US008175751B2

(12) United States Patent
Thakur et al.

(10) Patent No.: US 8,175,751 B2
(45) Date of Patent: May 8, 2012

(54) COMPUTER-IMPLEMENTED SYSTEMS AND METHODS FOR SCREENING AND PREDICTING THE PERFORMANCE OF ENHANCED OIL RECOVERY AND IMPROVED OIL RECOVERY METHODS

(75) Inventors: Ganesh Thakur, Houston, TX (US); Arnaldo L. Espinel, Richmond, TX (US); Suryo Yudono, Riau (ID); Rodolfo Martin Terrado, Midland, TX (US)

(73) Assignee: Chevron U.S.A. Inc., San Ramon, CA (US)

( * ) Notice: Subject to any disclaimer, the term of this patent is extended or adjusted under 35 U.S.C. 154(b) by 347 days.

(21) Appl. No.: 12/472,920

(22) Filed: May 27, 2009

(65) Prior Publication Data

US 2010/0300682 A1 Dec. 2, 2010

(51) Int. Cl.
*G05B 21/00* (2006.01)

(52) U.S. Cl. ..... 700/266; 703/10

(58) Field of Classification Search ..... 700/266, 700/272

See application file for complete search history.

(56) References Cited

U.S. PATENT DOCUMENTS 4,951,921 A * 8/1990 Stahl et al. ..... 166/270
5,076,363 A * 12/1991 Kalpakci et al. ..... 166/270.1
5,080,809 A * 1/1992 Stahl et al. ..... 507/221
5,186,257 A * 2/1993 Stahl et al. ..... 166/270.1
5,382,371 A * 1/1995 Stahl et al. ..... 507/221
6,030,928 A * 2/2000 Stahl et al. ..... 507/121
6,574,565 B1 * 6/2003 Bush ..... 702/14
6,828,281 B1 * 12/2004 Hou et al. ..... 507/227
7,055,602 B2 * 6/2006 Shpakoff et al. ..... 166/268
7,137,447 B2 * 11/2006 Shpakoff et al. ..... 166/268
7,229,950 B2 * 6/2007 Shpakoff et al. ..... 507/218
7,426,959 B2 * 9/2008 Wang et al. ..... 166/52
7,601,320 B2 * 10/2009 Van Dorp et al. ..... 423/443
7,612,022 B2 * 11/2009 Shpakoff et al. ..... 507/209
7,654,322 B2 * 2/2010 Wang et al. ..... 166/266
7,707,013 B2 * 4/2010 Valdez et al. ..... 703/2
7,774,184 B2 * 8/2010 Balci et al. ..... 703/10
7,926,561 B2 * 4/2011 Berg ..... 166/245
7,963,327 B1 * 6/2011 Saleri et al. ..... 166/252.1
7,966,164 B2 * 6/2011 Valdez et al. ..... 703/10
2007/0143025 A1 6/2007 Valdez et al.
2007/0143026 A1 6/2007 Valdez et al.
2009/0020284 A1 1/2009 Graf et al.

OTHER PUBLICATIONS

Benton, et al., "Early Implementation of a Full-Scale Waterflood in the Abo Reef, Terry Co., TX—A Case History", SPE 9475, American Institute of Mining, Metallurgical, and Petroleum Engineers, Inc., 1980, 12 pages.

Bush et al., "Empirical Prediction of Recovery Rate in Waterflooding Depleted Sands", SPE 2109, SPE Eighth Secondary Recovery Symposium, Wichita Falls, Texas, May 6-7, 1968, pp. 933-943.

(Continued)

*Primary Examiner* — Ramesh Patel
*Assistant Examiner* — Anthony Whittington

(57) ABSTRACT

Computer-implemented systems and methods are provided for screening among various EOR process for application to a reservoir. Also provided are computer-implemented systems and methods for screening the feasibility of a waterflood process for application in a reservoir and for recommending a waterflood injection scheme to be applied. In addition, computer-implemented systems and methods for predicting the performance of a waterflood process in a reservoir are provided. Computer-implemented systems and methods for predicting the performance of a polymer flood technique in a reservoir also are provided. The performance of the polymer flood process may be compared to the performance of a waterflood process.

14 Claims, 58 Drawing Sheets

OTHER PUBLICATIONS

Craig, et al., "Oil Recovery Performance of Pattern Gas or Water Injection Operations from Model Tests", Petroleum Transactions, vol. 204, 1955, pp. 7-15.
Craig, "Predicting Waterflood Performance", from Reservoir Engineering Aspects of Waterflooding, SPE Monograph Series vol. 3, 1993, pp. 81-82.
Dyes et al., "Oil Production after Breakthrough—as Influenced by Mobility Ratio", T.P. 3784, Petroleum Transactions, AIME, Journal of Petroleum Technology, Apr. 1954, pp. 27-32.
Dykstra, H. et al., "The Prediction of Oil Recovery by Water Flood", Secondary Recovery of Oil in the United States, Chapter 12, American Petroleum Institute, New York 1950, 2nd Ed. pp. 160-174.
El-Khatib, et al., "The Application of Buckley-Leverett Displacement to Waterflooding in Non-Communicating Stratified Reservoirs", SPE 68076, Society of Petroleum Engineers, 2001, 12 pages.
Snyder et al., "Application of Buckley Leverett Displacement Theory to Noncommunicating Layered Systems", Journal of Petroleum Technology, Nov. 1967, pp. 1500-1506.
Stiles, "Use of Permeability Distribution in Water Flood Calculations", T.P. 2513, Petroleum Transactions, AIME, Jan. 1949, pp. 9-13.
Thakur et a., "Integrated Waterflood Asset Management", PennWell Publishing Co., 1988.
U.S. Appl. No. 12/472,920, filed May 27, 2009, by Ganesh Thakur et al.
PCT Application PCT/US2010/036158, filed on May 26, 2010, by Arnoldo L. Espinel et al.
PCT Application PCT/US2010/036158, Notification of Transmittal of the International Search Report and the Written Opinion of the International Search Authority, dated Dec. 27, 2010, 10 pages.

* cited by examiner

201

EORScreen 203 Quick Help FAQ

| Parameter | Type | Units | Input | | Parameter Definition |
|---|---|---|---|---|---|
| Field Name | | | Sample | | Name of the working field or basin |
| Reservoir Name | | | 1 | | Name of the specific reservoir |
| Current EOR / IOR | | | Waterflood | | Current production method (i.e. primary, CO2, waterflood) |
| Depth | G | ft | 2,000 | | True vertical depth to bottom of reservoir |
| Rock Type | G | (text) | Sandstone | | Basic rock type |
| Oil Gravity | HC | °API | 18 | | API gravity (at standard conditions) |
| Oil Viscosity | HC | cP | 345 | | Oil viscosity at reservoir conditions |
| Net Thickness | RP | ft | 33 | | Bed thickness |
| Current Reservoir Pressure | RP | psi | 450 | | Current reservoir pressure |
| Minimum Oil Content | RP | bbl/acre-ft | 1,385 | Calc | 7758 * Porosity * remaining oil saturation (ROS @ start of EOR) |
| Mobile Oil Saturation @ start at EOR (ROS - Sorw) | RP | % | 27 | Calc | Mobile oil saturation @ start at EOR |
| Oil Saturation - in water swept zones (Sorw) | RP | % | 24 | | Residual oil saturation at the end of the waterflood |
| Remaining Oil Saturation @ start of EOR (ROS) | RP | % | 51 | | Remaining oil saturation @ start of EOR |
| Permeability | RP | mD | 1,550 | | Absolute permeability |
| Porosity | RP | % | 35 | | Average total porosity |
| Temperature | RP | °F | 192 | | Reservoir temperature |
| Transmissibility | RP | mD-ft/cP | 148 | Calc | Transmissibility |
| Water Salinity | WP | ppm (TDS) | 1,200 | | Total dissolved solids in the water phase |
| Fracture | G | (text) | | | Fracture network within reservoir |
| Gas Cap | G | (text) | Yes - Depleted | | Relative size of the gas cap (small, medium, large) to the oil zone |
| Dip Angle | G | degree | 45 | | Angle of the bed from horizontal |
| Net to Gross Ratio | RP | fraction | 0.8 | | Ratio of net to gross thickness |
| Well Spacing | RP | acres | | | Acres per well |
| Receptivity | RP | bwpd/ft | ~60 | | Amount of water that can be injected into the reservoir without fracturing |
| HCComposition | HC | (text) | | | Hydrocarbon composition |
| Minimum Miscibility Pressure | HC | psi | 8,150 | Calc | The MMP is the minimum pressure where the two phases are totally miscible in each other |
| Pressure Ratio (Pcurrent/MMP) | HC | fraction | 0.06 | | |
| Initial Pressure | RP | psi | 865 | Calc | Reservoir pressure at the time of discovery |
| Drive Mechanism | RP | (text) | Solution gas , Gravity | | |
| Gas Saturation | RP | % | 15 | | |
| Bubble Point Pressure | RP | psi | | | Pressure at which gas first comes out of solution at reservoir temperature |
| Critical Gas Saturation | RP | % | 10 | | |
| Gas Ratio (Sgc/Sgi) | RP | fraction | | | |
| Dykstra-Parsons Coefficient | RP | fraction | 0.8 | Calc | Estimation of vertical heterogeneity in reservoir |
| Vertical Sweep Factor | RP | fraction | Varies | | |
| Hardness | WP | ppm | | | |
| Water Divalent Ions | WP | ppm | 2,500 | | |
| Water Multivalent Ions | WP | ppm | | | |
| Water Iron Content | WP | ppm | 5 - 50 | | |
| Water Boron Content | WP | ppm | | | |

Fig. 2

301

EORScreen — Field : Sample - Reservoir : 1 — Refresh — Quick Help

Save Current File | cutemp1

113

111

| Parameter | Type | Units | Input | Waterflood | CO2 | Hydrocarbon Gas Injection | Nitrogen & Flue Gas | Surfactant-Polymer & Alkaline-Surfactant-Polymer | Polymer | Steamflood | Insitu Combustion |
|---|---|---|---|---|---|---|---|---|---|---|---|
| | | | | Overall EOR Screening: Total Number of Strikes | | | | | | | |
| | | | | 2 | 2 | 2 | 2 | 2 | 2 | 4 | 4 |
| Current EOR / IOR | | | Waterflood | | | | | | | | |
| Depth | G | ft | 2,000 | Design Matter | 0 | 0 | 1 | Design matter | gn matter for tempor | 0 | 0 |
| Rock Type | G | (text) | Sandstone | 0 | 0 | 0 | 0 | 0 | 0 | 0 | 0 |
| Oil Gravity | HC | °API | 10 | 1 | 1 | 1 | 1 | 1 | 1 | 0 | 0 |
| Oil Viscosity | HC | cP | 345 | 1 | 1 | 1 | 1 | 1 | 1 | 0 | 0 |
| Net Thickness | RP | ft | 33 | Not critical | | Thin unless dipping | Thin unless dipping | 0 | | 0 | 0 |
| Current Reservoir Pressure | RP | psi | 450 | Design matter | | | | | | 0 | |
| Minimum Oil Content | RP | bbl/acre-ft | 1,385 | Not critical | | | | | | 0 | 0 |
| Mobile Oil Saturation @ start at EOR (ROS - Sorw) | RP | % | 27 | | | | | | Design matter | | |
| Oil Saturation - in water swept zones (Sorw) | RP | % | 24 | | | | | | | | |
| Remaining Oil Saturation @ start of EOR (ROS) | RP | % | 51 | 0 | 0 | 0 | 0 | 0 | 0 | | Design matter |
| Permeability | RP | mD | 1,550 | 0 | Not critical | Not critical | Not critical | 0 | 0 | Design matter | 0 |
| Porosity | RP | % | 35 | Not critical | | | | | | | |
| Temperature | RP | F | 192 | Not critical | 0 | Not critical | Not critical | 0 | 0 | | |
| Transmissibility | RP | mD-ft/cP | 148 | Not critical | | | | | | Design matter | 0 |
| Water Salinity | WP | ppm (TDS) | 1,200 | Design matter | | | | 0 | Design matter | Design matter | |
| Fracture | G | (text) | | | Design matter | | | | Non-extensive | Non-extensive | |
| Gas Cap | G | (text) | Yes - Depleted | Design matter | | | | Only if successful water flood | None to minor | Small compared to oil thickness | Small compared to oil thickness |
| Dip Angle | G | degree | 45 | | Not critical | | | | | | |
| Net to Gross Ratio | RP | fraction | 0.8 | | | | | | | | |
| Well Spacing | RP | acres | | | | | | | | | |
| Receptivity | RP | bwpd/ft | ~60 | | | | | | | | |
| HCComposition | HC | (text) | | | | High % of C2-C7 | High % of C1-C7 | | | Not critical | Design matter |
| Minimum Miscibility Pressure | HC | psi | 8,150 | | | | | | | | |
| Pressure Ratio (Pcurrent/MMP) | HC | fraction | 0.06 | | Design matter | | | | | | |
| Initial Pressure | RP | psi | 866 | | | | | | | | |
| Drive Mechanism | RP | (text) | n gas, Gravity | None to weak water drive | | | | | | | |
| Gas Saturation | RP | % | 10 | Design matter | | | | | | | |
| Bubble Point Pressure | RP | psi | | | | | | | | | |
| Critical Gas Saturation | RP | % | 10 | | | | | | | | |
| Gas Ratio (Sgc/Sgi) | RP | fraction | | | | | | | | | |
| Dykstra-Parsons Coefficient | RP | fraction | 0.80 | | | | | | | | |
| Vertical Sweep Factor | RP | fraction | Varies | | | | | | | | |
| Hardness | WP | ppm | | Design matter | | | | | | | |
| Water Divalent Ions | WP | ppm | 2,500 | | | | | Design matter | Design matter | | |
| Water Multivalent Ions | WP | ppm | | | | | | Design matter | Design matter | | |
| Water Iron Content | WP | ppm | 5 - 50 | | | | | Design matter | Design matter | | |
| Water Boron Content | WP | ppm | | | | | | | | | |

Fig. 3

EORScreen — Field : Sample - Reservoir : 1 — Refresh | Quick Help

Save Project | cxtempt

| Parameter | Type | Units | Input | Waterflood | CO2 | Hydrocarbon Gas Injection | Nitrogen & Flue Gas | Surfactant Polymer & Alkaline Surfactant Polymer | Polymer | Steamflood | Insitu Combustion |
|---|---|---|---|---|---|---|---|---|---|---|---|
| Overall EOR Screening: Total Number of Strikes | | | | 2 | 3 | 3 | 3 | 2 | 2 | 1 | 1 |
| Current EOR / IOR | | | Waterflood | | | | | | | | |
| Depth | G | ft | 200 | Design Matter | | 1 | | Design matter | gn matter for temper | 1 | 1 |
| Rock Type | G | (text) | Sandstone | 0 | 0 | 0 | 0 | 0 | 0 | 0 | 0 |
| Oil Gravity | HC | °API | 10 | 1 | 1 | 1 | 1 | 1 | 1 | 0 | 0 |
| Oil Viscosity | HC | cP | 345 | 1 | 1 | 1 | 1 | 1 | 1 | 0 | 0 |
| Net Thickness | RP | ft | 33 | Not critical | | Thin unless dipping | Thin unless dipping | 0 | | 0 | 0 |
| Current Reservoir Pressure | RP | psi | 450 | Design matter | | | | | | 0 | |
| Minimum Oil Content | RP | bbl/acre-ft | 1,385 | Not critical | | | | | | 0 | 0 |
| Mobile Oil Saturation @ start at EOR (ROS - Sorw) | RP | % | 27 | | | | | | Design matter | | |
| Oil Saturation - in water swept zones (Sorw) | RP | % | 24 | | | | | | | | |
| Remaining Oil Saturation @ start of EOR (ROS) | RP | % | 51 | 0 | 0 | 0 | 0 | 0 | 0 | | Design matter |
| Permeability | RP | mD | 1,550 | 0 | Not critical | Not critical | Not critical | 0 | 0 | Design matter | 0 |
| Porosity | RP | % | 35 | Not critical | | | | | | | |
| Temperature | RP | °F | 192 | Not critical | 0 | Not critical | Not critical | 0 | 0 | | |
| Transmissibility | RP | mD-ft/cP | 148 | Not critical | | | | | | Design matter | 0 |
| Water Salinity | WP | ppm (TDS) | 1,200 | Design matter | | | | 0 | Design matter | Design matter | |
| Fracture | G | (text) | | | Design matter | | | | Non-extensive | Non-extensive | |
| Gas Cap | G | (text) | Yes - Depleted | Design matter | | | | Only if successful water flood | None to minor | Small compared to oil thickness | Small compared to oil thickness |
| Dip Angle | G | degree | 45 | | Not critical | | | | | | |
| Net to Gross Ratio | RP | fraction | 0.8 | | | | | | | | |
| Well Spacing | RP | acres | | | | | | | | | |
| Receptivity | RP | bwpd/ft | ~60 | | | | | | | | |
| HCComposition | HC | (text) | | | | High % of C2-C7 | High % of C1-C7 | | | Not critical | Design matter |
| Minimum Miscibility Pressure | HC | psi | 8,150 | | | | | | | | |
| Pressure Ratio (Pcurrent/MMP) | HC | fraction | 0.06 | | Design matter | | | | | | |
| Initial Pressure | RP | psi | 87 | | | | | | | | |
| Drive Mechanism | RP | (text) | n gas , Gravity | None to weak water drive | | | | | | | |
| Gas Saturation | RP | % | 10 | Design matter | | | | | | | |
| Bubble Point Pressure | RP | psi | | | | | | | | | |
| Critical Gas Saturation | RP | % | 10 | | | | | | | | |
| Gas Ratio (Sgc/Sgi) | RP | fraction | | | | | | | | | |
| Dykstra-Parsons Coefficient | RP | fraction | 0.80 | | | | | | | | |
| Vertical Sweep Factor | RP | fraction | Varies | | | | | | | | |
| Hardness | WP | ppm | | Design matter | | | | | | | |
| Water Divalent Ions | WP | ppm | 2,500 | | | | | Design matter | Design matter | | |
| Water Multivalent Ions | WP | ppm | | | | | | Design matter | Design matter | | |
| Water Iron Content | WP | ppm | 5 - 50 | | | | | Design matter | Design matter | | |
| Water Boron Content | WP | ppm | | | | | | | | | |

113

111

Fig. 4

Waterflood Screening - 601 603

Clear Input | Use Saved Data | Example Cases | Help | FAQ

Evaluation Result : Waterflood project is unlikely

| Parameter | Type | Units | Input | Calc | Input description |
|---|---|---|---|---|---|
| Field Name | | | Example 2 | | Name of the working field or basin |
| Reservoir Name | | | Example | | Name of the specific reservoir |
| Type of Aquifer | RP | (text) | Large aquifer | | Type of reservoir aquifer (water drive mechanism) |
| Mobility Ratio (M) | RP | fraction | [illegible] | Calc | Measure of the relative rate of oil movement to water movement |
| Average Permeability | RP | mD | 1.0 | | Average k in the reservoir |
| Transmissibility | RP | mD*ft/cP | [illegible] | Calc | Capacity of a rock to transmit fluids (k*h/mhuo) |
| Remaining Oil Saturation @ start WF (ROS) | RP | % | 41.0 | | Remaining oil saturation @ start of WF (Mat bal calculation) |
| Kro | RP | fraction | 0.80 | | Rel Perm of oil @ oil bank (at irreducible water saturation)-endpoints of kr/Sw curves |
| Krw | RP | fraction | 0.20 | | Rel Perm to water @ at Sor - endpoints of kr/Sw curves |
| Oil Viscosity | HC | cP | 34.0 | | Oil viscosity at reservoir conditions |
| Oil Gravity | HC | °API | 20.0 | | API gravity at standard conditions |
| Water Viscosity | WP | cP | 0.7 | | Water viscosity at reservoir conditions |
| Net Thickness | RP | ft | 10 | | Clean sand thickness |
| Fractured Reservoir | RP | (text) | Connecting | | Fracture network within the reservoir (connecting/not connecting/not fractured) |
| Porosity | RP | % | 13.0 | | Average porosity |
| Current GOR / Initial GOR | RP | fraction | 0.2 | Calc | Current GOR / Initial GOR |
| Initial GOR (Rsi) | RP | SCF/STB | 100 | | Initial GOR |
| Current Producing GOR (Rp) | RP | SCF/STB | 300 | | GOR at the moment of the screening |
| Location | G | | Offshore | | Onshore / Offshore |
| Rock Type | G | (text) | Sandstone | | Basic rock type |
| Depth | G | ft | 1,600 | | True vertical depth of the bottom of reservoir |
| Structure Dip Angle | G | degree | 3 | | Angle of the bed from horizontal |
| Net to Gross Ratio | RP | fraction | 0.60 | | Ratio of net to gross thickness |
| Dykstra-Parsons Coefficient | RP | fraction | 0.80 | Default | Estimation of vertical heterogeneity in reservoir. Default: 0.8 sands, 0.9 carbonates |
| Receptivity | RP | bwpd/ft | 2.0 | | Amount of water that can be injected into the reservoir without fracturing |
| Residual Oil Saturation - in water swept zones (Sor) | RP | % | 26.0 | | Estimated residual oil saturation at the end of the waterflood |
| Mobile Oil Saturation @ start WF (ROS - Sor) | RP | % | 15.0 | Calc | Mobile oil saturation @ start at WF |
| Well Spacing | RP | acres | 40 | | Acres per well |
| Temperature | RP | °F | 173 | | Reservoir temperature |
| Initial Pressure | RP | psi | 900 | | Reservoir pressure at the time of discovery |
| Current Reservoir Pressure | RP | psi | 230 | | Current reservoir pressure |
| Bubble Point Pressure | RP | psi | 118 | | Pressure at which gas first comes out of solution at reservoir temperature |
| Tarmat presence | RP | yes/no | no | | Consider heterogeneity / reservoir discontinuity caused by Tar mat |
| Water salinity | RP | ppm | Compatible | | Reservoir water salinity |

Fig. 6

Waterflood Screening 601

Clear Input | Use Saved Data | Example Cases | Help | FAQ

Evaluation Result : Waterflood project is unlikely

| Parameter | Type | Units | Input | Calc | Input description |
|---|---|---|---|---|---|
| Field Name | | | Example 2 | | Name of the working field or basin |
| Reservoir Name | | | Example | | Name of the specific reservoir |
| Type of Aquifer | RP | (text) | Large aquifer | | ...ve mechanism) |
| Mobility Ratio (M) | RP | fraction | [illegible] | | ...t movement to water movement |
| Average Permeability | RP | mD | 1.0 | | |
| Transmissibility | RP | mD ft/cP | [illegible] | | ...ds (k h/mu) |
| Remaining Oil Saturation @ start WF (ROS) | RP | % | 41.0 | | ...t of WF (Material calculation) |
| Kro | RP | fraction | 0.80 | | Rel Perm of oil @ oil bank (at irreducible water saturation)-endpoints of kr/Sw curves |
| Krw | RP | fraction | 0.20 | | Rel Perm to water @ at Sor - endpoints of kr/Sw curves |
| Oil Viscosity | HC | cP | 34.0 | | Oil viscosity at reservoir conditions |
| Oil Gravity | HC | °API | 20.0 | | API gravity at standard conditions |
| Water Viscosity | WP | cP | 0.7 | | Water viscosity at reservoir conditions |
| Net Thickness | RP | ft | 10 | | Clean sand thickness |
| Fractured Reservoir | RP | (text) | Connecting | | Fracture network within the reservoir (connecting/not connecting/not fractured) |
| Porosity | RP | % | 13.0 | | Average porosity |
| Current GOR / Initial GOR | RP | fraction | 0.2 | Calc | Current GOR / Initial GOR |
| Initial GOR (Rsi) | RP | SCF/STB | 100 | | Initial GOR |
| Current Producing GOR (Rp) | RP | SCF/STB | 300 | | GOR at the moment of the screening |
| Location | G | | Offshore | | Onshore / Offshore |
| Rock Type | G | (text) | Sandstone | | Basic rock type |
| Depth | G | ft | 1,600 | | True vertical depth of the bottom of reservoir |
| Structure Dip Angle | G | degree | 3 | | Angle of the bed from horizontal |
| Net to Gross Ratio | RP | fraction | 0.60 | | Ratio of net to gross thickness |
| Dykstra-Parsons Coefficient | RP | fraction | 0.80 | default | Estimation of vertical heterogeneity in reservoir. Default: 0.8 sands, 0.9 carbonates |
| Receptivity | RP | bwpd/ft | 2.0 | | Amount of water that can be injected into the reservoir without fracturing |
| Residual Oil Saturation - in water swept zones (Sor) | RP | % | 26.0 | | Estimated residual oil saturation at the end of the waterflood |
| Mobile Oil Saturation @ start WF (ROS - Sor) | RP | % | 15.0 | Calc | Mobile oil saturation @ start of WF |
| Well Spacing | RP | acres | 40 | | Acres per well |
| Temperature | RP | °F | 173 | | Reservoir temperature |
| Initial Pressure | RP | psi | 900 | | Reservoir pressure at the time of discovery |
| Current Reservoir Pressure | RP | psi | 200 | | Current reservoir pressure |
| Bubble Point Pressure | RP | psi | 118 | | Pressure at which gas first comes out of solution at reservoir temperature |
| Tarmat presence | RP | yes/no | no | | Consider heterogeneity / reservoir discontinuity caused by Tar mat |
| Water salinity | RP | ppm | Compatible | | Reservoir water salinity |

Higher limit >= 12

High M does not mean unsuccessful WF, but more water and WOR and time could be needed to reach the same recovery value.

Fig. 7

Waterflood Screening - 601

Clear Input | Use Saved Data | Example Cases | Help | FAQ

Evaluation Result : Waterflood Project is Feasible

| Parameter | Type | Units | Input | Calc | Input description |
|---|---|---|---|---|---|
| Field Name | | | Example 2 | | Name of the working field or basin |
| Reservoir Name | | | Example | | Name of the specific reservoir |
| Type of Aquifer | RP | (text) | Large aquifer | | Type of reservoir aquifer (water drive mechanism) |
| Mobility Ratio (M) | RP | fraction | 11.8 | Calc | Measure of the relative rate of oil movement to water movement |
| Average Permeability | RP | mD | 1.0 | | Average k in the reservoir |
| Transmissibility | RP | mD*ft/cP | [illegible] | Calc | Capacity of a rock to transmit fluids (k*h/mμo) |
| Remaining Oil Saturation @ start WF (ROS) | RP | % | 41.0 | | Remaining oil saturation @ start of WF (Mat bal calculation) |
| Kro | RP | fraction | 0.80 | | Rel Perm of oil @ oil bank (at irreducible water saturation)-endpoints of kr/Sw curves |
| Krw | RP | fraction | 0.20 | | Rel Perm to water @ at Sor - endpoints of kr/Sw curves |
| Oil Viscosity | HC | cP | 33.0 | | Oil viscosity at reservoir conditions |
| Oil Gravity | HC | °API | 20.0 | | API gravity at standard conditions |
| Water Viscosity | WP | cP | 0.7 | | Water viscosity at reservoir conditions |
| Net Thickness | RP | ft | 10 | | Clean sand thickness |
| Fractured Reservoir | RP | (text) | Connecting | | Fracture network within the reservoir (connecting/not connecting/not fractured) |
| Porosity | RP | % | 13.0 | | Average porosity |
| Current GOR / Initial GOR | RP | fraction | 0.2 | Calc | Current GOR / Initial GOR |
| Initial GOR (Rsi) | RP | SCF/STB | 100 | | Initial GOR |
| Current Producing GOR (Rp) | RP | SCF/STB | 300 | | GOR at the moment of the screening |
| Location | G | | Offshore | | Onshore / Offshore |
| Rock Type | G | (text) | Sandstone | | Basic rock type |
| Depth | G | ft | 1,600 | | True vertical depth of the bottom of reservoir |
| Structure Dip Angle | G | degree | 3 | | Angle of the bed from horizontal |
| Net to Gross Ratio | RP | fraction | 0.60 | | Ratio of net to gross thickness |
| Dykstra-Parsons Coefficient | RP | fraction | 0.80 | default | Estimation of vertical heterogeneity in reservoir. Default: 0.8 sands, 0.9 carbonates |
| Receptivity | RP | bwpd/ft | 2.0 | | Amount of water that can be injected into the reservoir without fracturing |
| Residual Oil Saturation - in water swept zones (Sor) | RP | % | 26.0 | | Estimated residual oil saturation at the end of the waterflood |
| Mobile Oil Saturation @ start WF (ROS - Sor) | RP | % | 15.0 | Calc | Mobile oil saturation @ start at WF |
| Well Spacing | RP | acres | 40 | | Acres per well |
| Temperature | RP | °F | 173 | | Reservoir temperature |
| Initial Pressure | RP | psi | 900 | | Reservoir pressure at the time of discovery |
| Current Reservoir Pressure | RP | psi | 200 | | Current reservoir pressure |
| Bubble Point Pressure | RP | psi | 118 | | Pressure at which gas first comes out of solution at reservoir temperature |
| Tarmat presence | RP | yes/no | no | | Consider heterogeneity / reservoir discontinuity caused by Tar mat |
| Water salinity | RP | ppm | Compatible | | Reservoir water salinity |

Fig. 8

Waterflood Screening 601

Clear Input | Use Saved Data | Example Cases | Help | FAQ

Evaluation Result : Waterflood Project is Feasible

| Parameter | Type | Units | Input | Calc | Input description |
|---|---|---|---|---|---|
| Field Name | | | Example 2 | | Name of the working field or basin |
| Reservoir Name | | | Example | | Name of the specific reservoir |
| Type of Aquifer | RP | (text) | Large aquifer | | Type of reservoir aquifer (water drive mechanism) |
| Mobility Ratio (M) | RP | fraction | 11.8 | Calc | Measure of the relative rate of oil movement to water movement |
| Average Permeability | RP | mD | 1.0 | | Average k in the reservoir |
| Transmissibility | RP | mD*ft/cP | [illegible] | Calc | Capacity of a rock to transmit fluids (k*h/mbuo) |
| Remaining Oil Saturation @ start WF (ROS) | RP | % | 41.0 | | Remaining oil saturation @ start of WF (Mat bal calculation) |
| Kro | RP | fraction | 0.80 | | Rel Perm of oil @ oil bank (at irreducible water saturation)-endpoints of kr/Sw curves |
| Krw | RP | fraction | 0.20 | | Rel Perm to water @ at Sor - endpoints of kr/Sw curves |
| Oil Viscosity | HC | cP | 32.0 | | Oil viscosity at reservoir conditions |
| Oil Gravity | HC | °API | 20.0 | | API gravity at standard conditions |
| Water Viscosity | WP | cP | 0.7 | | Water viscosity at reservoir conditions |
| Net Thickness | RP | ft | 10 | | Clean sand thickness |
| Fractured Reservoir | RP | (text) | Connecting | | Fracture network within the reservoir (connecting/not connecting/not fractured) |
| Porosity | RP | % | 13.0 | | Average porosity |
| Current GOR / Initial GOR | RP | fraction | 0.2 | Calc | Current GOR / Initial GOR |
| Initial GOR (Rsi) | RP | SCF/STB | 100 | | Initial GOR |
| Current Producing GOR (Rp) | RP | SCF/STB | 300 | | GOR at the moment of the screening |
| Location | G | | Offshore | | Onshore / Offshore |
| Rock Type | G | (text) | Sandstone | | Basic rock type |
| Depth | G | ft | 1,600 | | True vertical depth of the bottom of reservoir |
| Structure Dip Angle | G | degree | 3 | | Angle of the bed from horizontal |
| Net to Gross Ratio | RP | fraction | 0.60 | | Ratio of net to gross thickness |
| Dykstra-Parsons Coefficient | RP | fraction | 0.80 | Default | Estimation of vertical heterogeneity in reservoir. Default: 0.8 sands, 0.9 carbonates |
| Receptivity | RP | bwpd/ft | 2.0 | | Amount of water that can be injected into the reservoir without fracturing |
| Residual Oil Saturation - in water swept zones (Sor) | RP | % | 26.0 | | Estimated residual oil saturation at the end of the waterflood |
| Mobile Oil Saturation @ start WF (ROS - Sor) | RP | % | 15.0 | Calc | Mobile oil saturation @ start at WF |
| Well Spacing | RP | acres | 40 | | Acres per well |
| Temperature | RP | °F | 173 | | Reservoir temperature |
| Initial Pressure | RP | psi | 900 | | Reservoir pressure at the time of discovery |
| Current Reservoir Pressure | RP | psi | 200 | | Current reservoir pressure |
| Bubble Point Pressure | RP | psi | 118 | | Pressure at which gas first comes out of solution at reservoir temperature |
| Tarmat presence | RP | yes/no | no | | Consider heterogeneity / reservoir discontinuity caused by Tar mat |
| Water salinity | RP | ppm | Compatible | | Reservoir water salinity |

Fig. 9

Waterflood Injection Scheme 602

☑ Use Module 1 Input | Clear Selection | Check Required Input

*The most likely scheme to be applied will be : Peripheral*

Peripheral Pattern

| Parameter | Range R1 | Range R2 |
|---|---|---|
| Reservoir continuity | Continuous formations / Few or no barriers ◉ | k barriers present / faults ○ |
| Main recovery mechanism | MR 1 ◉ | MR 2 ○ |
| Main objective | MO 1 ◉ | MO 2 ○ |
| Rock type and permeability | RT 1 ◉ | RT 1 |
| Dykstra-Parsons coefficient (fraction) | D-P 1 ◉ | D-P 1 |
| I/P ratio(inj to prod rates) | I/P 1 ◉ | I/P 1 ○ |
| Mobility ratio | M 1 | M 1 ◉ |
| Transmissibility (mD-ft/cP) | T 1 ◉ | T 1 |
| Structure dip (degrees) | ≥ 5 ◉ | < 5 |
| Reservoir location | RL 1 | RL 2 ◉ |
| Time of application | T 1 ○ | T 2 ○ |
| Depth and costs | D 1 ○ | D 2 ○ |
| Reservoir pressure | RP 1 ○ | RP 2 ○ |
| Water volume requirements | WV 1 ○ | WV 2 ○ |

Fig. 10

Waterflood Injection Scheme 602

☑ Use Module 1 Input | Clear Selection | Check Required Input

*The most likely scheme to be applied will be : Pattern*

Peripheral | Pattern

| Parameter | Range R1 | Range R2 |
|---|---|---|
| Reservoir continuity | Continuous formations / Few or no barriers ○ | k barriers present / faults ◉ |
| Main recovery mechanism | MR 1 ○ | MR 2 ◉ |
| Main objective | MO 1 ○ | MO 2 ◉ |
| Rock type and permeability | RT 1 ◉ | RT 2 |
| Dykstra-Parsons coefficient (fraction) | D-P 1 ◉ | D-P 1 |
| I/P ratio(inj to prod rates) | I/P 1 ○ | I/P 1 ◉ |
| Mobility ratio | M 1 | M 1 ◉ |
| Transmissibility (mD-ft/cP) | T 1 ◉ | T 1 |
| Structure dip (degrees) | ≥ 5 ◉ | < 5 |
| Reservoir location | RL 1 | RL 2 ◉ |
| Time of application | T 1 ○ | T 2 ○ |
| Depth and costs | D 1 ○ | D 2 ○ |
| Reservoir pressure | RP 1 ○ | RP 2 ○ |
| Water volume requirements | WV 1 ○ | WV 2 ○ |

Fig. 11

Waterflood Injection Scheme 602

☑ Use Module 1 Input | Clear Selection | Check Required Input

*The most likely scheme to be applied will be : Pattern*

Peripheral | Pattern

| Parameter | Range R1 | | Range R2 | |
|---|---|---|---|---|
| Reservoir continuity | Continuous formations / Few or no barriers | ○ | k barriers present / faults | ◉ |
| Main recovery mechanism | MR 1 | ○ | MR 2 | ◉ |
| Main objective | MO 1 | ○ | MO 2 | ◉ |
| Rock type and permeability | RT 1 | ◉ | RT 2 | |
| Dykstra-Parsons coefficient (fraction) | D-P 1 | ◉ | D-P 1 | |
| I/P ratio(inj to prod rates) | I/P 1 | ○ | I/P 1 | ◉ |
| Mobility ratio | M 1 | | M 1 | ◉ |
| Transmissibility (mD-ft/cP) | T 1 | ◉ | T 1 | |
| Structure dip (degrees) | ≥ 5 | ◉ | < 5 | |
| Reservoir location | RL 1 | | RL 2 | ◉ |
| Time of application | T 1 | ○ | T 2 | ○ |
| Depth and costs | D 1 | ○ | D 2 | ○ |
| Reservoir pressure | RP 1 | ○ | RP 2 | ○ |
| Water volume requirements | WV 1 | ○ | WV 2 | ○ |

Fig. 12

603

| Reservoir | Actual Condition | Screened Condition | Comments | Status |
|---|---|---|---|---|
| **Field 2** | Peripheral | Feasible Peripheral | High Water cut and/or small dip angle<br>Incremental recovery may justify pattern | OK |
| **Field 3** | Pattern | Feasible Pattern | Typical pattern scheme application<br>- HC displacement<br>- Discontinuities<br>- Low permeability and mobility<br>- Small dip angle | OK |
| **Field 4** | Pattern | Feasible Pattern | Typical pattern scheme application<br>- HC displacement<br>- Discontinuities<br>- Low permeability and mobility<br>- Small dip angle | OK |
| **Field 5** | Peripheral | Feasible Peripheral | Recommend peripheral<br>- High permeability<br>- Low Dykstra Parsons<br>- Reservoir continuity<br>- Offshore | OK |
| **Field 6** | Peripheral | Feasible Pattern | Pressure maintenance project<br>Recommend peripheral<br>- Medium permeability<br>- High transmissibility<br>Recommend pattern in the future<br>- Reservoir discontinuity (calcite barrier)<br>Require economic evaluation to decide the injection scheme | Warning |

Fig. 13

1701

Input Data Analysis:

Check Highlighted Parameters

General Data Summary

| | |
|---|---|
| Residual Saturation, $S_{wr}$ | 0.10 |
| Residual Oil Saturation, $S_{or}$ | 0.30 |
| Residual Gas Saturation, $S_{gr}$ | 0.00 |
| Initial Oil Saturation, $S_{oi}$ | 0.40 |
| Initial Gas Saturation, $S_{gi}$ | 0.15 |
| Initial Water Saturation, $S_{wi}$ | 0.45 |
| Water Viscosity, $\mu_w$ | 0.30 cp |
| Oil Viscosity, $\mu_o$ | 1.00 cp |
| Oil formation volume factor, $B_o$ | 1.20 RB/STB |
| Water formation factor, $B_w$ | 1.01 RB/STB |
| Area | 40.00 Acres |
| Net Thickness | 30.00 ft |
| Porosity | 0.20 fraction |
| Distance between wells, d | 466.65 ft |
| Reservoir Pressure Drop, $P_{res}$ | 1000.00 psi |
| Injection Pressure, $P_{inj}$ | 4000.00 psi |
| Wellbore Radius, $r_w$ | 1.00 ft |
| Number of Layers | 10 |
| Average Permeability | 12.23 md |
| Transmissibility | 611.50 md-ft/cp |

Note:
This the the summary of the input data
There are 3 colors of the input data:
1. White: If the input is in suitable range
2. Yellow: If the input is close to suitable range Layered Data No. Of Layers 10

| Layer | Thickness, ft | Permeability, md | Porosity |
|---|---|---|---|
| 1 | 5.00 | 31.50 | 0.20 |
| 2 | 5.00 | 20.50 | 0.20 |
| 3 | 5.00 | 16.00 | 0.20 |
| 4 | 5.00 | 13.10 | 0.20 |
| 5 | 5.00 | 10.90 | 0.20 |
| 6 | 5.00 | 8.20 | 0.20 |
| 7 | 5.00 | 7.70 | 0.20 |
| 8 | 5.00 | 6.30 | 0.20 |
| 9 | 5.00 | 4.90 | 0.20 |
| 10 | 5.00 | 3.20 | 0.20 |

Save A Copy of Input in Excel Workbook

Results>>

<<Change Data

Save Data

Fig. 17

| | | |
|---|---|---|
| viscosity of Oil | 2.54 | cp |
| viscosity of Water | 0.25 | cp |
| viscosity of Polymer | 2.0 | cp |
| Bo | 1.108 | |
| Bw | 1 | |
| Rock Density | 2.65 | g/cm³ |
| Number of Layers | 5 | |
| Pressure Drop | 1800 | psi |
| Wellbore Radius | 0.5833 | ft |
| Area | 40 | Acres |

| | |
|---|---|
| $kro_e$ | 1 |
| $n_o$ | 3 |
| $krw_e$ | 0.25 |
| $n_w$ | 2 |

| Layer | 1 | 2 | 3 | 4 | 5 |
|---|---|---|---|---|---|
| $S_{wi}$ (Fraction) | 0.17 | 0.17 | 0.17 | 0.17 | 0.17 |
| $S_{or}$ (Fraction) | 0.25 | 0.25 | 0.25 | 0.25 | 0.25 |
| $S_{gi}$ (Fraction) | 0 | 0 | 0 | 0 | 0 |
| Porosity (%) | 0.170 | 0.159 | 0.166 | 0.135 | 0.189 |
| Permeability (md) | 765.411 | 337.870 | 328.290 | 19.760 | 914.318 |
| Thickness (ft) | 3.872 | 4.610 | 5.688 | 5.442 | 0.774 |

Fig. 37

| | | |
|---|---|---|
| Viscosity of Oil | 1 | cp |
| Viscosity of Water | 0.5 | cp |
| Bo | 1.2 | |
| Bw | 1 | |
| Number of Layers | 10 | |
| Pressure Drop | 3000 | psi |
| Wellbore Radius | 1 | ft |
| Area | 40 | Acres |

| | |
|---|---|
| $kro_e$ | 1 |
| $n_o$ | 2.258487 |
| $krw_e$ | 0.74 |
| $n_w$ | 2.250687 |

| Layer | Permeabilty (md) | Thickness (ft) |
|---|---|---|
| 1 | 31.5 | 5 |
| 2 | 20.5 | 5 |
| 3 | 16 | 5 |
| 4 | 13.1 | 5 |
| 5 | 10.9 | 5 |
| 6 | 8.2 | 5 |
| 7 | 7.7 | 5 |
| 8 | 6.3 | 5 |
| 9 | 4.9 | 5 |
| 10 | 3.2 | 5 |

Fig. 40

Waterflood Screening

Help | Example Cases | Clear Input | Use Saved Data

| Parameter | Type | Units | Input | Calc | Input description |
|---|---|---|---|---|---|
| Field Name | | | | | Name of the working field or basin |
| Reservoir Name | | | | | Name of the specific reservoir |
| Drive Mechanism | | (text) | | | Type of production mechanism in the reservoir (Aquifer / weak or no aquifer) |
| Mobility Ratio (M) | RP | fraction | | Calc | Measure of the relative rate of oil movement to water movement |
| Average Permeability | RP | mD | | | Average k in the reservoir |
| Transmissibility | RP | mD*ft/cP | | Calc | Capacity of a rock to transmit fluids (k*h/mhuo) |
| Remaining Oil Saturation @ start WF (ROS) | RP | % | | | Remaining oil saturation @ start of WF (Material calculation) |
| Kro | RP | fraction | | | Rel Perm of oil @ oil bank (at irreducible water saturation)-endpoints of kr/Sw curves |
| Krw | RP | fraction | | | Rel Perm to water @ at Sor - endpoints of kr/Sw curves |
| Oil Viscosity | HC | cP | | | Oil viscosity at reservoir conditions |
| Oil Gravity | HC | °API | | | API gravity at standard conditions |
| Water Viscosity | WP | cP | | | Water viscosity at reservoir conditions |
| Net Thickness | RP | ft | | | Cle |
| Fractured Reservoir | RP | (text) | | | Fra ng/not fractured) |
| Porosity | RP | % | | | |
| Current GOR / Initial GOR | RP | [illegible] | | Calc | Current GOR / Initial GOR |
| Initial GOR | RP | SCF/STB | | | Initial GOR |
| Current GOR | RP | SCF/STB | | | GOR at the moment of the screening |
| Location | G | | | | Onshore / Offshore |
| Rock Type | G | (text) | | | Basic rock type |
| Depth | G | ft | | | True vertical depth of the bottom of reservoir |
| Structure Dip Angle | G | degree | | | Angle of the bed from horizontal |
| Net to Gross Ratio | RP | fraction | | | Ratio of net to gross thickness |
| Dykstra-Parsons Coefficient | RP | fraction | | Default | Estimation of vertical heterogeneity in reservoir. Default: 0.8 sands, 0.9 carbonates |
| Receptivity | RP | bwpd/ft | | | Amount of water that can be injected into the reservoir without fracturing |
| Residual Oil Saturation - in water swept zones (Sor) | RP | % | | | Estimated residual oil saturation at the end of the waterflood |
| Mobile Oil Saturation @ start WF (ROS - Sor) | RP | % | | Calc | Mobile oil saturation @ start of WF |
| Well Spacing | RP | acres | | | Acres per well |
| Temperature | RP | °F | | | Reservoir temperature |
| Initial Pressure | RP | psi | | | Reservoir pressure at the time of discovery |
| Current Reservoir Pressure | RP | | | | Current reservoir pressure |

Primary variables secondary variables

General variables

Fig. 43

Primary variables

Waterflood Injection Scheme

Use Module 1 Input | Clear Selection | Check Required

*The most likely scheme to be applied will be :* ral Pattern

| Parameter | Option 1 | Option 2 |
|---|---|---|
| Reservoir continuity | Continuous format ew or no barriers | k barriers present / faults |
| Main recovery mechanism | W water drive | Dissolved gas / gas cap / gravity segregation |
| Main objective | Pressure maintenance | HC displacement |
| Rock type and permeability | High perm sandstones or carbonates (k>45mD) | Low permeability sandstones or tight carbonates (k≤45 mD) |
| Dykstra-Parsons coefficient (fraction) | ≤ 0.8 (Acceptable heterogeneity) | >0.8 (Highly heterogen |
| (IP ratio/inj to prod rates) | ≥3:1 | <3:1 |
| Mobility ratio | M > 3 | M ≤ 3 |
| Transmissibility (mD-ft/cP) | ≥ 100 | < 100 |
| Structure dip (degrees) | ≥ 5 | < 5 |
| Reservoir location | Offshore | Onshore |
| Time of application | Early in reservoir life. Better before Pbp is reached | Late in reservoir life for displacement |
| Depth and costs | Deep reservoir, deep wells | Shallow reservoir, shallow wells |
| Reservoir pressure | Reservoir above saturation pressure | Reservoir below saturation pressure |
| Water volume requirements | High, according to flooded area (5 to 15 BWPD/net ft) | Low, according to flooded area (2 to 5 BWPD/net ft) |

Secondary variables

General variables

Fig. 44

Fig. 48

TABLE 8.1 — COMPARISON OF WATERFLOOD PREDICTION METHODS

| Method and Modification | Date Presented | Fluid Flow Effects: Consider Initial Gas Saturation? | Consider Saturation Gradient? | Consider Variable Injectivity? | Applies to: Linear System? | Five-spot Pattern? | Other Patterns? | Pattern Effects: Applicable Mobility Ratio? | Consider Areal Sweep? | Consider Increase Sweep After Breakthrough? | Require Pattern Lab Data? | Require Additional Lab Data? | Heterogeneity Effects: Consider Stratification Heterogeneity? | Consider Cross Flow? | Consider Spatial Variation? |
|---|---|---|---|---|---|---|---|---|---|---|---|---|---|---|---|
| Perfect Method | | yes | yes | yes | yes | yes | yes | any | yes | yes | no | no | yes | yes | yes |
| 1. Yuster-Soder-Calhoun | 1944 | yes | no | yes | — | yes | no | 1.0 | no | no | no | no | yes | no | no |
| Muskat | 1950 | no | no | yes | yes | no | no | any | no | no | no | no | yes | no | no |
| Prats et al. | 1959 | yes | no | yes | — | yes | no | any | yes | yes | yes | yes | yes | no | no |
| Dykstra-Parsons | 1950 | yes | no | no | yes | no | no | any | no | no | no | no | yes | no | no |
| Johnson | 1956 | yes | no | no | yes | no | no | any | no | no | no | no | yes | no | no |
| Felsenthal et al. | 1962 | yes | no | no | yes | no | no | any | no | no | no | no | yes | no | no |
| Stiles | 1949 | no | no | no | yes | no | no | 1.0 | no | no | no | no | yes | no | no |
| Schmalz-Rahme | 1950 | no | no | no | yes | no | no | 1.0 | no | no | yes | no | yes | no | no |
| Arps | 1956 | no | no | no | yes | no | no | 1.0 | no | no | no | no | yes | no | no |
| Ache | 1957 | no | no | no | — | yes | no | 1.0 | no | no | no | no | yes | no | no |
| Slider | 1961 | yes | no | yes | yes | yes | no | 1.0 | no | no | no | no | yes | no | no |
| Johnson | 1965 | no | no | no | yes | no | no | 1.0 | no | no | no | no | yes | no | no |
| 2. Muskat | 1946 | no | no | no | — | yes | yes | 1.0 | yes | no | no | no | no | no | no |
| Hurst | 1953 | no | no | no | — | yes | no | 1.0 | yes | yes | no | no | yes | no | no |
| Caudle et al | 1952-59 | no | no | yes | — | yes | yes | any | yes | yes | yes | no | yes | no | no |
| Aronofsky | 1952-56 | no | no | yes | — | yes | no | any | yes | no | yes | no | yes | no | no |
| Deppe-Hauber | 1961-64 | yes | no | yes | — | yes | yes | any | yes | yes | yes | no | yes | no | no |
| 3. Buckley-Leverett | 1942 | no | yes | no | yes | no | no | — | no | no | no | no | no | no | no |
| Roberts | 1959 | no | yes | no | yes | no | no | — | no | no | yes | no | yes | no | no |
| Rulus and Lynch | 1959 | no | yes | no | yes | no | no | any | no | no | no | no | yes | no | no |
| Snyder and Ramey | 1967 | no | yes | no | yes | no | no | any | no | no | no | no | yes | no | no |
| Craig-Geffen-Morse | 1955 | yes | yes | yes* | — | yes | no | any | yes | yes | yes | no | yes* | no | no |
| Hendrickson | 1961 | no | yes | no | — | yes | no | any | yes | yes | yes | no | yes | no | no |
| Wasson and Schnider | 1968 | yes | yes | yes* | — | yes | no | any | yes | yes | yes | yes | yes* | no | no |
| Rapoport et al. | 1958 | no | yes | no | yes | yes | no | any | yes | yes | yes | yes | yes | no | no |
| Higgins-Leighton | 1962-64 | yes | yes | yes | yes | yes | yes | any | yes | yes | yes | no | yes | no | no |
| 4. Douglas-Blair-Wagner | 1958 | no | yes | yes | — | yes | yes | any | yes | yes | yes | no | yes | no | no |
| Hiatt | 1958 | no | yes | no | yes | no | no | any | no | no | no | no | yes | yes | no |
| Douglas et al. | 1959 | no | yes | yes | — | yes | yes | any | yes | yes | no | no | yes | no | no |
| Warren-Cosgrove | 1964 | no | yes | no | yes | no | no | — | no | no | no | no | yes | yes | no |
| Morel-Seytoux | 1966-68 | no | yes | yes | — | yes | yes | any | yes | yes | no | no | yes | no | no |
| 5. Guthrie-Greenberger | 1955 | no | yes | no | — | — | yes | any | yes | yes | no | no | yes | yes | yes |
| Schauer | 1957 | yes | no | no | — | yes | no | any | yes | no | no | no | yes | no | no |
| Guerrero-Earlougher | 1961 | yes | no | no | — | yes | yes | — | no | no | no | no | yes | no | no |
| API | 1967 | no | yes | no | — | — | yes | any | yes | yes | no | no | yes | yes | yes |

*Using Caudle and Witte's injectivity correlation

COMPUTER-IMPLEMENTED SYSTEMS AND METHODS FOR SCREENING AND PREDICTING THE PERFORMANCE OF ENHANCED OIL RECOVERY AND IMPROVED OIL RECOVERY METHODS

1. TECHNICAL FIELD

This document relates to computer-implemented systems and methods for use in selecting an improved oil recovery or an enhanced oil recovery method for application to a reservoir. This document also relates to computer-implemented systems and methods for use in predicting the performance of a reservoir system with application of an improved oil recovery process or an enhanced oil recovery process.

2. BACKGROUND

Reservoir systems, such as petroleum reservoirs, contain fluids such as water and various types of oil. The different recovery processes which are used for oil production from the reservoir may be classified as primary, secondary or tertiary recovery processes.

In a primary recovery process, the reservoir's energy and natural forces are used to produce the hydrocarbons contained in the reservoir fluid, such as oil and gas. Only a small fraction of the original-oil-in-place (OOIP) may be recovered by the primary recovery methods. That is, the average recovery is generally about 10-20% of the OOIP. In order to increase the production of oil from subterranean reservoirs, a variety of supplemental (secondary and/or tertiary) recovery techniques may be employed. In a secondary recovery process, energy is introduced into the reservoir by injection, e.g., of water or gas, to facilitate increased recovery. An additional 10-30% of OOIP over the primary recovery process may be obtained. A tertiary recovery process, which generally follows a secondary recovery, may provide for recovery of an additional 5 to 20% of the OOIP over the secondary recovery process. The most widely used secondary recovery technique is waterflooding, which involves the injection of water into the reservoir. Waterflood processes may be more economical than other oil recovery processes, which makes them attractive. A waterflood recovery process is referred to as improved oil recovery (IOR) process.

An enhanced oil recovery (EOR) process can be a tertiary recovery process or a secondary recovery process. The different EOR techniques may provide economical means for achieving recovery of an incremental amount of, e.g., the oil that can be produced from a reservoir after conventional primary or secondary production processes have been applied. Examples of EOR processes include, but are not limited to, polymer and surfactant flooding.

The methods and systems disclosed herein provide for determining whether a reservoir is a candidate for a waterflood process or an EOR process. Also, the methods and systems disclosed herein provide for determining the feasibility of a waterflooding and/or an EOR process for application in a reservoir and to recommend a specific injection scheme. In addition, the methods and systems disclosed herein provide an easy-to-use system for predicting the performance of a waterflooding process in a reservoir, and may be used at an early stage of planning the reservoir exploitation process. Methods and systems for predicting the performance of a polymer flooding technique versus a waterflooding technique in a reservoir also are provided.

3. SUMMARY

As disclosed herein, computer-implemented systems and methods are provided for evaluating the likelihood of success of one or more recovery processes in providing enhanced or improved recovery of oil from a reservoir system, wherein said one or more recovery processes are enhanced oil recovery (EOR) processes or a waterflood process. The methods and systems comprise receiving data indicative of physical or chemical properties associated with the reservoir system, said data comprising one or more parameter values, wherein each said parameter value corresponds to a parameter; comparing each said received parameter value to one or more recovery process consensus values corresponding to the respective parameter, wherein each said recovery process consensus value is associated with a recovery process, and wherein said comparing is implemented on a computer system; assigning a recovery process parameter score to each said recovery process for each said parameter based on said comparing, wherein said assigning is implemented on a computer system; computing a recovery process overall score for each said recovery process based on the recovery process parameter scores assigned to the recovery process, wherein said computing is implemented on a computer system; and wherein said recovery process overall score provides an indication of the likelihood of success of said recovery process with respect to recovery of oil from the reservoir system. At least one of said recovery process parameter score and said recovery process overall score may be output to a display, a user interface device, a computer readable data storage product, or a random access memory.

In one aspect of the foregoing methods and systems, the one or more recovery processes with the highest recovery process overall score are deemed to have the lowest likelihood of success, and the one or more recovery processes with the lowest overall score are deemed to have the highest likelihood of success. In another aspect, the step of outputting further comprises outputting a color code with said recovery process parameter score or said recovery process overall score, wherein said color code is a different color depending on the value of said recovery process parameter score or said recovery process overall score. The enhanced oil recovery (EOR) processes are selected from the group consisting of a $CO_2$ flooding process, a nitrogen-flue gas injection process, a polymer flood process, a steamflood process, alkaline-surfactant-polymer (ASP) flood process, and an in-situ combustion process. The waterflood process is an improved oil recovery process. In one aspect, the methods and systems further comprise, prior to outputting, a step of comparing said recovery process overall score to a predetermined recovery process success score, wherein said recovery process is deemed likely to succeed with respect to recovery of oil from the reservoir system if said recovery process overall score is less than said predetermined recovery process success score, or is deemed unlikely to succeed respect to recovery of oil from the reservoir system if said recovery process overall score is greater than said predetermined recovery process success score. In the foregoing aspect, the predetermined recovery process success score can be about 90%, about 80%, about 70%, about 60%, about 50%, about 45%, about 40%, about 35%, about 30%, about 25%, about 20%, about 15%, or about 10% of the highest recovery process overall score which can be computed for a recovery process based on the recovery process parameter scores. In the foregoing aspect, an indication of the likelihood of success of said recovery process with respect to recovery of oil from the reservoir system may be output to a display, a user interface device, a computer readable data storage product, or a random access memory. In another aspect, the methods and systems further comprise, prior outputting, a step of comparing said recovery process overall score to a predetermined recovery process success score, wherein recovery process is deemed likely to succeed with respect to recovery of oil from the reservoir system if said recovery process overall score is greater than said predetermined recovery process success score, or is deemed unlikely to succeed respect to recovery of oil from the reservoir system if said recovery process overall score is less than said predetermined recovery process success score. In the foregoing aspect, the predetermined recovery process success score can be about 90%, about 80%, about 70%, about 60%, about 50%, about 45%, about 40%, about 35%, about 30%, about 25%, about 20%, about 15%, or about 10% of the highest recovery process overall score which can be computed for a recovery process based on the recovery process parameter scores. In the foregoing aspect, the methods and systems further comprise outputting to a display, a user interface device, a tangible computer readable data storage product, or a tangible random access memory, an indication of the likelihood of success of said recovery process with respect to recovery of oil from the reservoir system.

A method of operating a reservoir system to achieve enhanced or improved recovery of oil from the reservoir system also is provided, said method comprising executing the steps of any of the foregoing methods and systems, and applying to the reservoir system a recovery process based on one or more of said recovery process parameter score assigned to said recovery process or said recovery process overall score computed for said recovery process.

Computer-implemented systems and methods also are provided for evaluating the likelihood of success of a waterflood (WF) process in providing improved recovery of oil from a reservoir system. The methods and systems comprise receiving data indicative of physical properties associated with the reservoir system, wherein said data comprises parameter values associated with one or more primary WF variables and parameter values associated with one or more secondary WF variables; comparing each said received parameter value to one or more WF consensus values corresponding to the respective parameter; assigning a primary WF point to a primary WF variable if the parameter value of said primary WF variable falls within a favorable range of the respective WF consensus values; assigning a secondary WF point to a secondary WF variable if the parameter value of said secondary WF variable falls within a favorable range of the respective WF consensus values; computing a WF screening score based on said primary WF points and said secondary WF points; wherein said WF screening score indicates a likelihood of success of said WF process with respect to recovery of oil from the reservoir system; and wherein said steps of comparing, assigning and computing are implemented on a computer system. The methods and systems may comprise outputting said WF screening score to a display, a user interface device, a tangible computer readable data storage product, or a tangible random access memory. The foregoing methods and systems may further comprise, prior to outputting, receiving data indicative of physical properties associated with the reservoir system, wherein said data further comprises parameter values associated with one or more tertiary WF variables; assigning a tertiary WF point to a tertiary WF variable if the parameter value of said tertiary WF variable falls within a favorable range of the respective WF consensus values; and computing a WF screening score based on said primary WF points, said secondary WF points, and said tertiary WF points. The foregoing methods and systems may further comprise receiving data indicative of physical properties associated with the reservoir system, wherein said data further comprises parameter values associated with one or more tertiary WF variables; assigning a tertiary WF point to a tertiary WF variable if the parameter value of said tertiary WF variable falls within a favorable range of the respective WF consensus values; and computing said WF screening score based on said primary WF points, said secondary WF points, and said tertiary WF points.

A method of operating a reservoir system to achieve improved recovery of oil from the reservoir system also is provided, the method comprising executing the steps of any of the foregoing methods and systems, and applying to the reservoir system the WF process if said WF screening score indicates a likelihood of success of said WF process.

In one aspect, the foregoing methods and systems further comprise, prior to outputting, a step of comparing said WF screening score to a predetermined WF process success score, wherein said WF process is deemed likely to succeed with respect to recovery of oil from the reservoir system if said WF screening score is greater than said predetermined WF process success score, or is deemed unlikely to succeed with respect to recovery of oil from the reservoir system if said WF screening score is less than said predetermined WF process success score. In this aspect, the predetermined WF process success score can be about 30%, about 40%, about 50%, about 55%, about 60%, about 65%, about 70%, about 75%, about 80%, about 85%, about 90%, or more, of the highest WF screening score which can be computed based on the primary WF points and the secondary WF points. In this aspect, an indication of the likelihood of success of said WF process with respect to recovery of oil from the reservoir system can be output to a display, a user interface device, a computer readable data storage product, or a random access memory.

A method of operating a reservoir system to achieve improved recovery of oil from the reservoir system also is provided, the method comprising executing the steps of any of the foregoing methods and systems, and applying to the reservoir system the WF process if said WF process is deemed likely to succeed.

Computer-implemented systems and methods also are provided for evaluating a pattern injection scheme or peripheral injection scheme for application of a waterflood (WF) process to a reservoir system. The methods and systems comprise receiving data indicative of physical properties associated with the reservoir system, wherein said data comprises parameter values associated with one or more primary injection scheme variables and parameter values associated with one or more secondary injection scheme variables; comparing each said received parameter value to one or more injection scheme consensus values corresponding to the respective parameter; determining a recommended injection scheme to be applied to said reservoir system for enhanced recovery of oil from the reservoir system; wherein said recommended injection scheme is a peripheral injection scheme if a majority of said parameter values falls within a range R1 of values of said one or more injection scheme consensus values; wherein said recommended injection scheme is a pattern injection scheme if a majority of said parameter values falls within a range R2 of values of said one or more injection scheme consensus values; wherein said range R1 is different from said range R2; and wherein said steps of comparing and determining are implemented on a computer system. The methods and systems may comprise outputting an indication of said recommended injection scheme to a display, a user interface device, a computer readable data storage product, or a random access memory. The foregoing methods and systems may further comprise, prior to outputting, receiving data indicative of physical properties associated with the reservoir system, wherein said data further comprises parameter values associated with one or more tertiary injection scheme variables. The foregoing methods and systems also may further comprise, prior to outputting, receiving data indicative of physical properties associated with the reservoir system, wherein said data further comprises parameter values associated with one or more quaternary injection scheme variables. A method of operating a reservoir system to achieve improved recovery of oil from the reservoir system also is provided, the method comprising executing the steps of any of the methods, and applying to the reservoir system said WF process according to the recommended injection scheme.

Computer-implemented systems and methods also are provided for evaluating a pattern injection scheme or a peripheral injection scheme for application of a waterflood (WF) process to a reservoir system. The methods and systems comprise receiving data indicative of physical properties associated with the reservoir system, wherein said data comprises parameter values associated with one or more primary injection scheme variables and parameter values associated with one or more secondary injection scheme variables; comparing each said received parameter value to one or more injection scheme consensus values corresponding to the respective parameter; assigning a primary injection scheme point to a primary injection scheme variable if the parameter value of said primary injection scheme variable falls within a favorable range of the respective injection scheme consensus values; assigning a secondary injection scheme point to a secondary injection scheme variable if the parameter value of said secondary injection scheme variable falls within a favorable range of the respective injection scheme consensus values; computing an injection scheme score based on said primary injection scheme points and said secondary injection scheme points; determining a recommended injection scheme to be applied to said reservoir system for improved recovery of oil from the reservoir system; wherein said recommended injection scheme is determined to be a pattern injection scheme if said injection scheme score is above a predetermined injection scheme viability score; wherein said recommended injection scheme is determined to be a peripheral injection scheme if said injection scheme score is below a predetermined injection scheme viability score; and wherein said steps of comparing, assigning, computing and determining are implemented on a computer system. The methods and systems may comprise outputting an indication of said recommended injection scheme to a display, a user interface device, a tangible computer readable data storage product, or a tangible random access memory. The foregoing methods and systems may further comprise, prior to outputting, receiving data indicative of physical properties associated with the reservoir system, wherein said data further comprises parameter values associated with one or more tertiary injection scheme variables; assigning a tertiary injection scheme point to a tertiary injection scheme variable if the parameter value of said tertiary injection scheme variable falls within a favorable range of the respective injection scheme consensus values; and computing said injection scheme score based on said primary injection scheme points, said secondary injection scheme points, and said tertiary injection scheme points. The foregoing methods and systems also may further comprise, prior to outputting, receiving data indicative of physical properties associated with the reservoir system, wherein said data further comprises parameter values associated with one or more quaternary injection scheme variables; assigning a quaternary injection scheme point to a quaternary injection scheme variable if the parameter value of said quaternary injection scheme variable falls within a favorable range of the respective injection scheme consensus values; and computing an injection scheme score based on said primary injection scheme points, said secondary injection scheme points, said tertiary injection scheme points, and said quaternary injection scheme points.

A method of operating a reservoir system to achieve improved recovery of oil from the reservoir system is provided, the method comprising executing the steps of any of the foregoing methods and systems, and applying to the reservoir system said WF process according to the recommended injection scheme.

Computer-implemented systems and methods also are provided for predicting a performance of a waterflood (WF) process in a reservoir system. The methods and systems comprise receiving data indicative of physical properties associated with the reservoir system, wherein said data comprises parameter values associated with one or more parameters; computing at least one uncorrected WF performance profile of production of oil from the reservoir system with application of the waterflood process, wherein said at least one uncorrected WF performance profile is computed based on a fit of at least one WF performance computation methodology to the received data; converting said at least one uncorrected WF performance profile to at least one corrected WF performance profile using a statistical correction factor, wherein application of said statistical correction factor provides for direct comparison of said at least one corrected WF performance profile to a measure of production of oil from said reservoir system following application of an initial oil recovery process to said reservoir system; wherein said at least one corrected WF performance profile provides an indication of the performance of said waterflood process in the reservoir system; and wherein said steps of computing and converting are implemented on a computer system. The at least one corrected WF performance profile can provide an indication of the performance of said waterflood process in the reservoir system following application of an initial oil recovery process to said reservoir system. The corrected WF performance profile may serve as an indication of the performance of a waterflood process in the reservoir system. The methods and systems may comprise outputting to a display, a user interface device, a computer readable data storage product, or a random access memory, said corrected WF performance profile. The corrected WF performance profile can be a fractional flow curve, a relative permeability curve, a cumulative oil production, a production profile, an injection profile, a water-oil-ratio (WOR), an ultimate recovery factor, volume of water injected, or any combination thereof. The WF performance computation methodology can be selected from the group consisting of the Buckley-Leverett methodology, the Craig-Geffen-Morse methodology, the Dykstra-Parsons methodology, the Stiles methodology, and the Bush-Helander methodology. The methods and systems can further comprise computing at least two uncorrected WF performance profiles of production of oil from the reservoir system with application of the waterflood process, wherein said at least two uncorrected WF performance profiles are computed based on a fit of at least two WF performance computation methodologies to the received data. The statistical correction factor can be computed based on application of the Bush-Helander empirical methodology and the Ganesh Thakur empirical methodology to the received data. The methods and systems can further computing said statistical conversion factor based on a correlation between a predicted production of said waterflood process using a Bush-Helander methodology and a predicted production of said waterflood process using a Ganesh Thakur methodology. In the foregoing systems and methods, said at least one uncorrected WF performance profile can be computed based on a fit of two or more WF performance computation methodologies to the received data. In one aspect of the foregoing systems and methods, the step of computing can further comprise comparing the results from the fit of the two or more WF performance computation methodologies to the received data. The step of comparing can be performed in a single time step during the computation. In another example, the results of the fit of the two or more WF performance computation methodologies to the received data can be displayed to a display, and wherein said step of comparing is performed at the display.

A method of operating a reservoir system to achieve improved recovery of oil from the reservoir system also is provided, the method comprising executing the steps of any of the foregoing methods and systems, and applying to said reservoir system said WF process based on said at least one corrected WF performance profile.

Computer-implemented systems and methods also are provided for predicting a performance of a polymer flood process in a reservoir system. The methods and systems comprise receiving data indicative of physical properties associated with the reservoir system, wherein said data comprises parameter values associated with one or more parameters; computing at least one polymer flood performance profile which provides a measure of production of oil from the reservoir system with application of the waterflood process, wherein said at least one polymer flood performance profile is computed based on application of at least one polymer flood performance computation methodology to the received data; wherein said at least one polymer flood performance profile provides an indication of the performance of said waterflood process in the reservoir system; and wherein said step of computing is implemented on a computer system. The methods and systems may comprise outputting to a display, a user interface device, a computer readable data storage product, or a random access memory, said at least one polymer flood performance profile. The polymer flood performance profile can be a fractional flow curve, a relative permeability curve, a cumulative oil production, a production profile, an injection profile, an ultimate recovery factor, or any combination thereof. The step of outputting may comprise outputting a comparison of a waterflood fractional flow curve and a polymer flood fractional flow curve. Said outputting may comprise outputting a water, polymer, and oil saturations at respective fronts during operation of the reservoir system (such as at breakthrough).

In an aspect of the foregoing systems and methods, said at least one polymer flood performance profile is computed based on a fit of two or more polymer flood performance computation methodologies to the received data. The step of computing can further comprise comparing the results from the fit of the two or more polymer flood performance computation methodologies to the received data. The step of comparing can performed in a single time step during the computation. In another example, the results of the fit of the two or more polymer flood performance computation methodologies to the received data are displayed to a display, and said step of comparing is performed at the display.

A method of operating a reservoir system to achieve enhanced recovery of oil from the reservoir system also is provided, the method comprising executing the steps of any of the foregoing methods and systems, and applying to the reservoir system said polymer flood process based on said at least one polymer flood performance profile.

An aspect of the present disclosure provides a computer system for performing the steps of any of the methods and systems disclosed herein. The computer system comprises one or more processor units; and one or more memory units connected to the one or more processor units, the one or more memory units containing one or more modules which comprise one or more programs which cause the one or more processor units to execute steps comprising performing the steps of any of the systems and methods disclosed herein. In the foregoing embodiments, the one or more memory units may contain one or more modules which comprise one or more programs which cause the one or more processor units to execute steps comprising outputting to a display, a user interface device, a tangible computer readable data storage product, or a tangible random access memory, a result of the systems and methods. For example, as is applicable to the method being executed, the result of the system or method which is output can be a recovery process parameter score, a recovery process overall score, a WF screening score, an indication of a recommended injection scheme, a corrected WF performance profile, or a polymer flood performance profile.

Another aspect of the present disclosure provides a computer-readable medium storing a computer program executable by a computer for performing the steps of any of the systems and methods disclosed herein. A computer program product is provided for use in conjunction with a computer having one or more memory units and one or more processor units, the computer program product comprising a computer readable storage medium having a computer program mechanism encoded thereon, wherein the computer program mechanism can be loaded into the one or more memory units of the computer and cause the one or more processor units of the computer to execute steps comprising performing the steps of any of the systems and methods disclosed herein. In the foregoing embodiments, the computer program mechanism may be loaded into the one or more memory units of said computer and cause the one or more processor units of the computer to execute steps comprising outputting to a display, a user interface device, a tangible computer readable data storage product, or a tangible random access memory, a result of the system or method. For example, as is applicable to the method being executed, the result of the system or method which is output can be a recovery process parameter score, a recovery process overall score, a WF screening score, an indication of a recommended injection scheme, a corrected WF performance profile, or a polymer flood performance profile.

4. BRIEF DESCRIPTION OF THE DRAWINGS

FIG. 2 shows screen shot of an example input window 201 for EOR screening input module 101.

FIG. 3 shows a screen shot of an example EOR screening output window.

FIG. 4 displays the results of the application of the EOR screening process.

Figure 5:
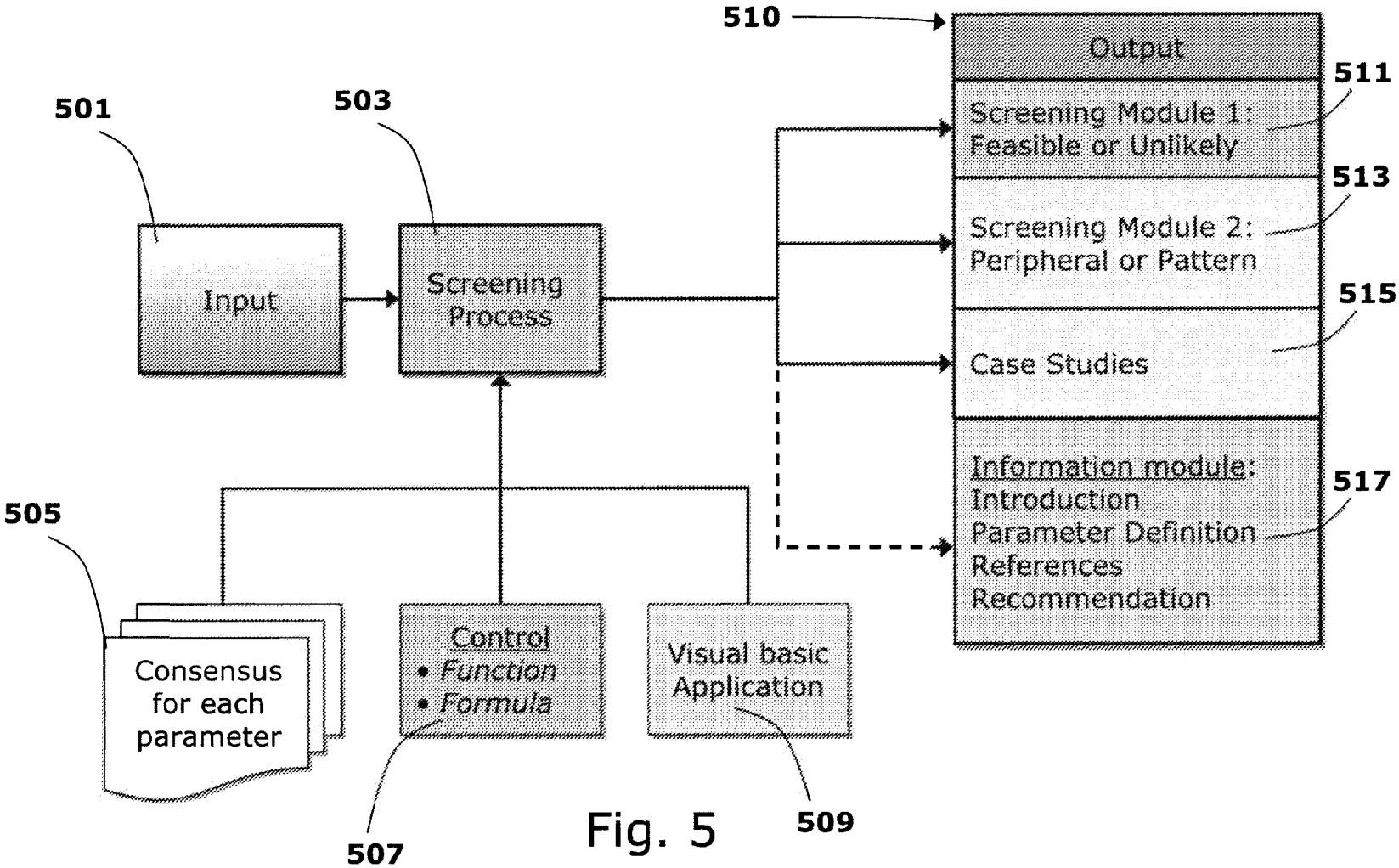

FIG. 5 illustrates a flow chart of a method for waterflood screening which may be computer-implemented.

FIG. 6 shows screen shot of an example input window for the WF screening input module.

FIG. 7 illustrates an output of the WF screening output module 511, showing an interactive help display which informs a user of a consensus (cut off) value for the mobility ratio (M) variable.

FIG. 8 shows an output of the WF screening output module 511 where the value of the mobility ratio (M) variable is less than the consensus (cut off) value displayed in FIG. 7.

FIG. 9 further illustrates an output of the WF screening output module 511.

FIG. 10 illustrates an output of the WF screening output module 513 which shows a display of a recommended injection scheme for the indicated reservoir parameters.

FIG. 11 illustrates an output of the WF screening output module 513.

FIG. 12 illustrates an output of the WF screening output module 513 which shows the effect of changes in the reservoir parameters on the final recommended injection scheme.

FIG. 13 shows an output of WF screening output module 515 and contains the actual injection scheme applied to fields and the recommended injection scheme for several fields.

Figure 14B:
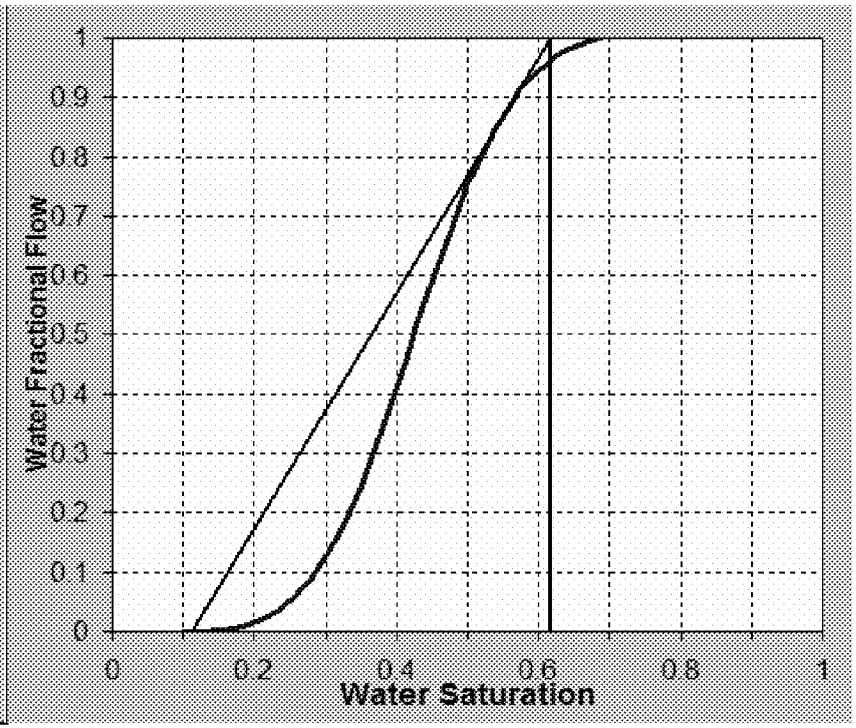
Figure 14A:
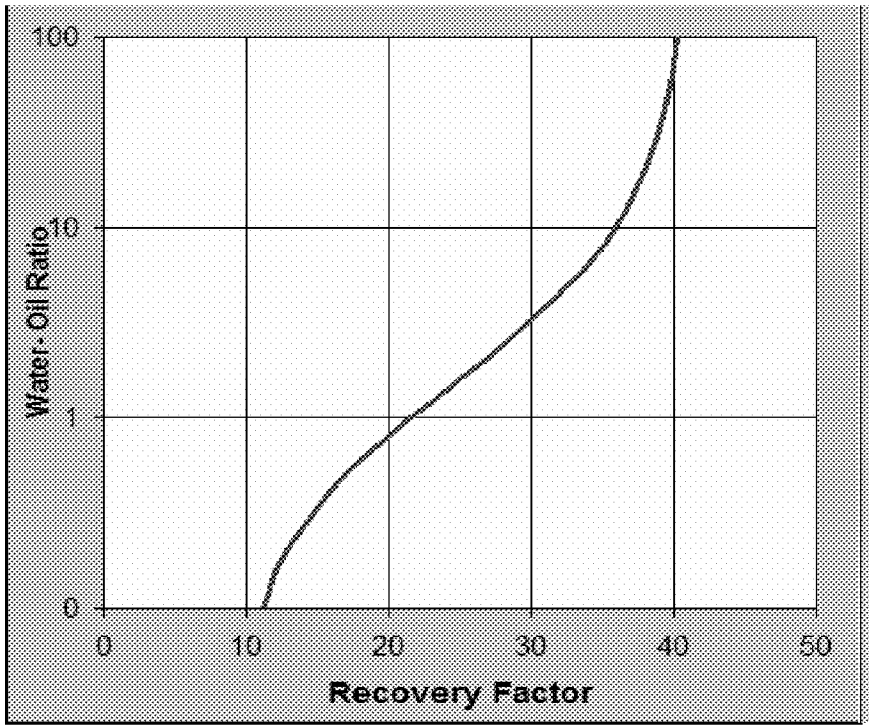

FIG. 14A shows a plot of the log water-oil ratio vs. the recovery factor.

FIG. 14B shows a plot of the water Fractional Flow Curve vs. the water saturation.

Figure 15:
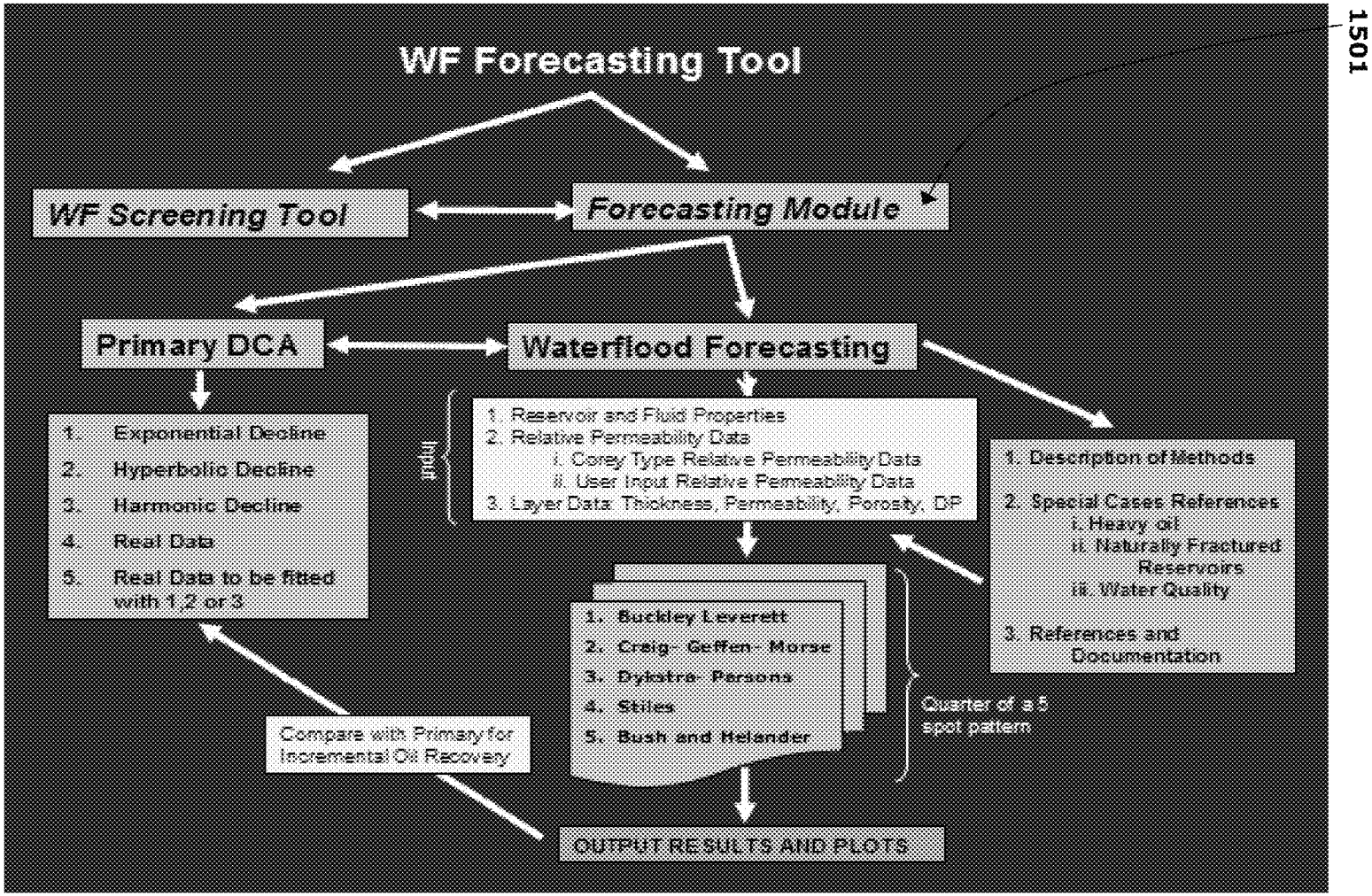

FIG. 15 illustrates the typical workflow of the WF forecasting tool and illustrates the communication which can occur between the WF forecasting tool and the WF screening tool.

Figure 16:
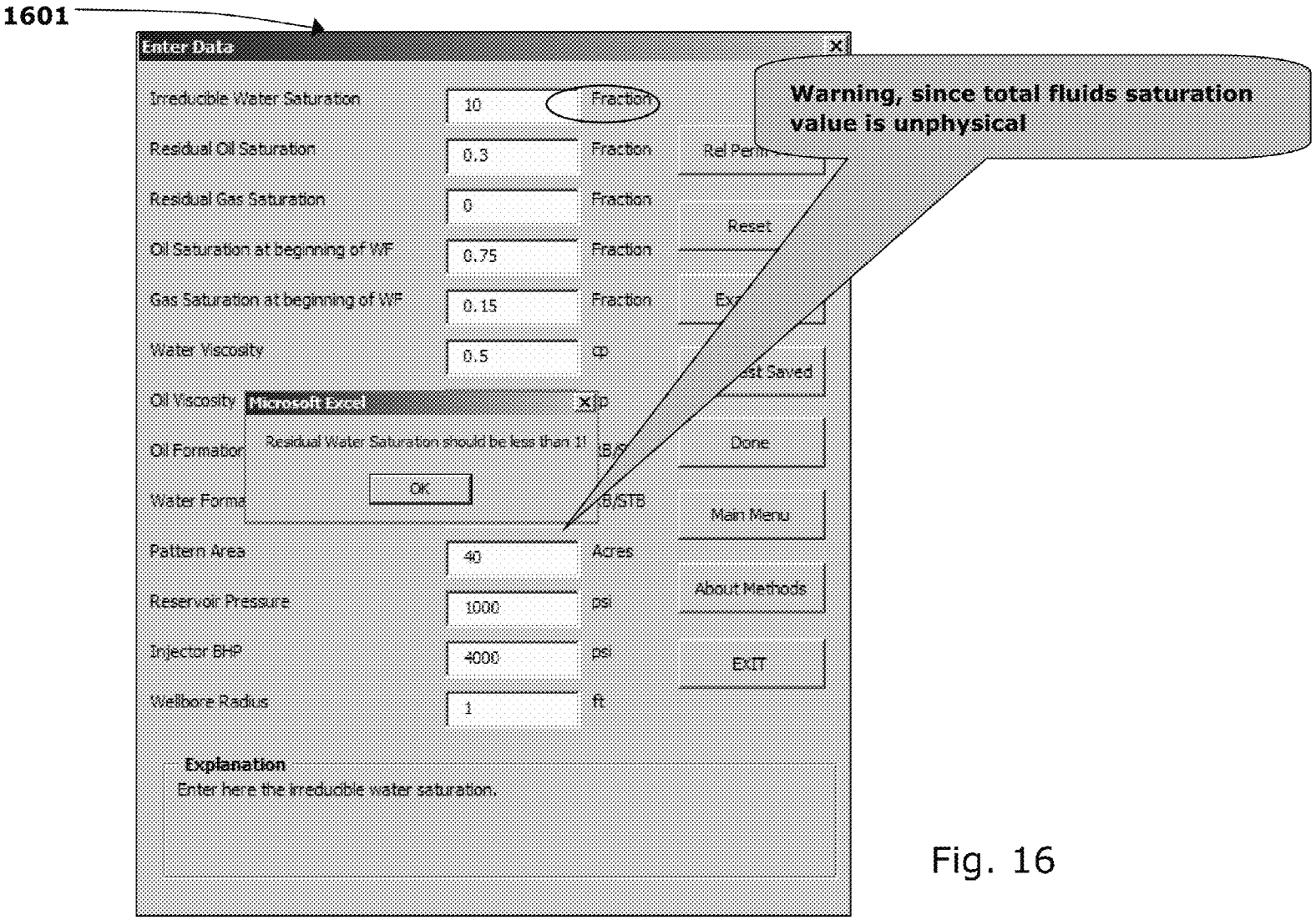

FIG. 16 shows an example of warning displays of the WF forecasting input module.

FIG. 17 shows an example display of the WF forecasting input module.

Figures 18A, 18B:
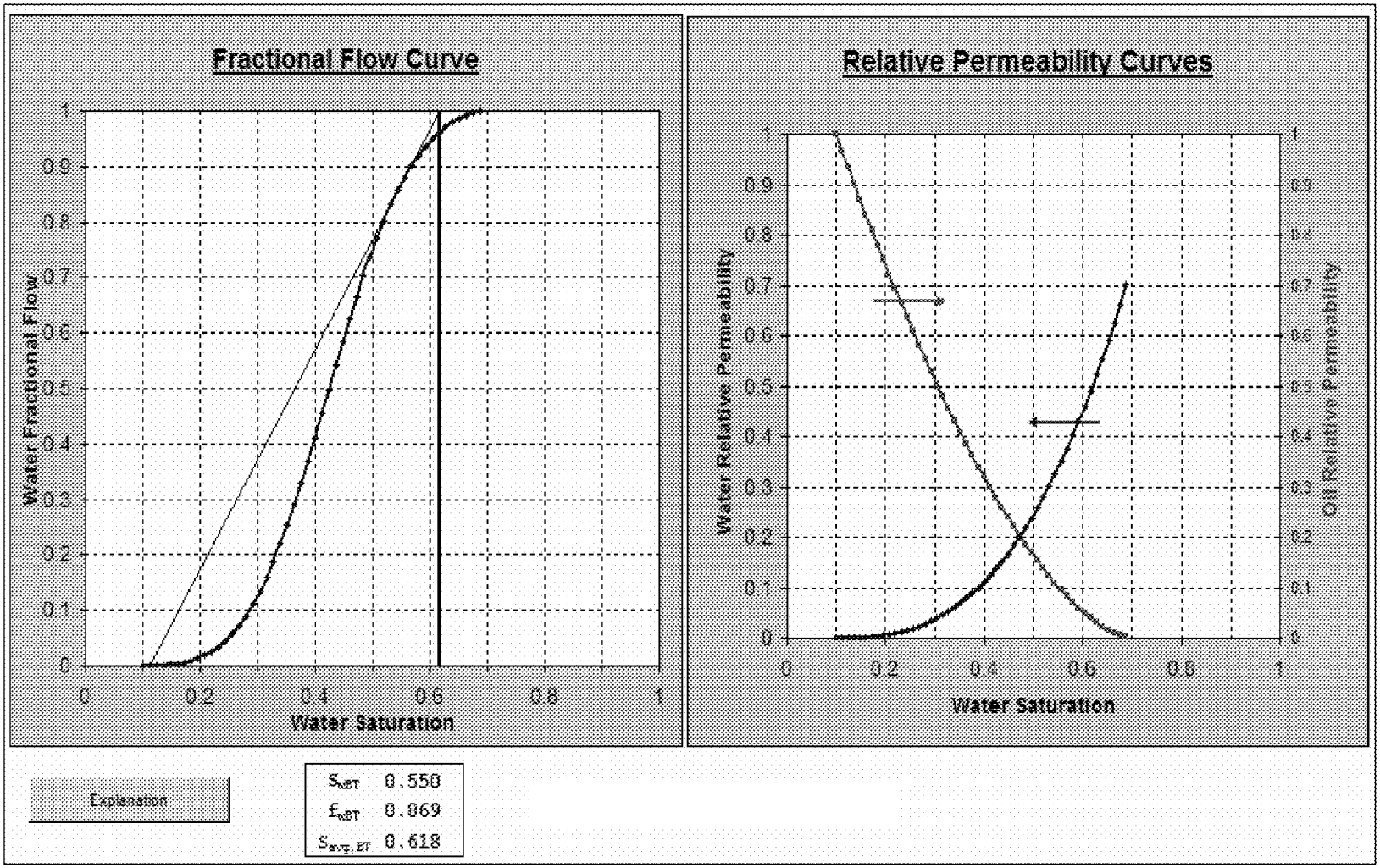

FIG. 18A displays an example of a fractional flow curve for the performance of a WF process; FIG. 18B displays an example of a relative permeability curves for water and oil.

Figure 19B:
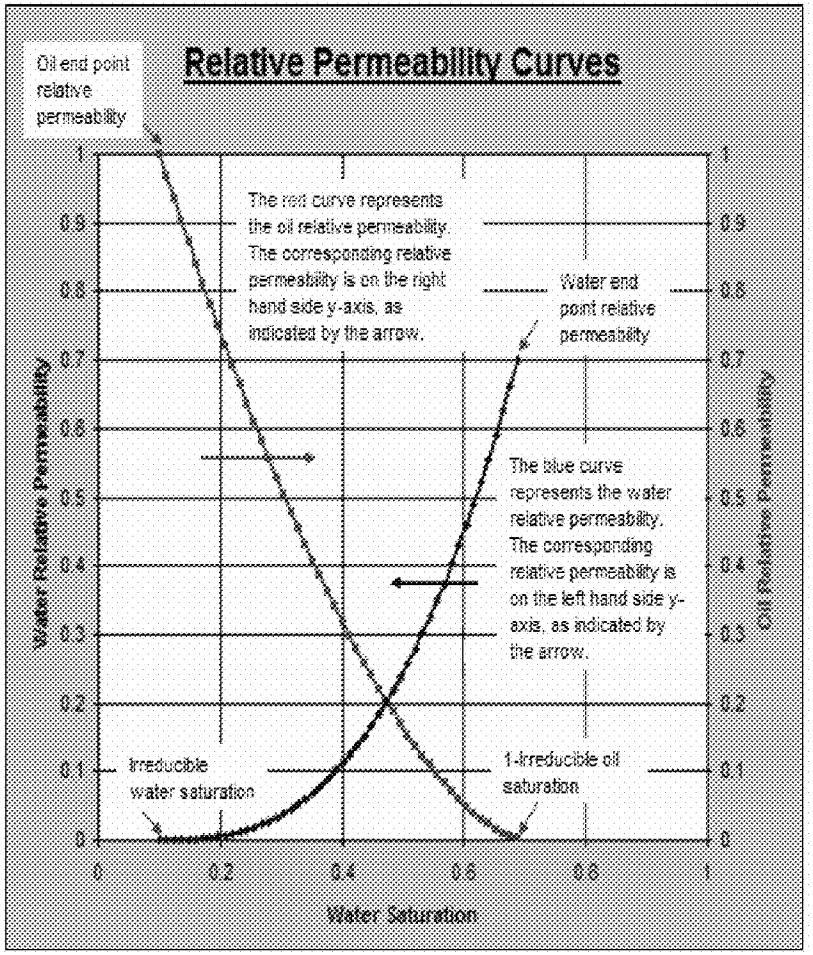
Figure 19A:
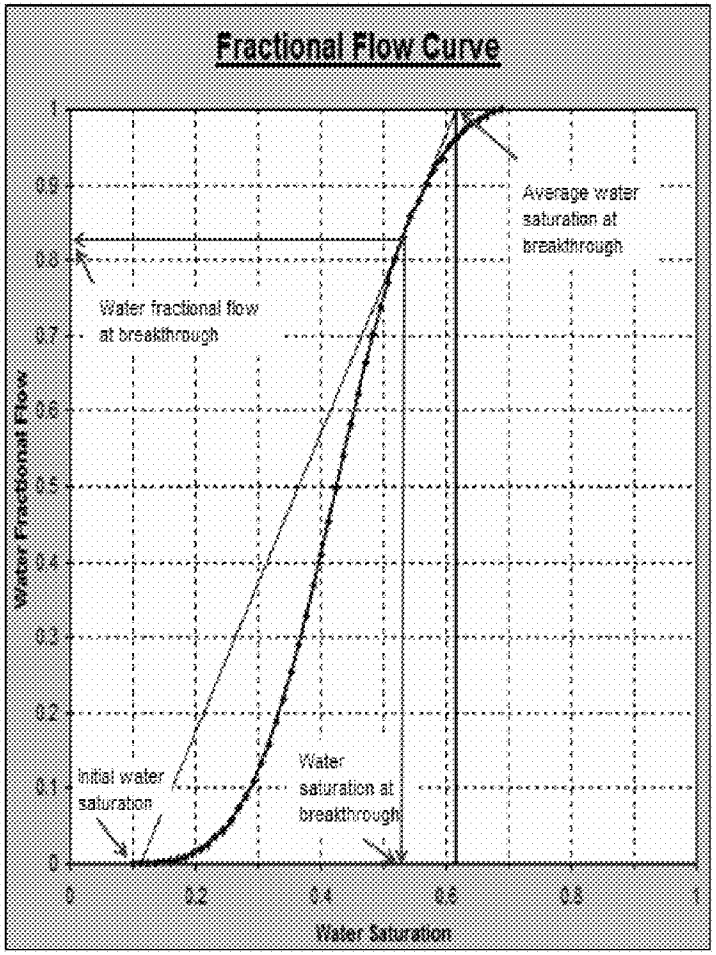

FIG. 19A illustrates an explanation of portions of a fractional flow curve.

FIG. 19B illustrates an explanation of portions of relative permeability curves.

Figures 20A, 20B:
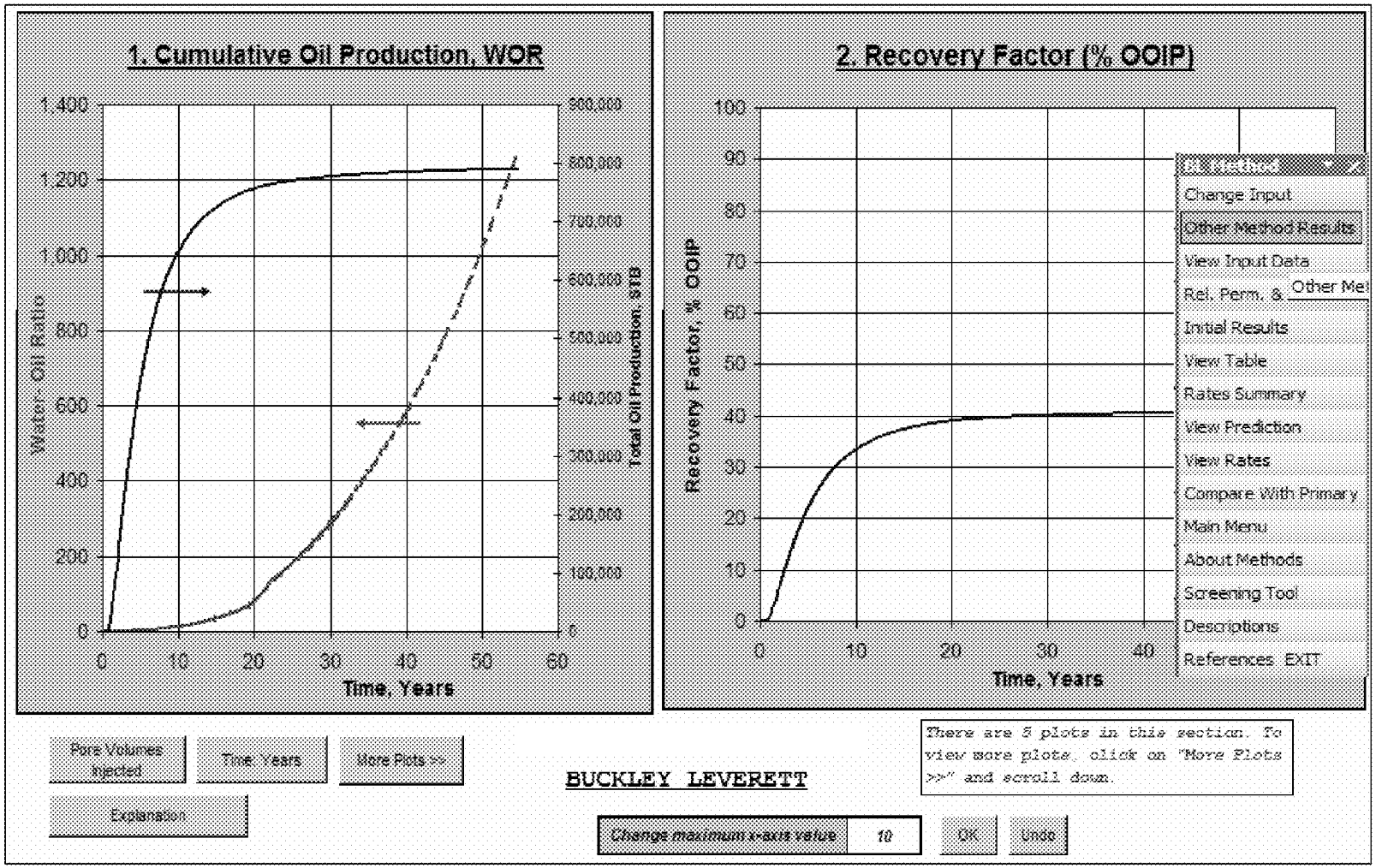

FIG. 20A shows a plot of curves of the cumulative oil production and water-oil-ratio;

FIG. 20B shows a plot of the recovery factor (as a percentage of the original-oil-in-place (OOIP)).

Figures 21A, 21B:
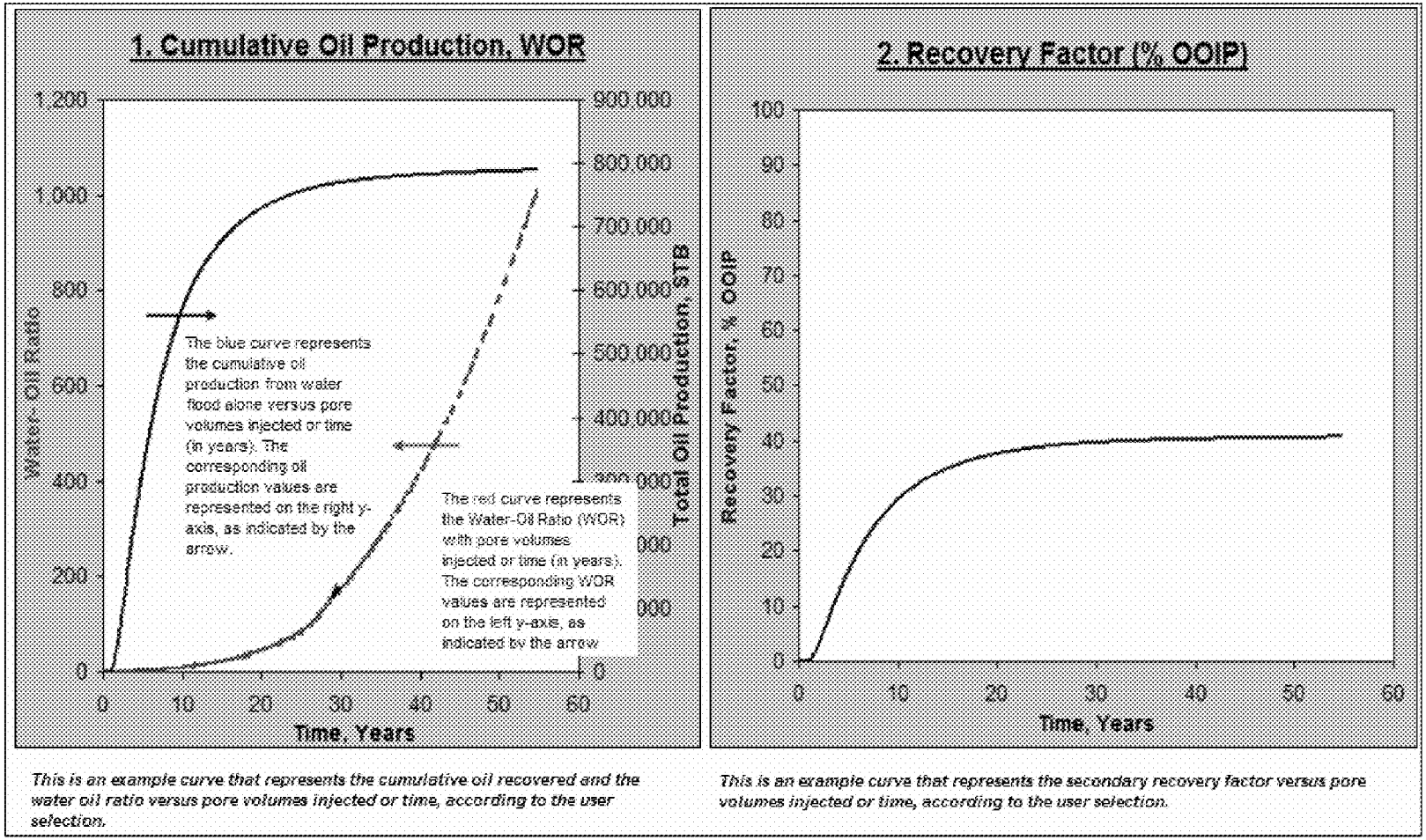

FIGS. 21A and 21B show explanations of the plots and of the axes of FIGS. 20A and 20B, respectively.

Figures 22A, 22B:
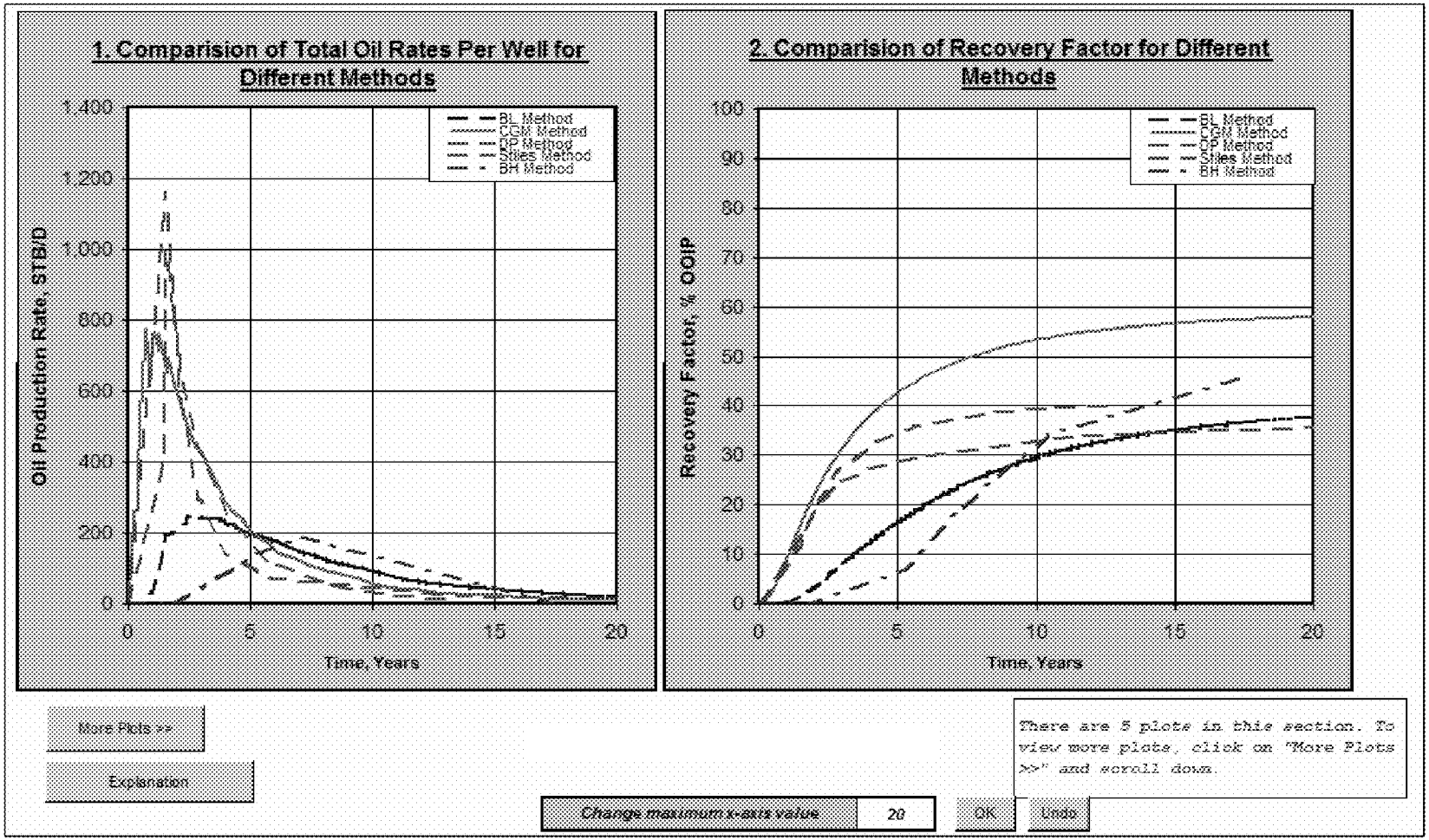

FIG. 22A shows a comparison of the total oil rates per well resulting from computations for the different WF performance computation methodologies.

FIG. 22B shows a comparison of the recovery factor (as a percentage of the OOIP) resulting from computations for the different WF performance computation methodologies.

Figures 23A, 23B:
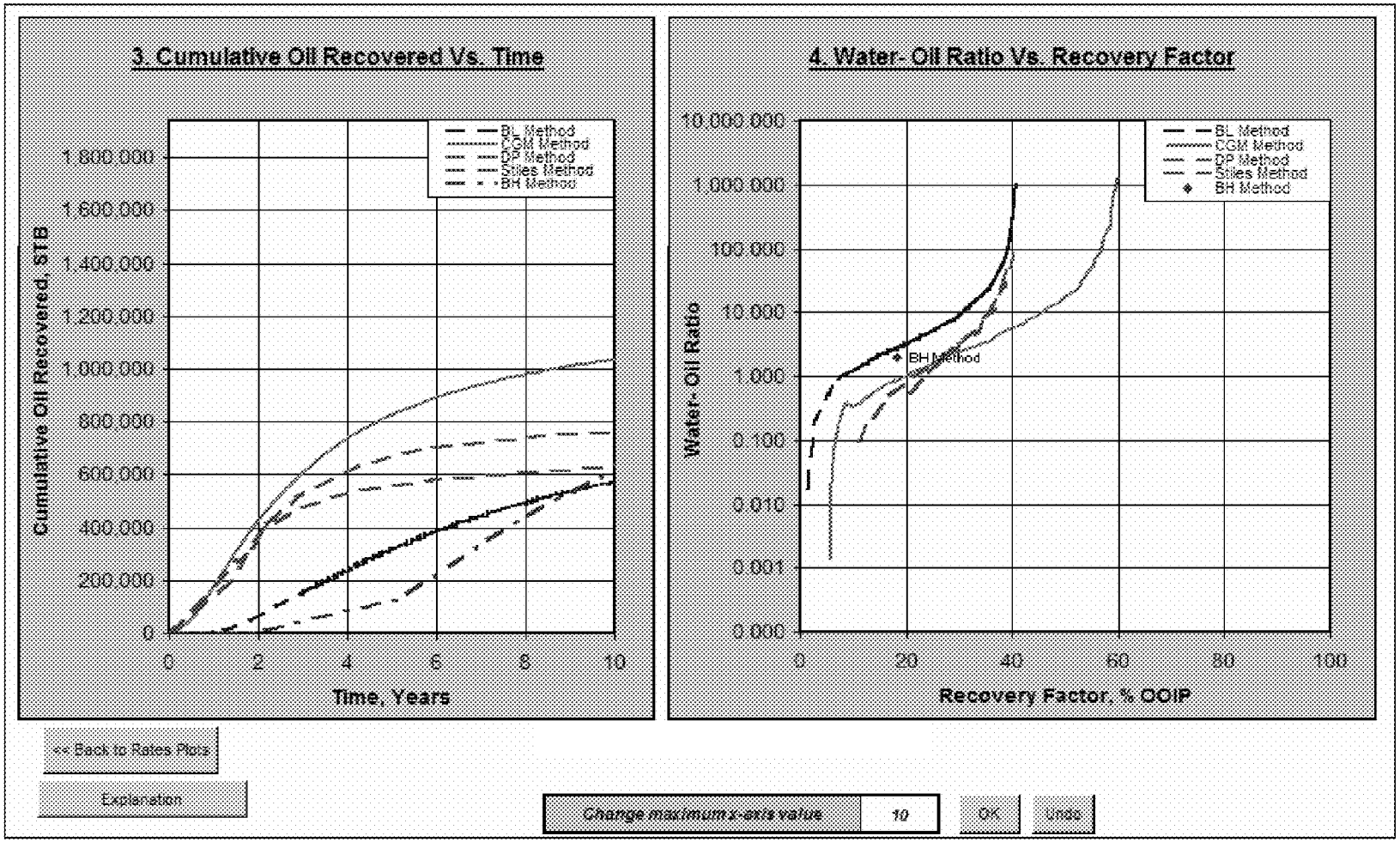

FIGS. 23A and 23B show a comparison of the cumulative oil recovered versus time and the log of the water-oil-ratio versus recovery factor (% OOIP), respectively, for the different WF performance computation methodologies.

Figure 24:
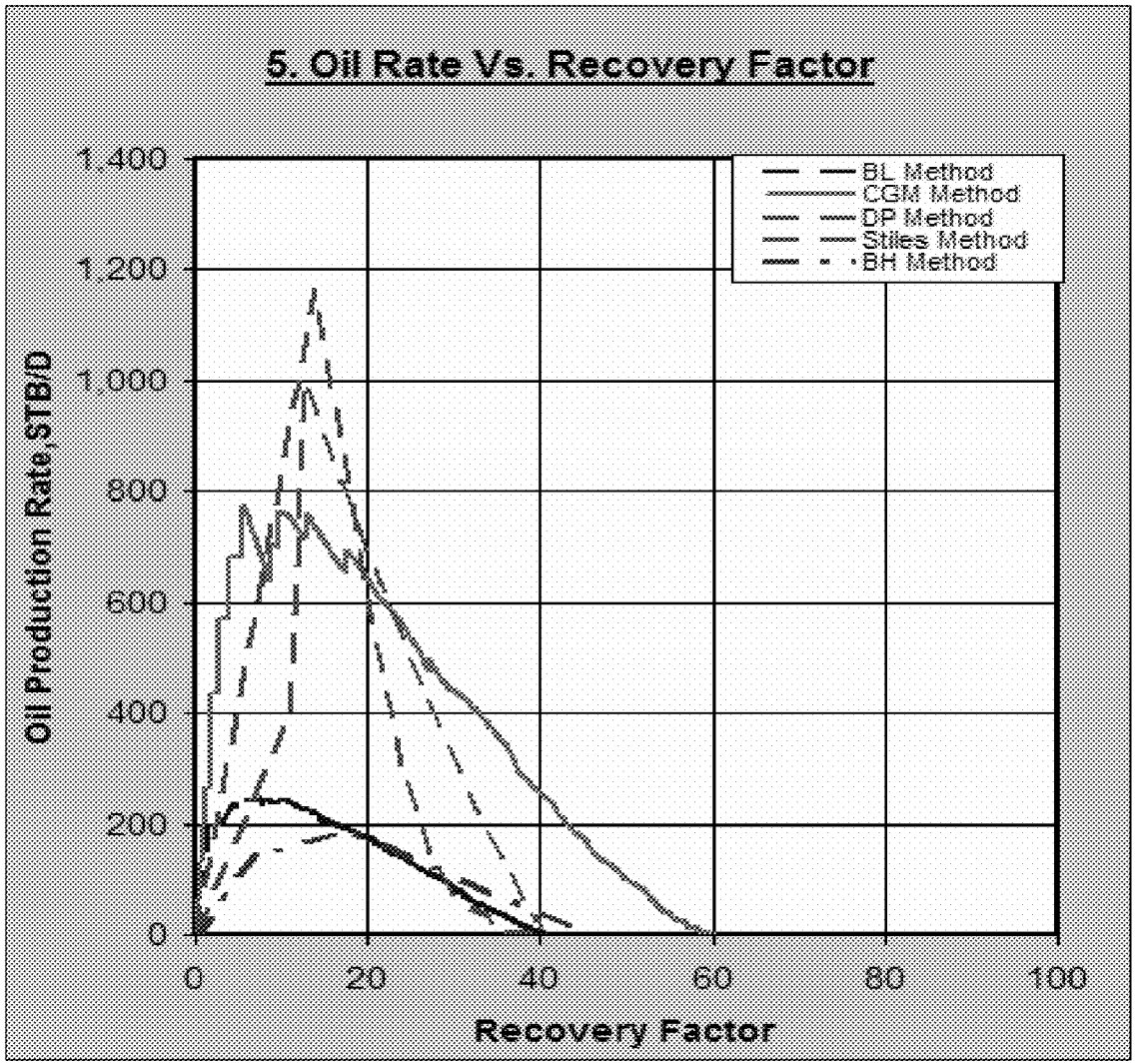

FIG. 24 shows a comparison of the oil production rate versus recovery factor for the different WF performance computation methodologies.

Figure 25B:
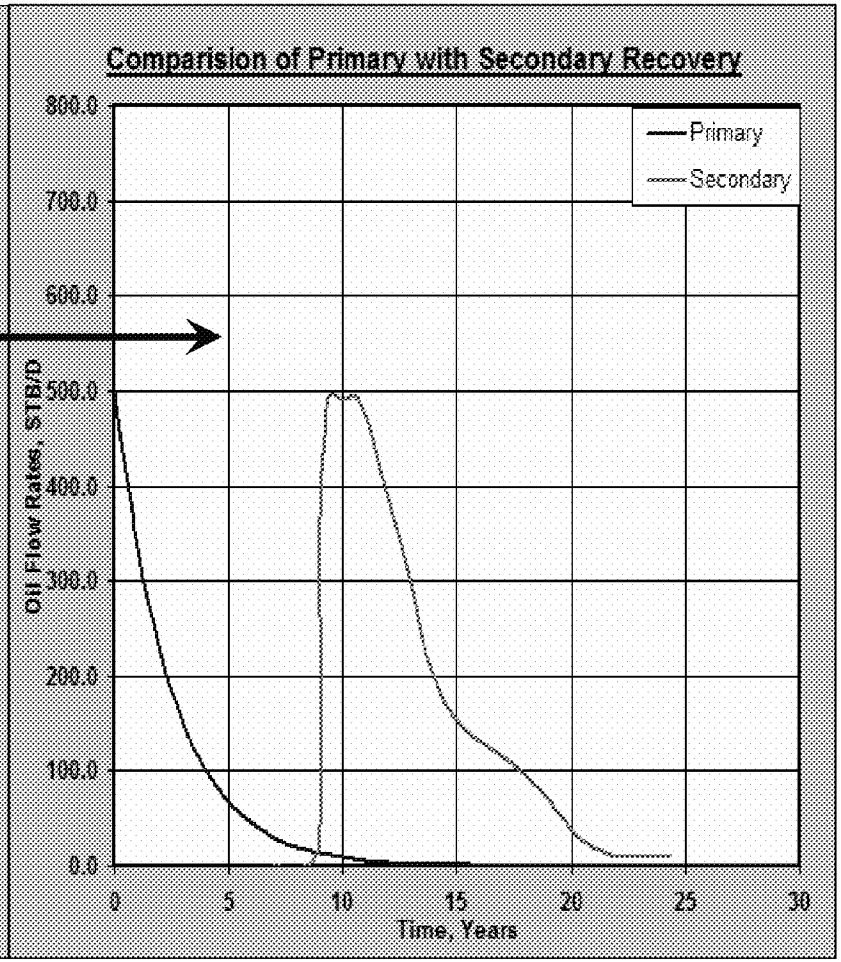
Figure 25A:
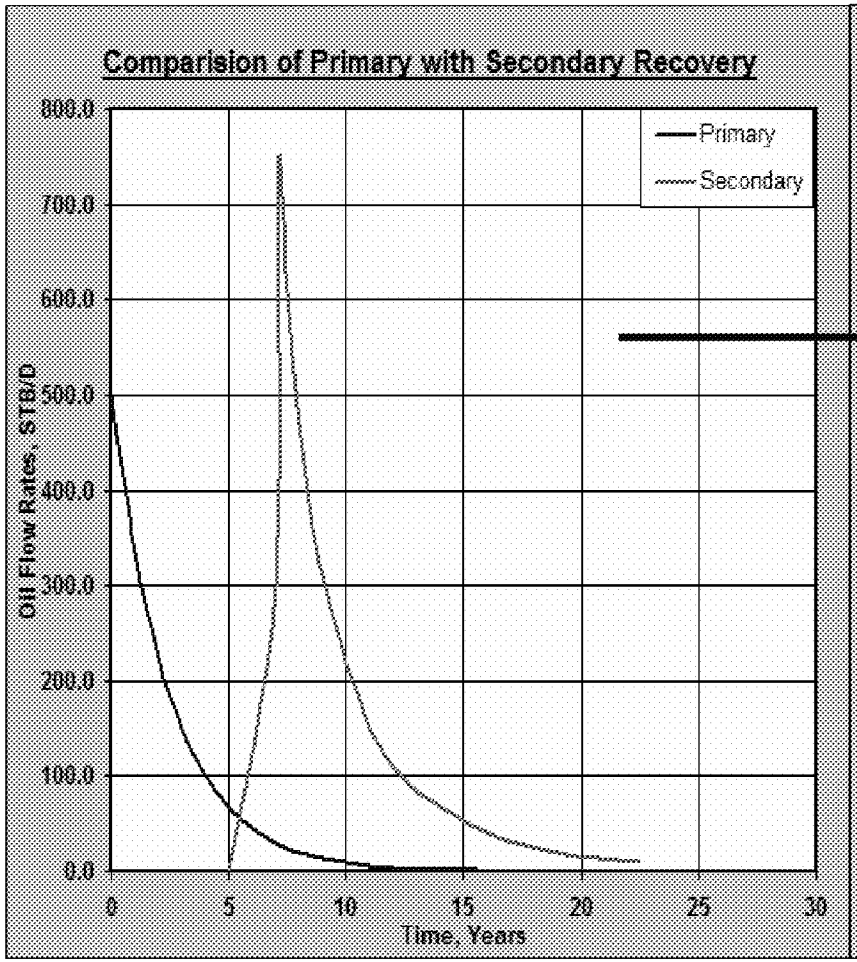

FIGS. 25A and 25B illustrate the application of a statistical correction factor ("SCF") to the data for primary and secondary recovery processes.

Figure 26B:
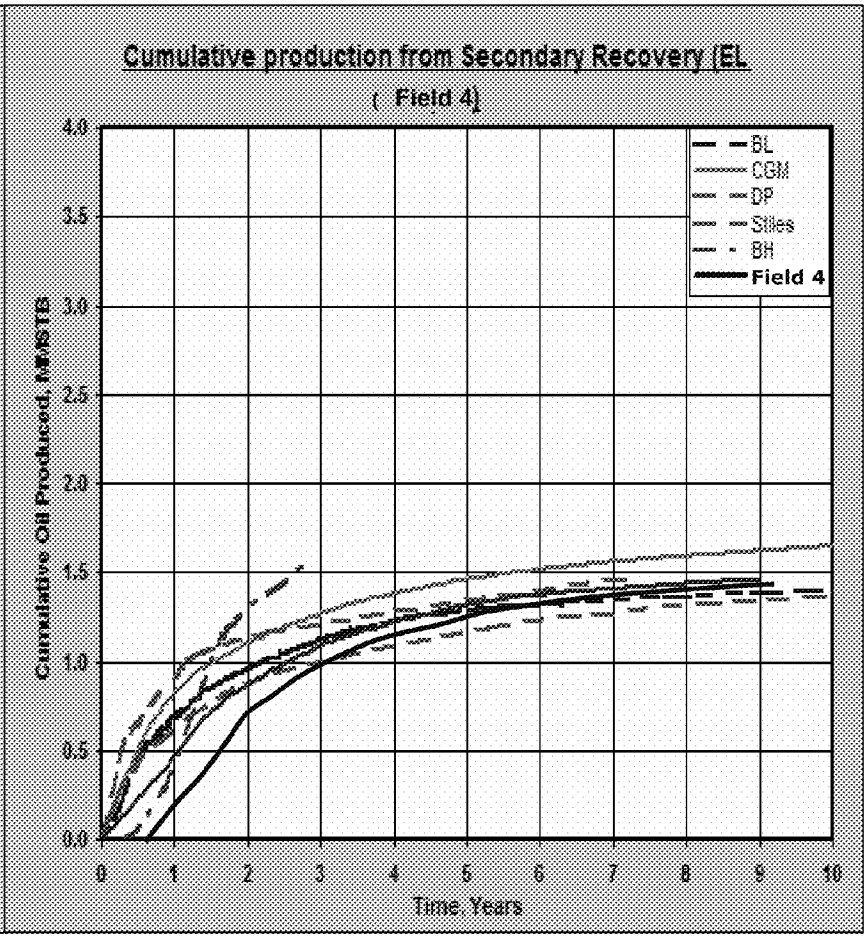
Figure 26A:
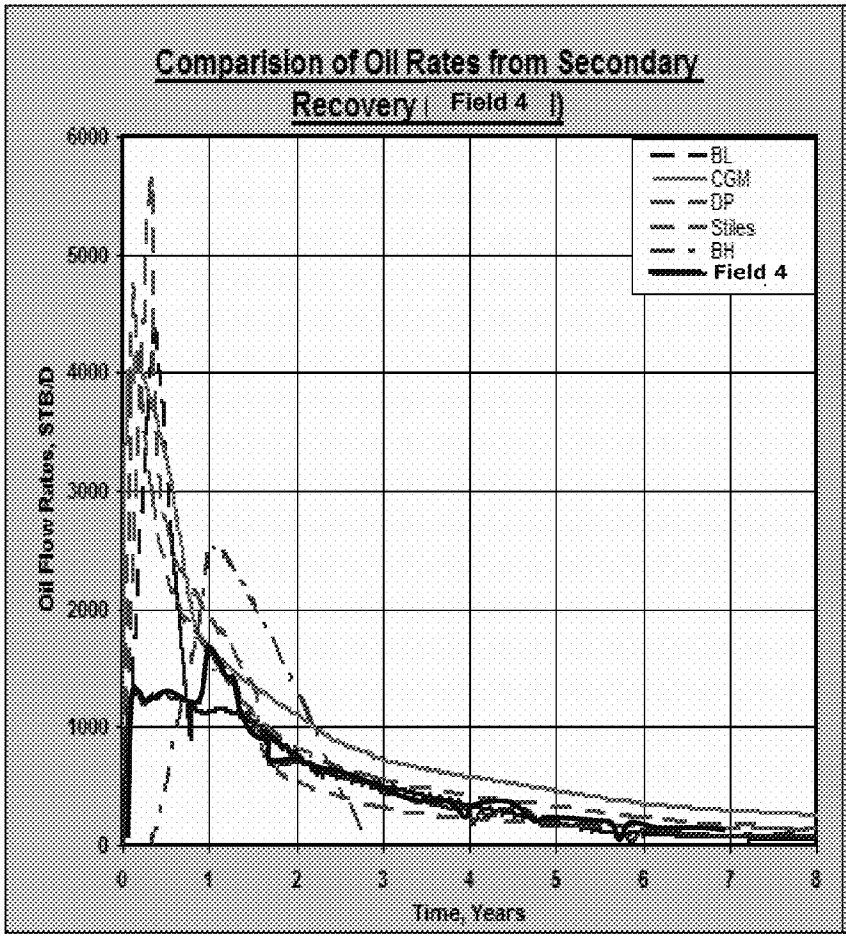

FIG. 26A shows a comparison of the oil flow rates versus time for the different WF performance computation methodologies using data from an actual reservoir; FIG. 26B shows a comparison of the cumulative oil produced versus time for the different WF performance computation methodologies using real data from a reservoir.

Figure 27:
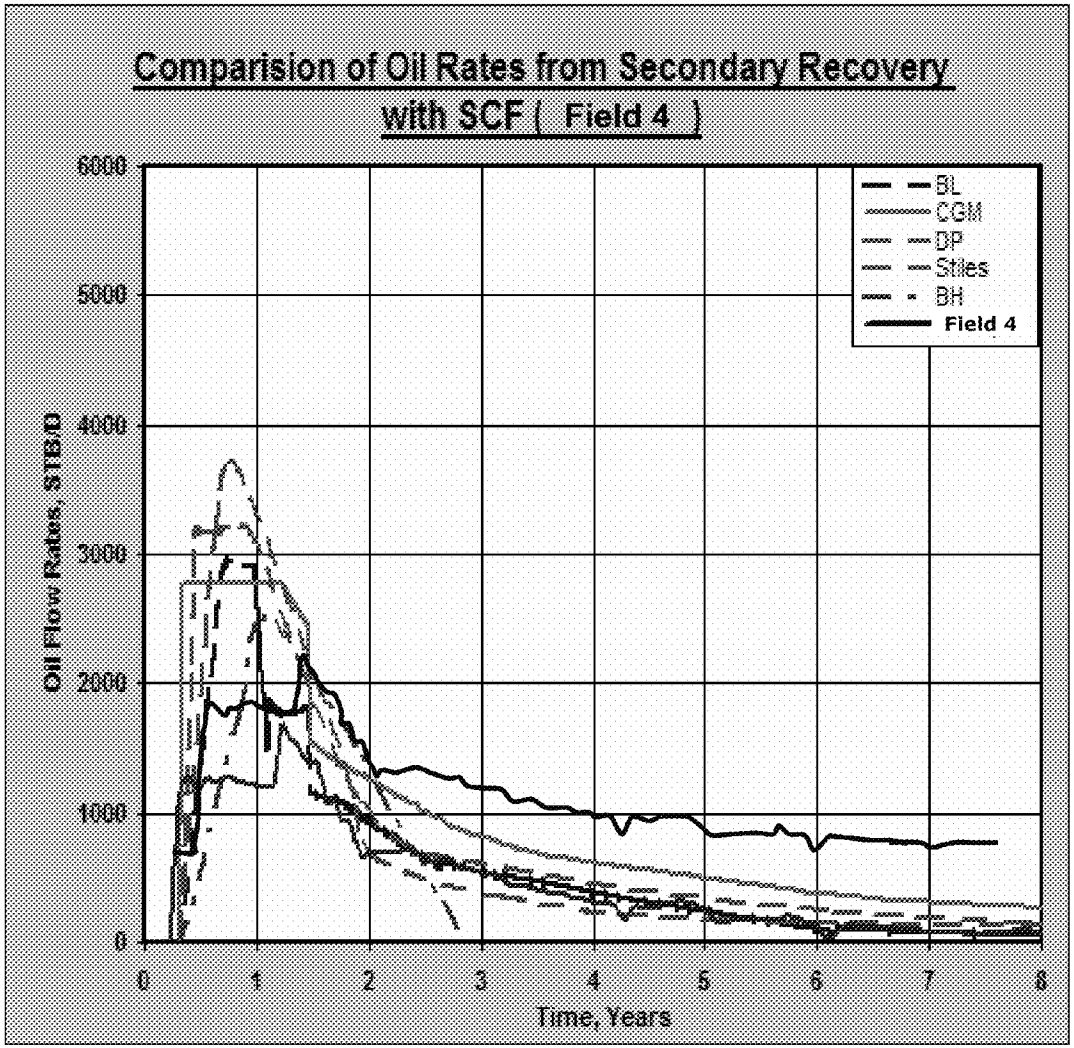

FIG. 27 shows application of the SCF to estimates of the oil flow rates from various WF performance computation methodologies as compared to actual field data.

Figure 28A:
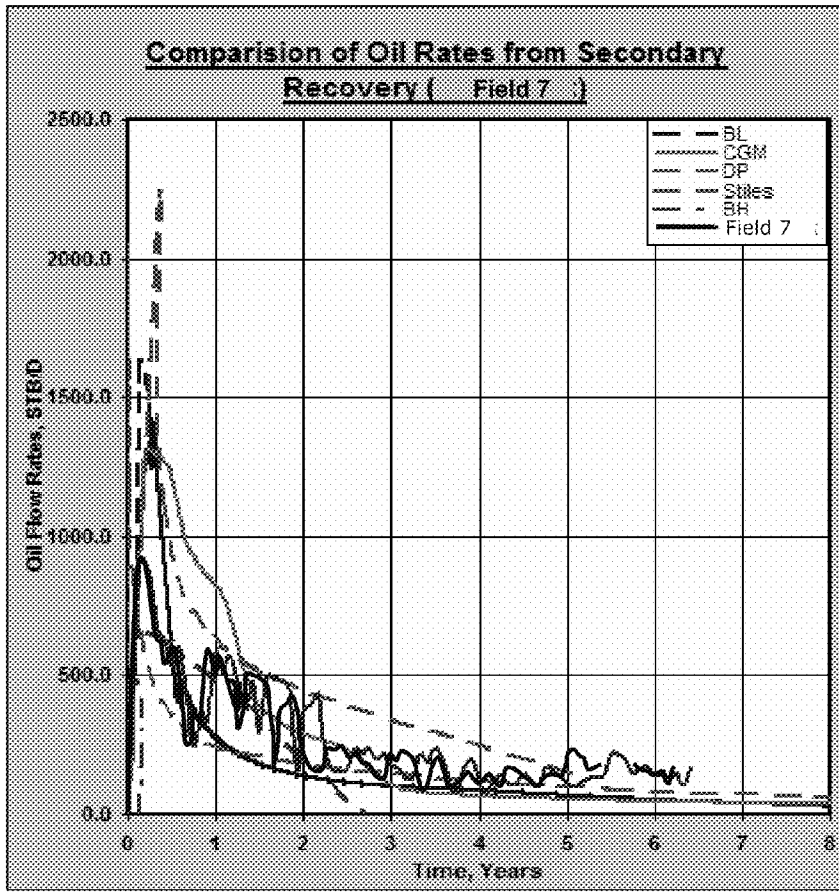
Figure 28B:
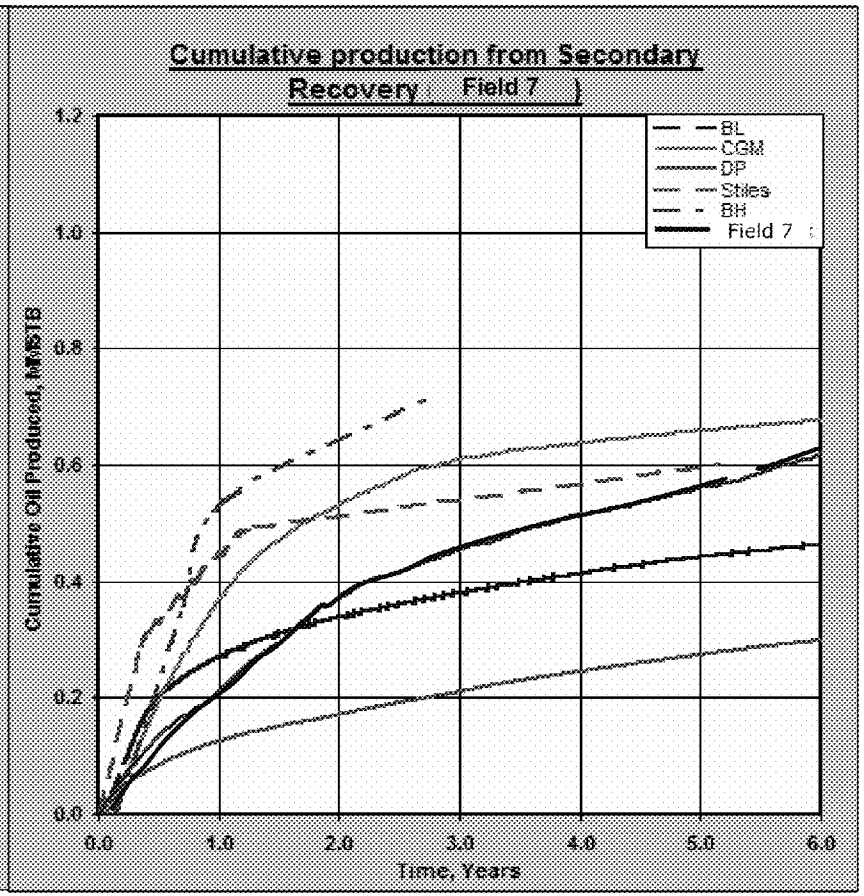

FIGS. 28A and 28B show comparisons of the oil flow rate versus time and the cumulative oil produced versus time, respectively, for various WF performance computation methodologies as compared to real field data.

Figure 29:
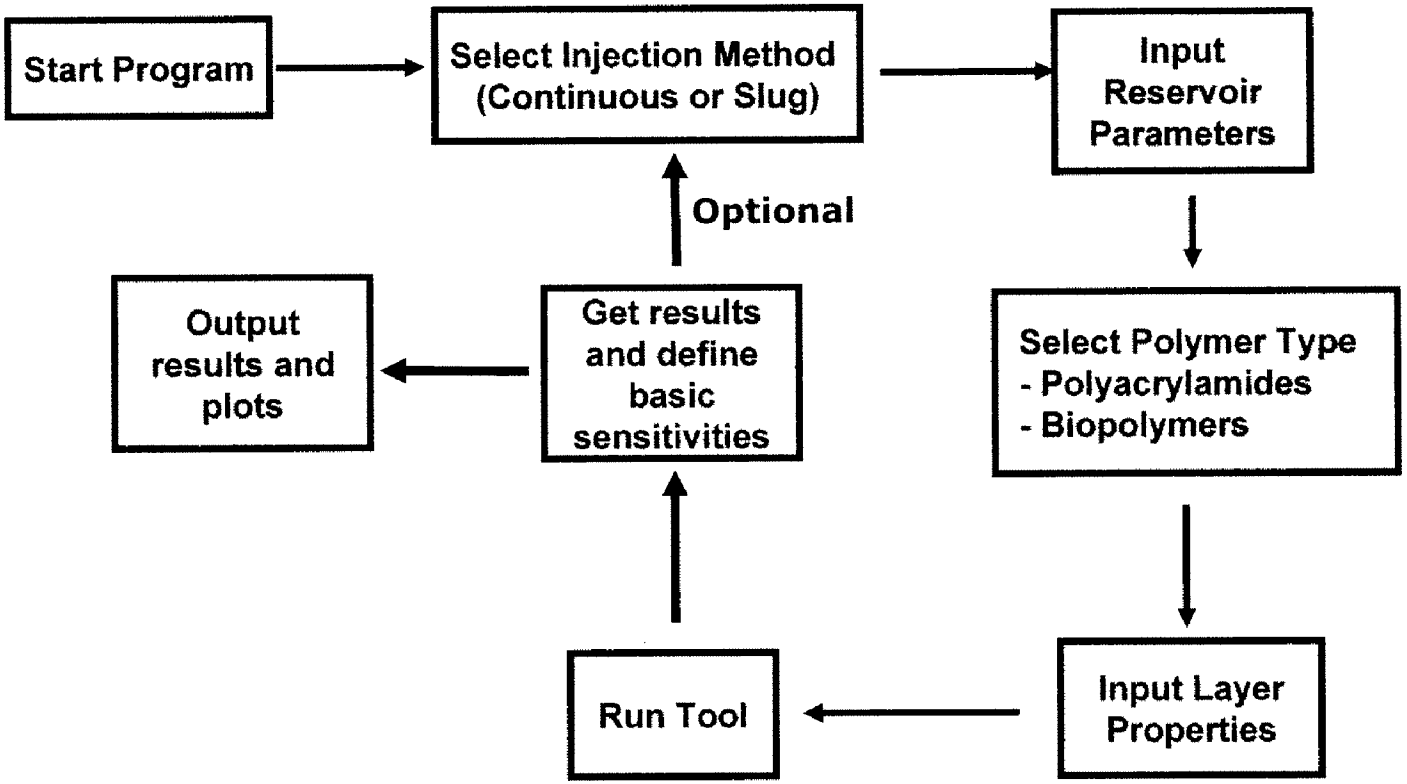

FIG. 29 illustrates a flow chart of a method of the polymer forecasting tool which may be computer-implemented.

Figure 30:
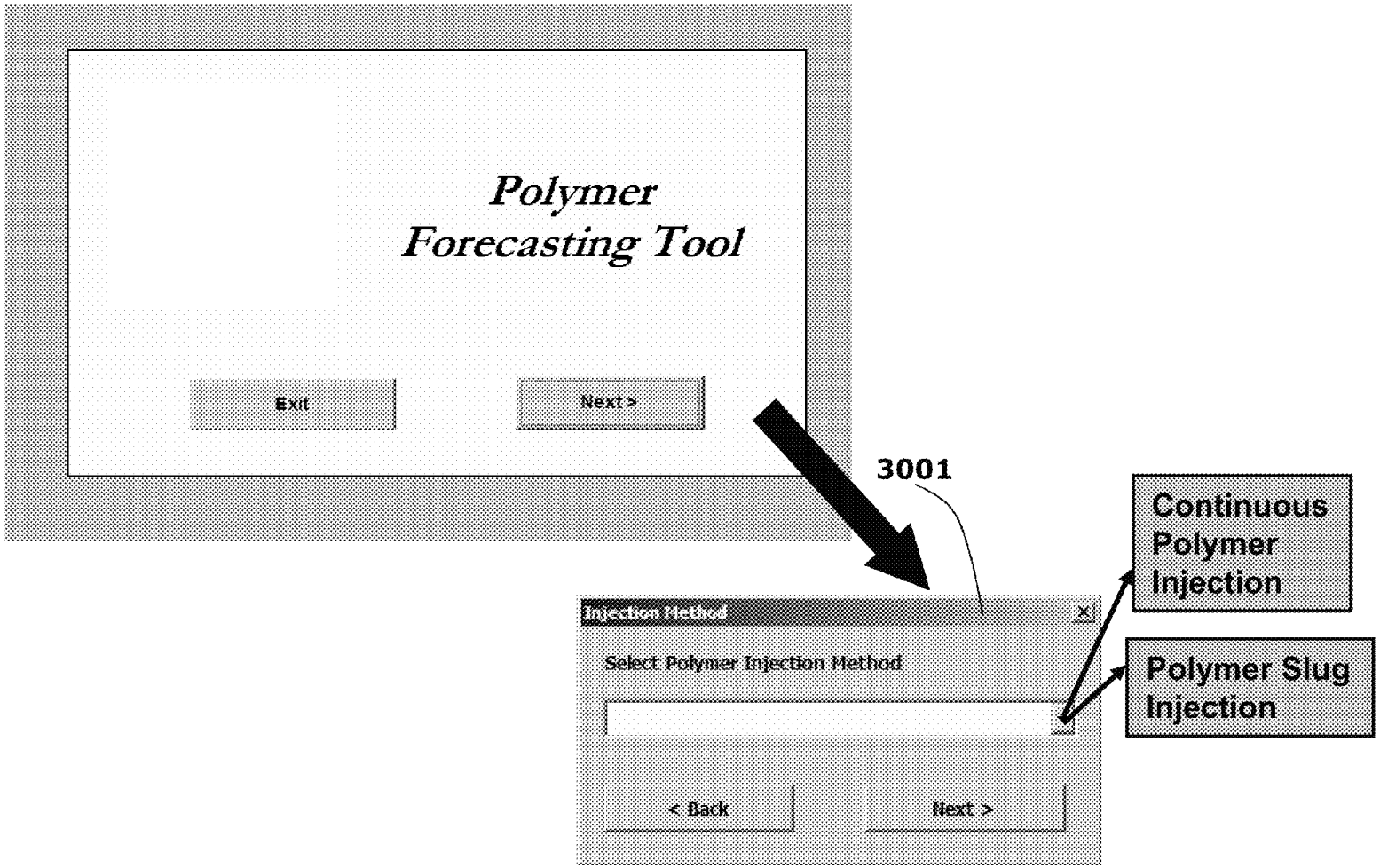

FIG. 30 illustrates the selection menu for selecting a polymer injection process.

Figure 31:
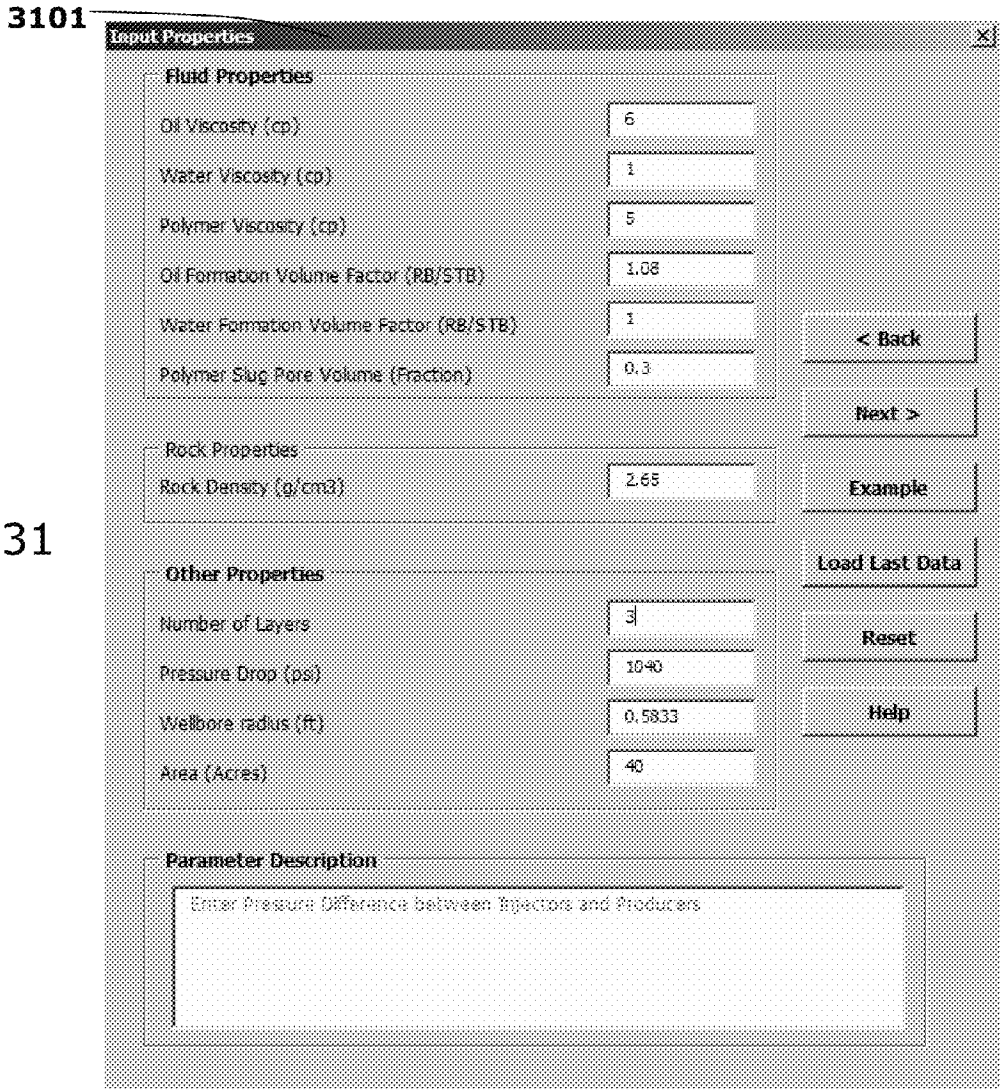

FIG. 31 shows a screen shot of an example input window 3101 for a polymer forecasting input module.

Figure 32:
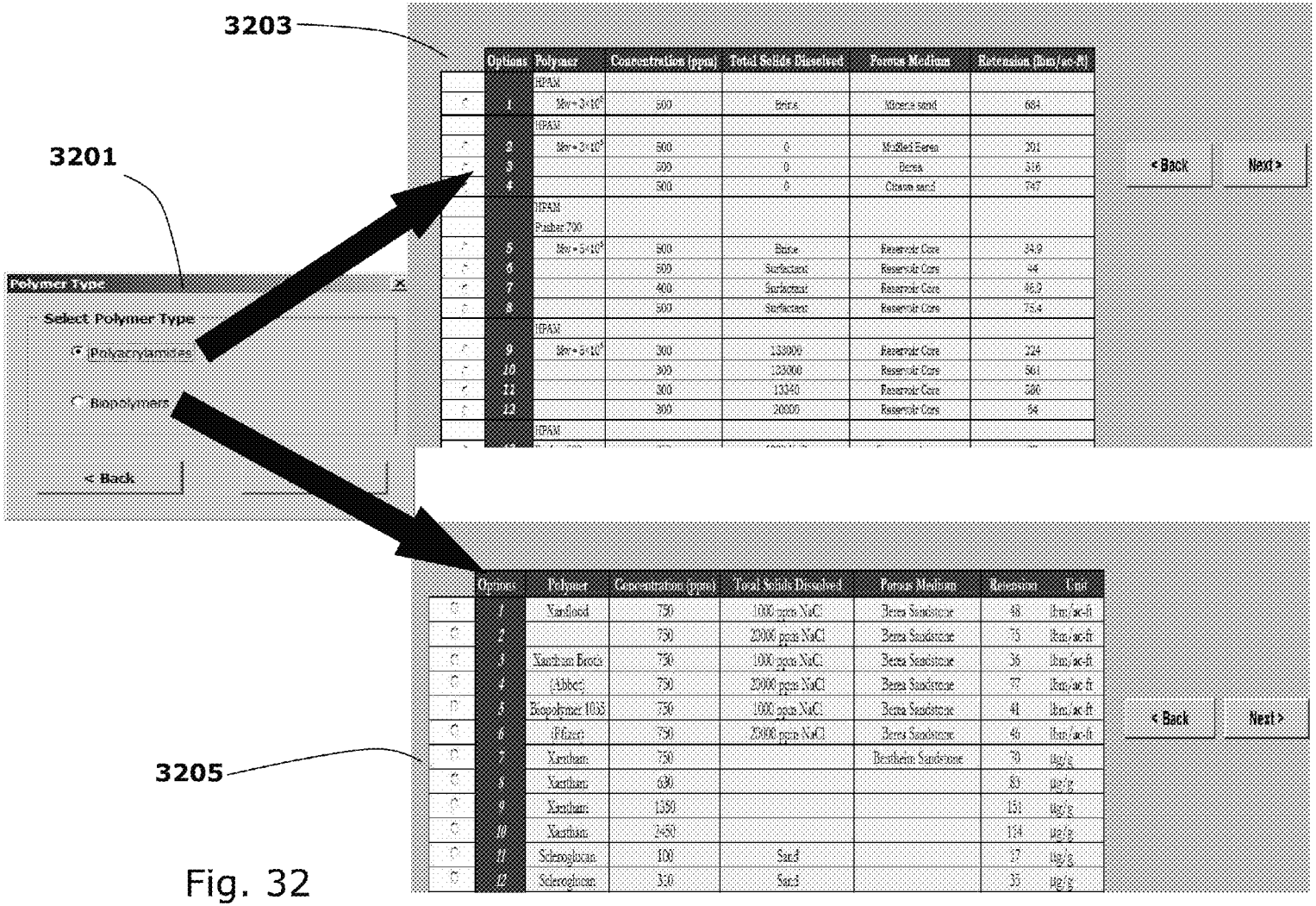

FIG. 32 illustrates the selection menu of the polymer types.

Figure 33:
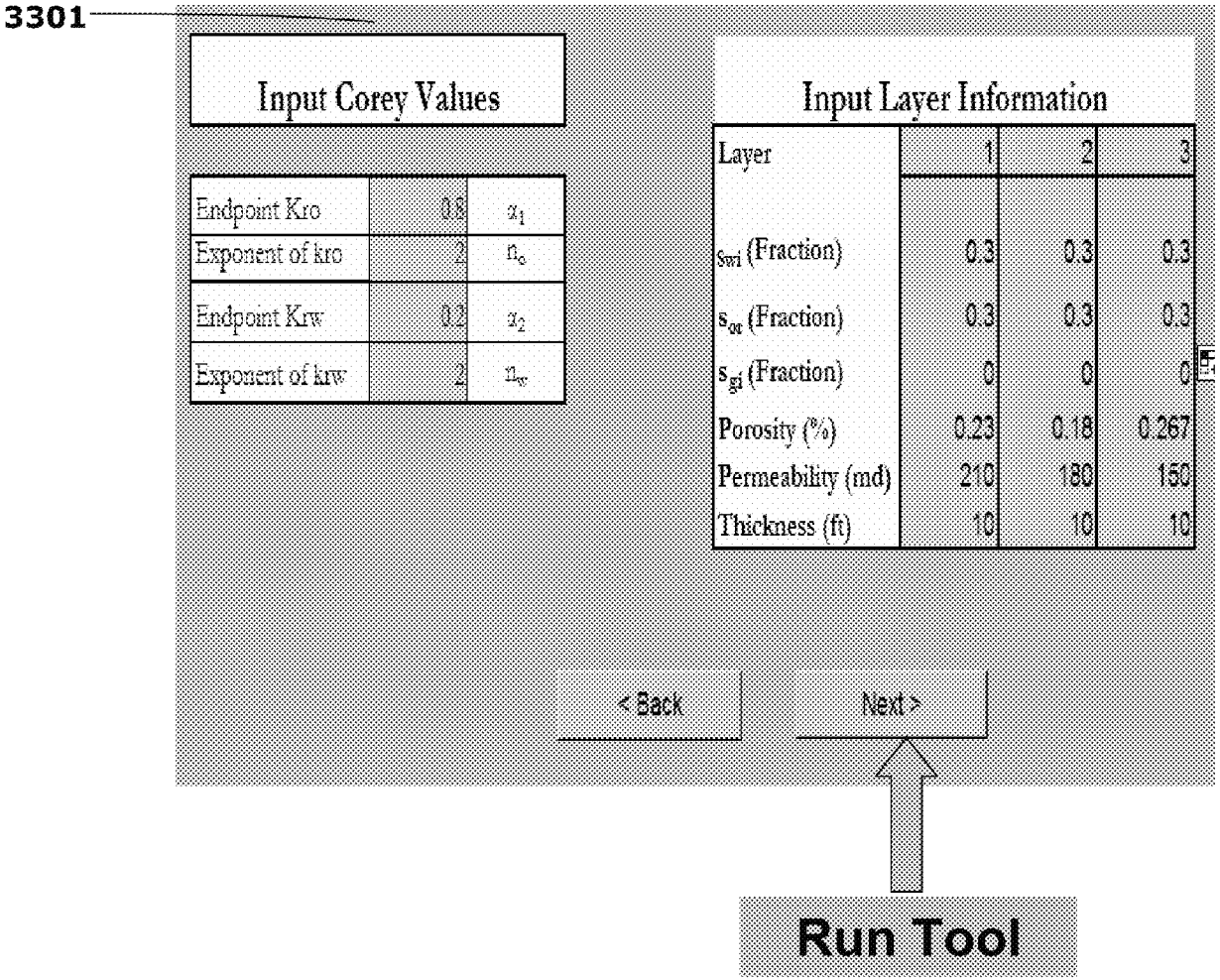

FIG. 33 shows values of relative permeability and layer information for an example reservoir.

Figure 34:
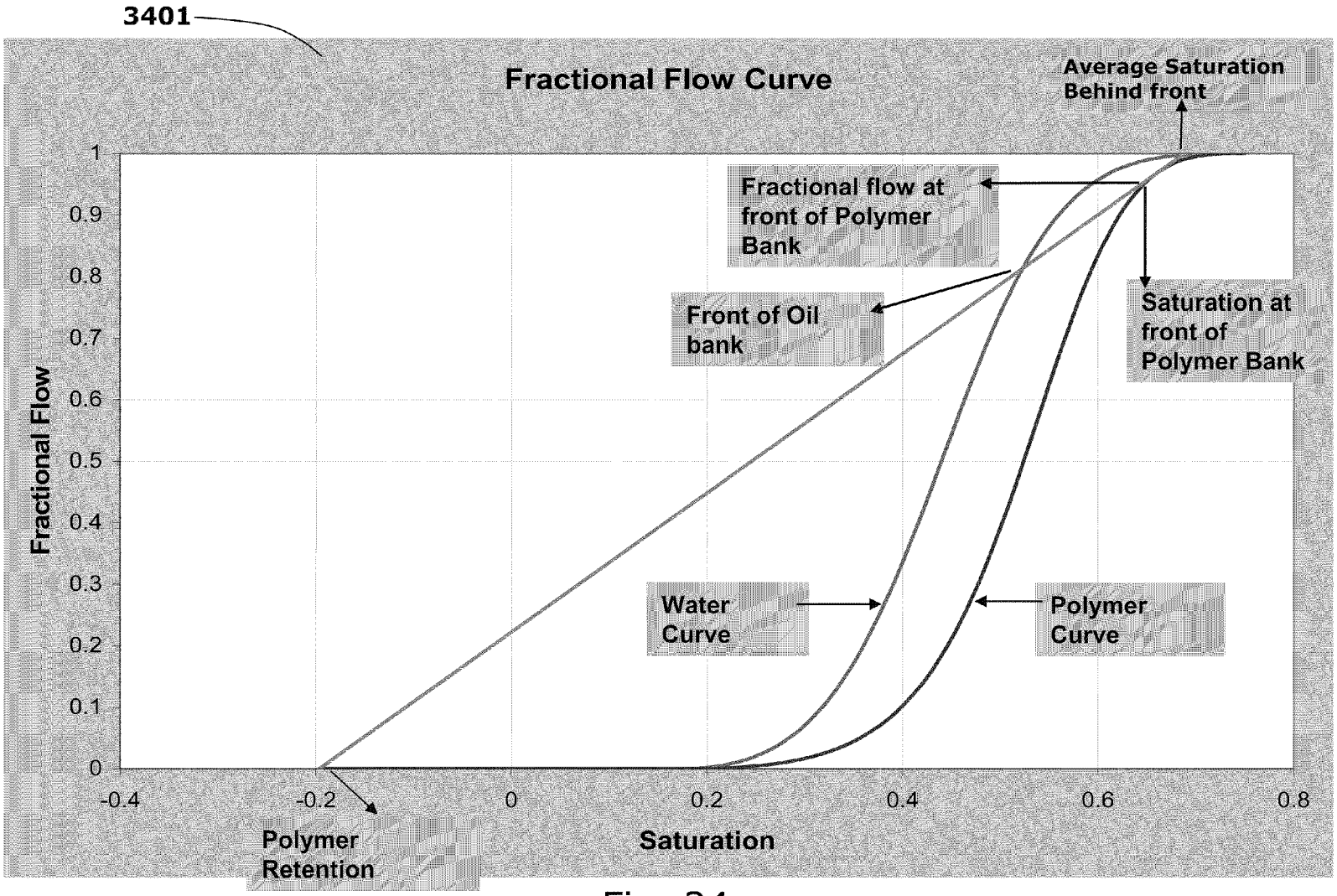

FIG. 34 shows a comparison of a water fractional flow curve vs. saturation and a polymer fractional flow curve vs. saturation with application of these processes to a reservoir, as well as an explanation of the features of the fractional flow curves.

Figure 35:
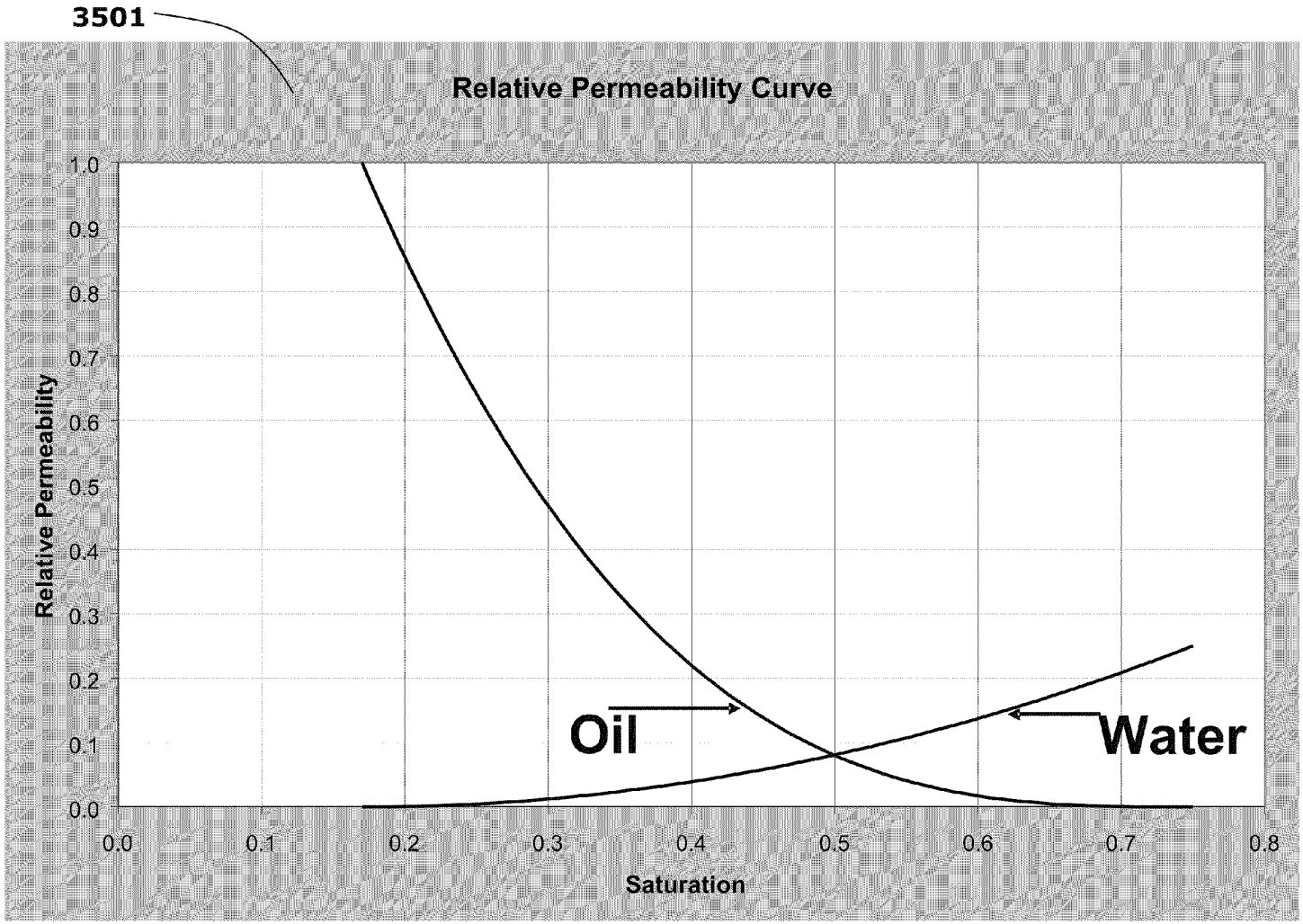

FIG. 35 shows a plot of example relative permeability curves vs. saturation for oil and water.

Figure 36A:
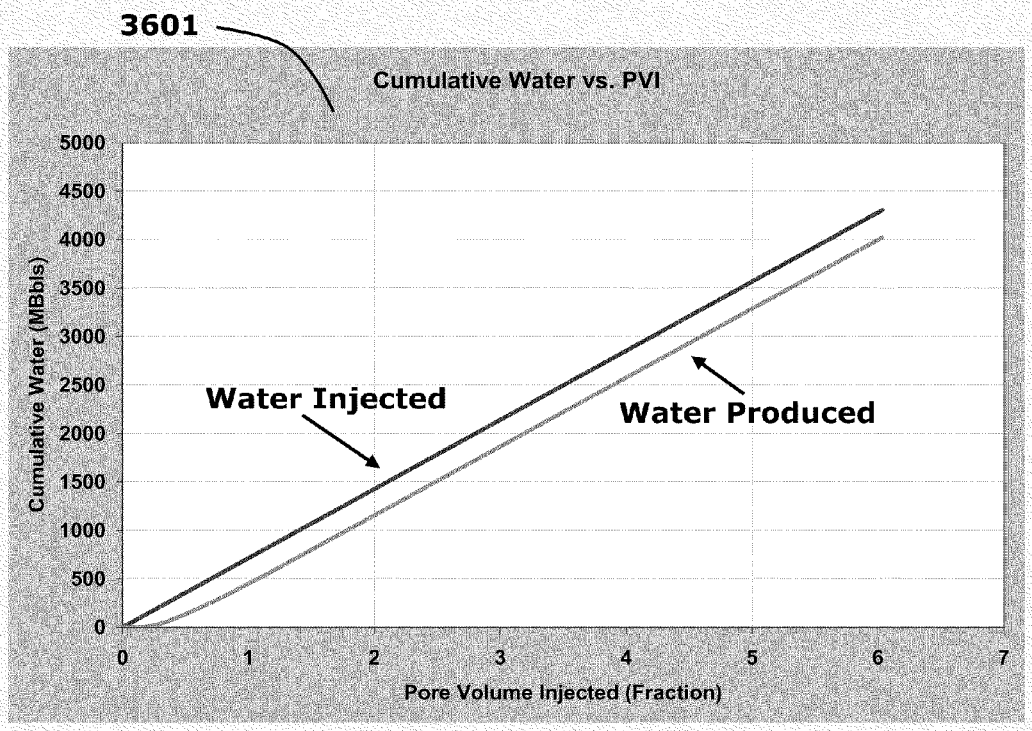
Figure 36B:
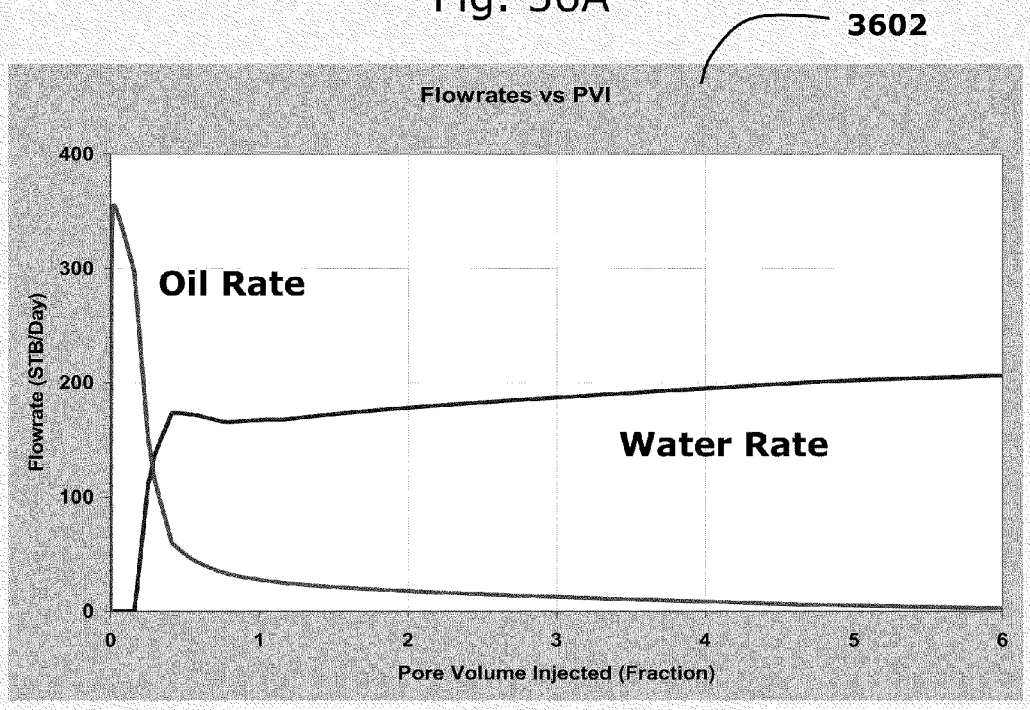
Figure 36C:
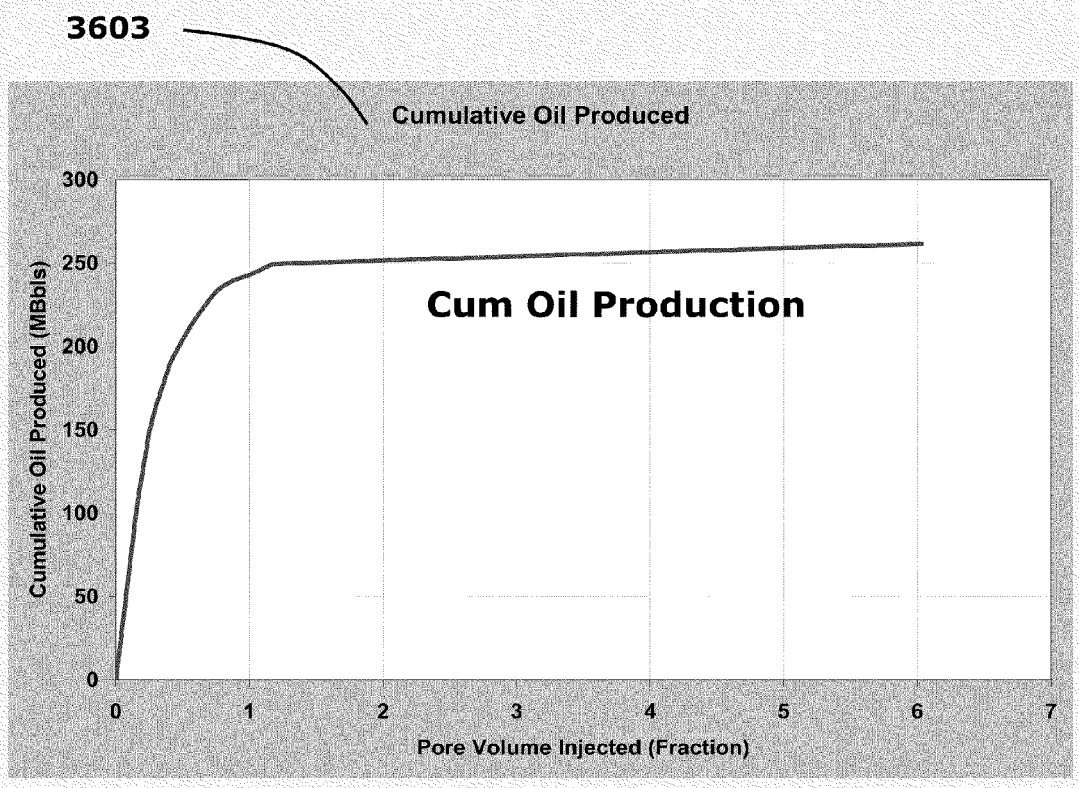

FIG. 36A shows example plots of the cumulative water injected and produced vs. pore volume injected (PVI); FIG. 36B shows example plots of the oil and water flow rate vs. PVI;

FIG. 36C shows an example cumulative oil production vs. PVI.

FIG. 37 shows input data for a parameter applicable to the polymer flood forecasting tool.

Figure 38:
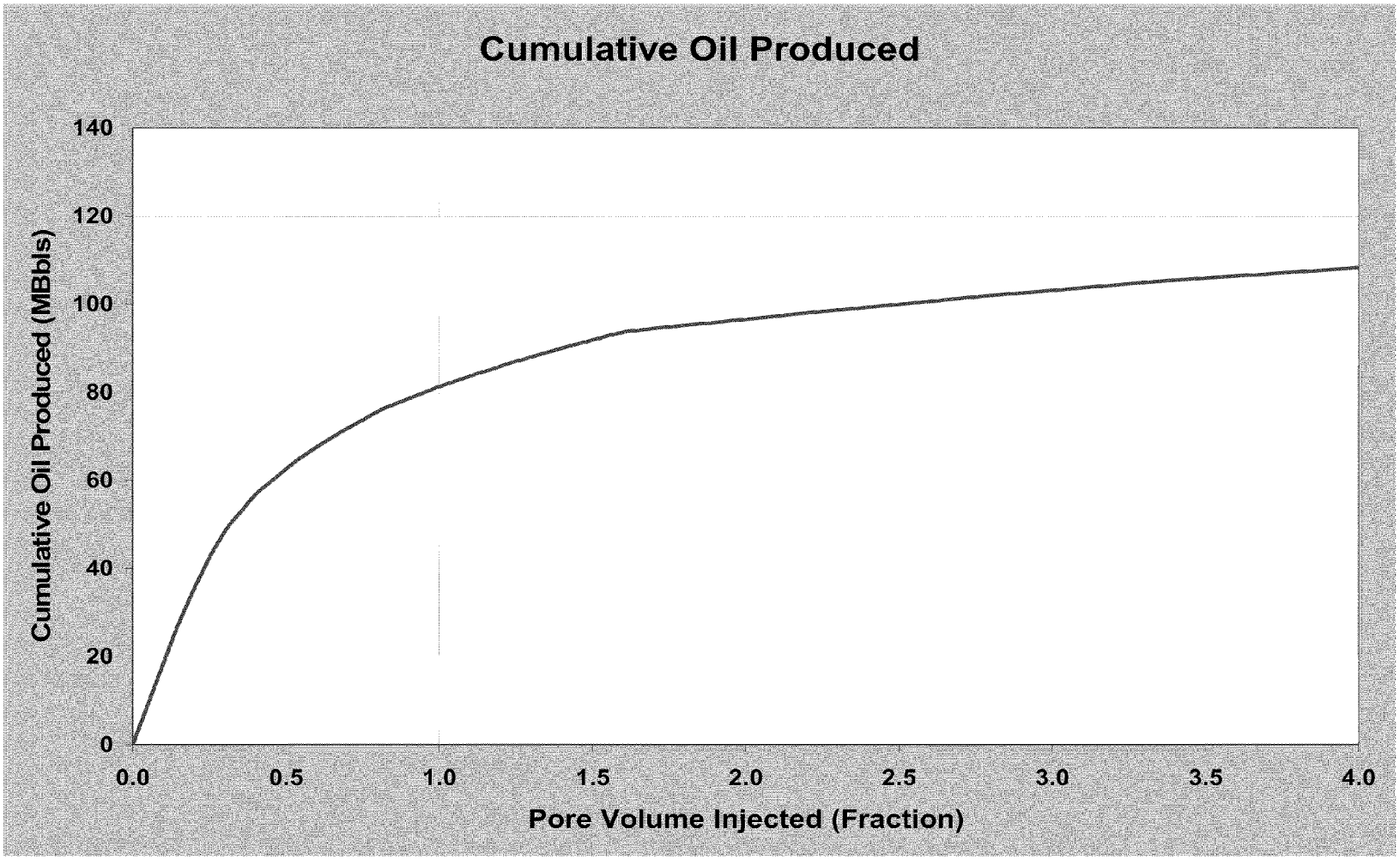

FIG. 38 shows a plot of the cumulative oil produced vs. PVI output by the polymer flood forecasting tool calculations using input data from a reservoir.

Figure 39:
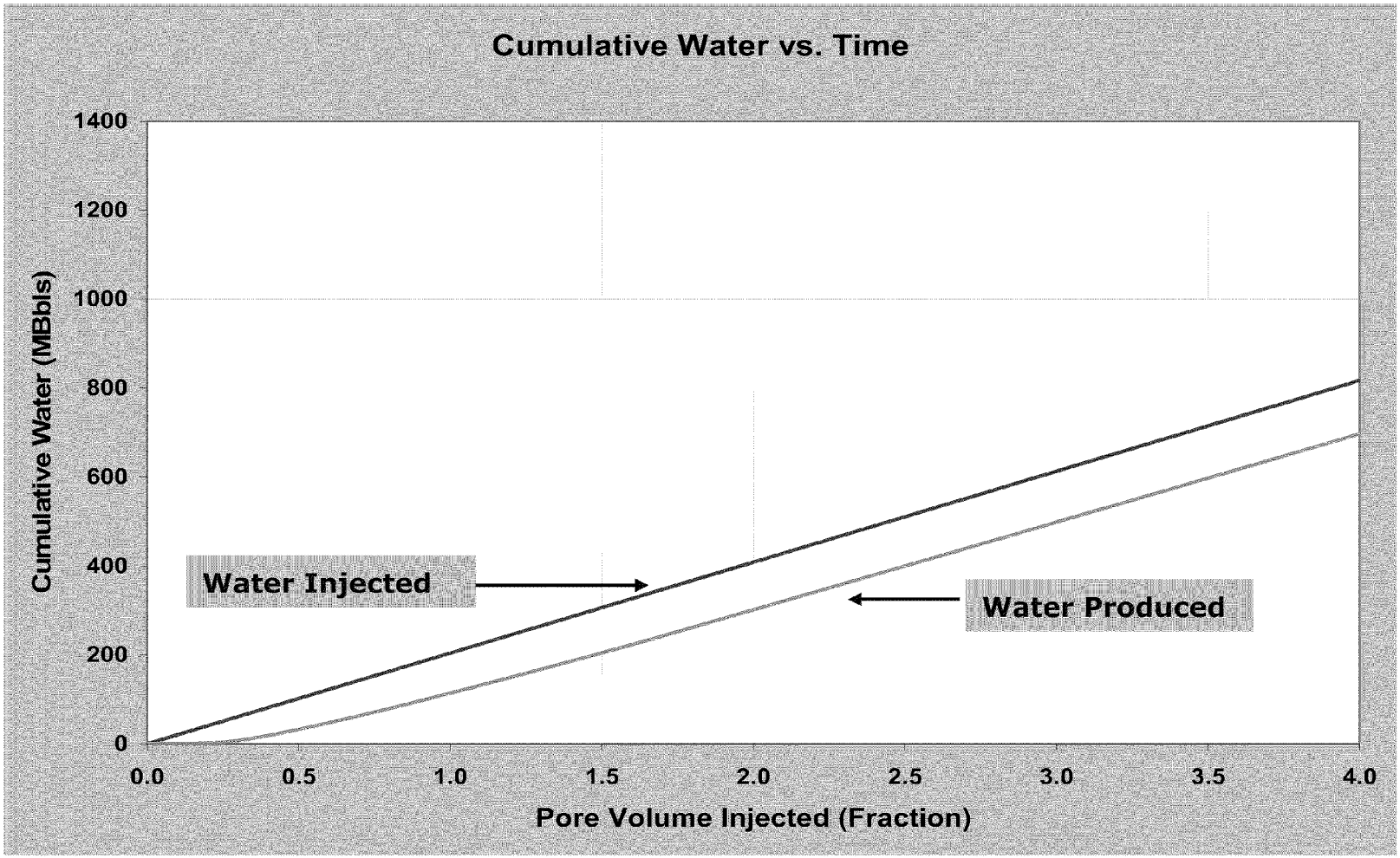

FIG. 39 shows plots of the cumulative water injected and produced vs. PVI for the reservoir.

FIG. 40 shows values of parameters for an input data set.

Figure 41A:
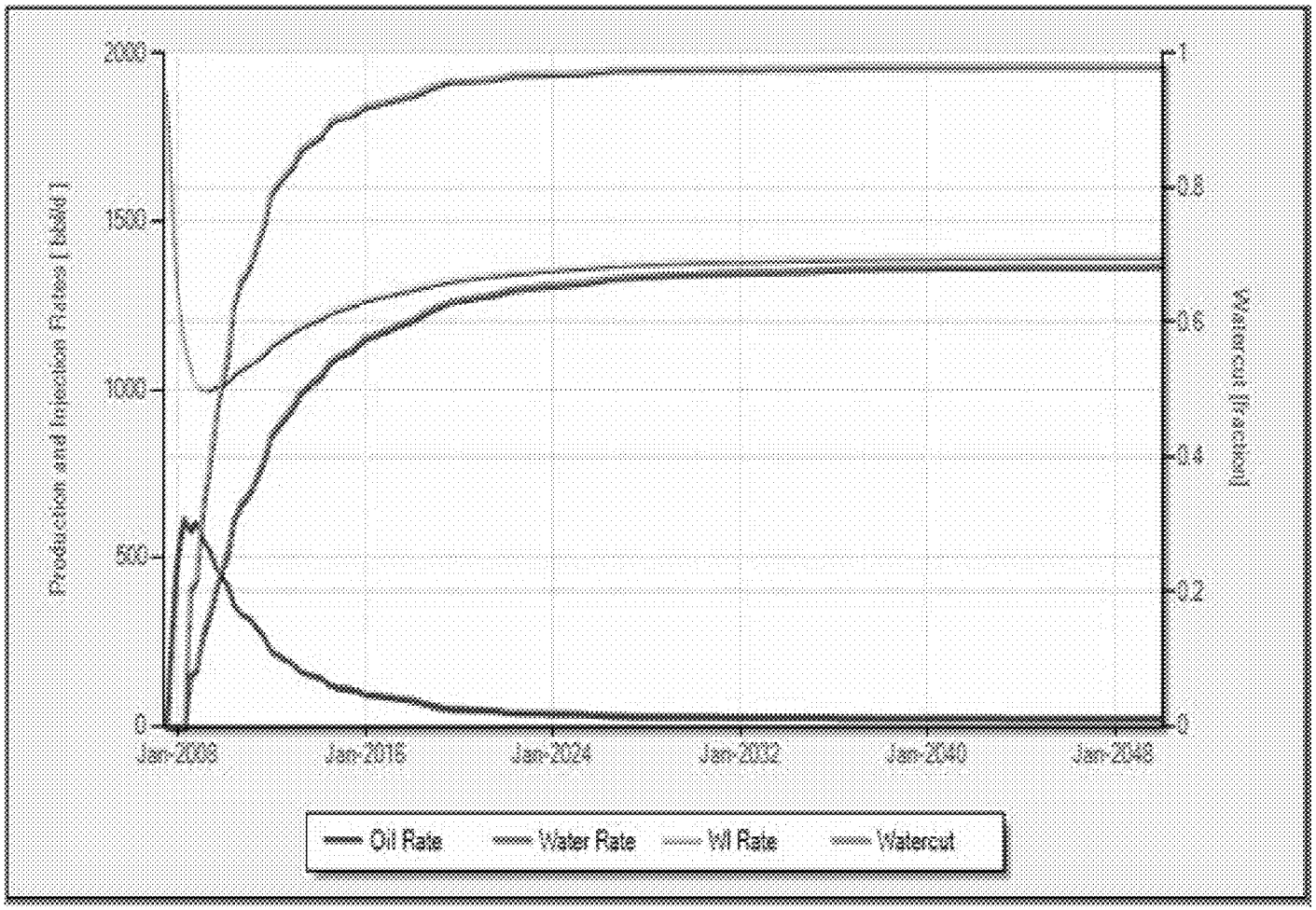

FIG. 41A shows plots of oil and water production rates over time, which provide a comparison of results of the performance of a waterflood process and a polymer flood process.

Figure 41B:
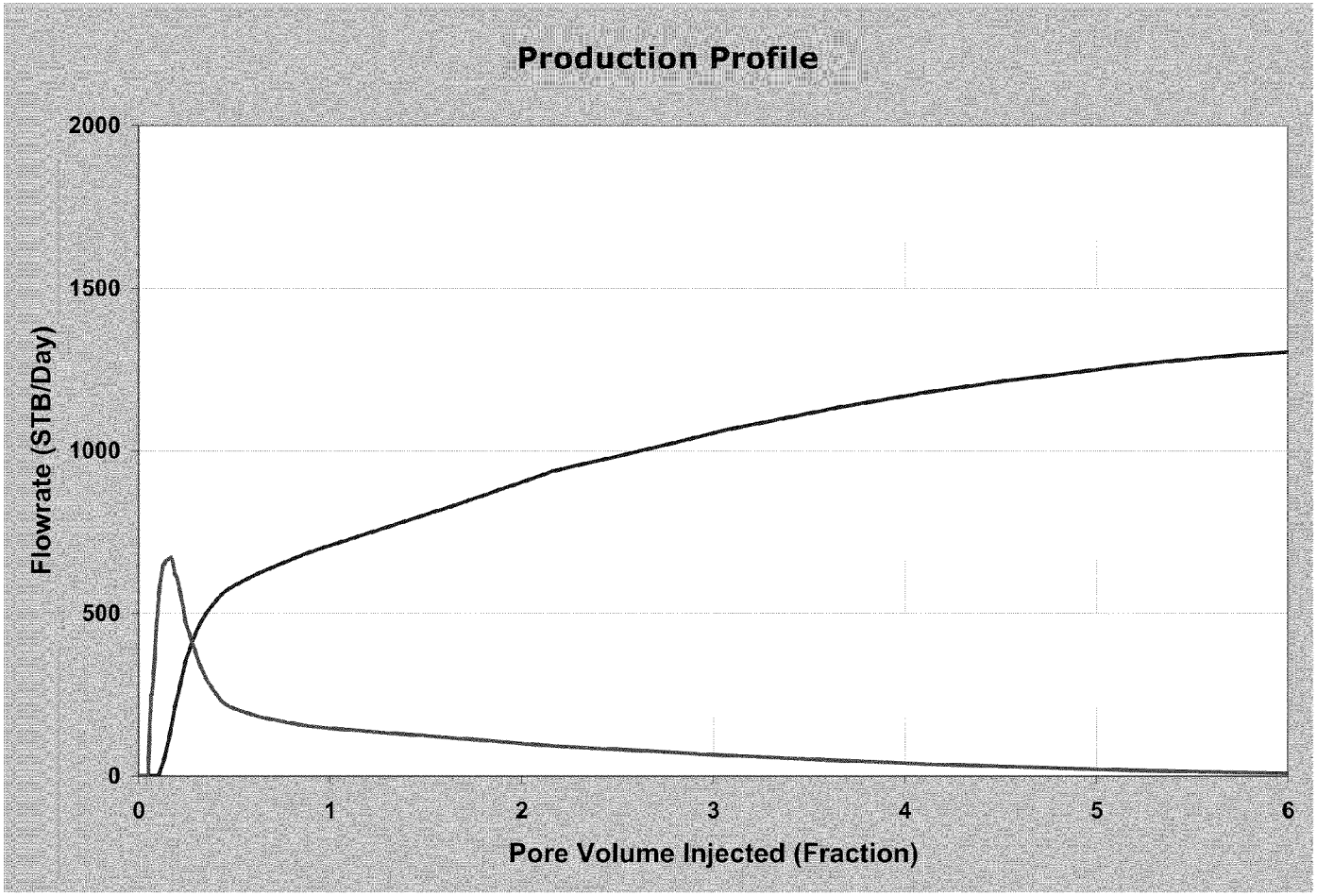

FIG. 41B shows a plot of the water production flow rates versus PVI calculations.

Figure 42A:
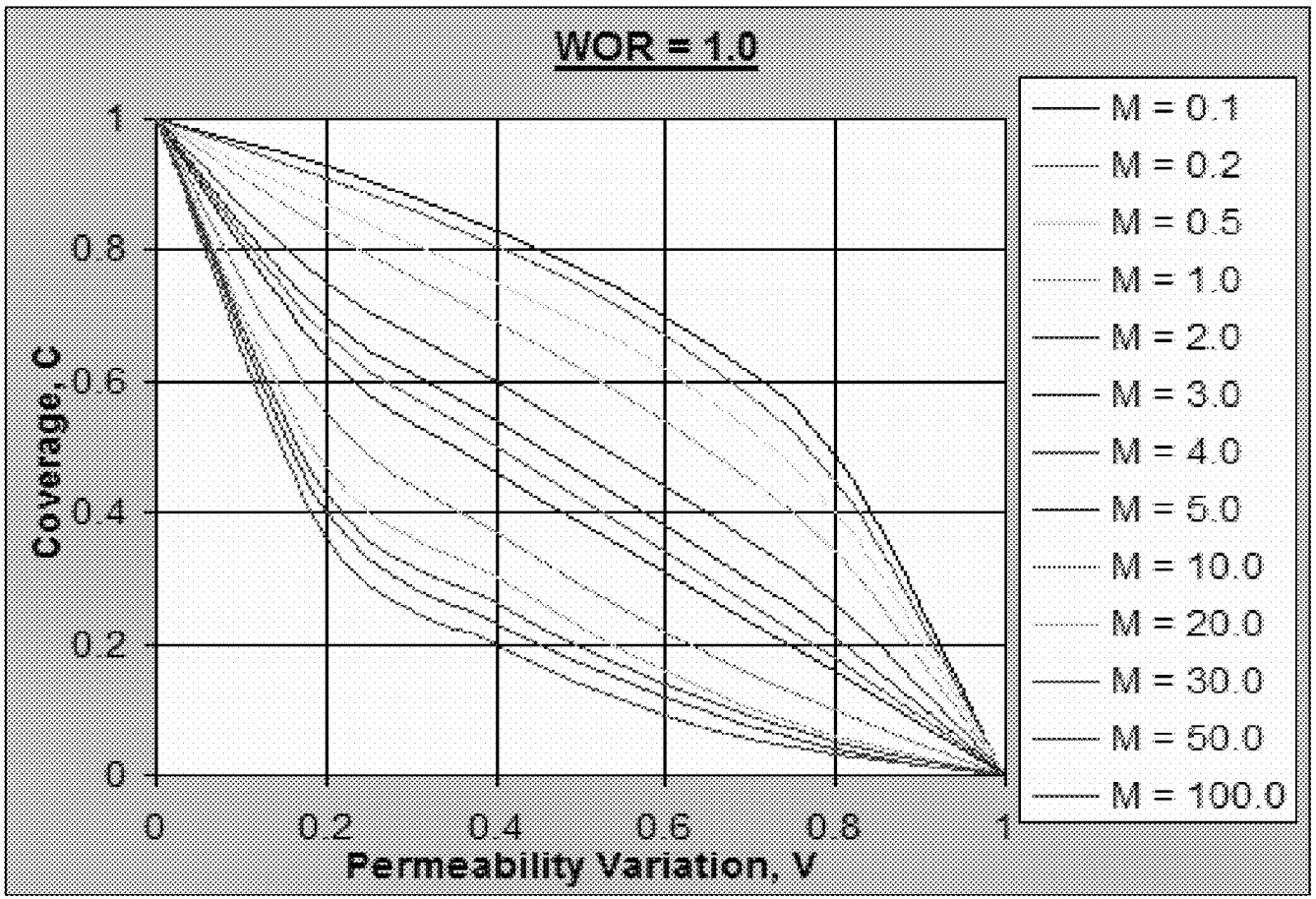

FIG. 42A shows plots of the vertical coverage plotted against the permeability variation for a water-oil ratio (WOR) =1. FIG. 42A shows the values of correlations according to the Dykstra-Parsons method which values are stored within the polymer flood forecasting tool.

Figure 42B:
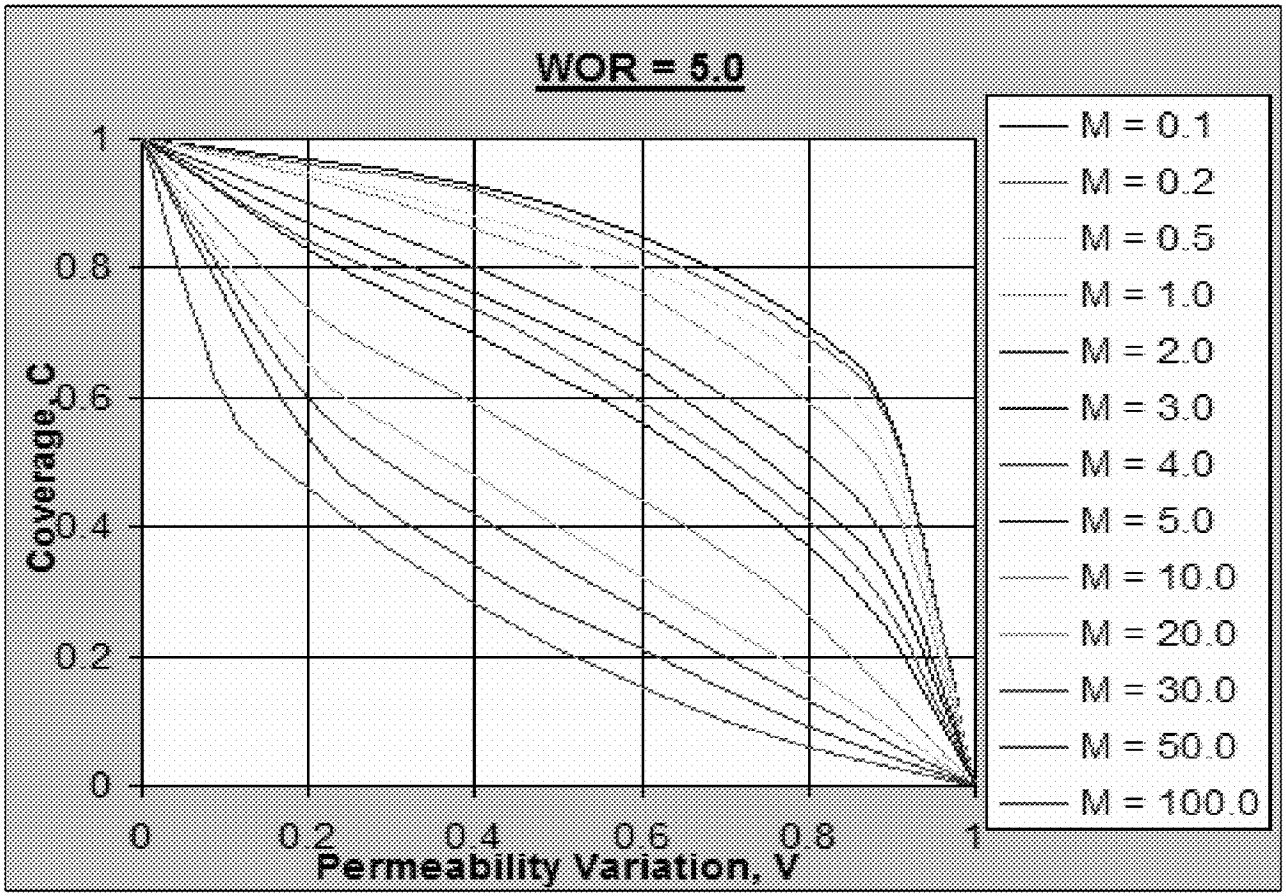

FIG. 42B shows plots of the vertical coverage plotted against the permeability variation for a WOR=5. FIG. 42B shows the values of correlations according to the Dykstra-Parsons method which values are stored within the polymer flood forecasting tool.

FIG. 43 lists input variables for a WF screening tool.

FIG. 44 shows a display for the WF injection scheme.

Figure 45:
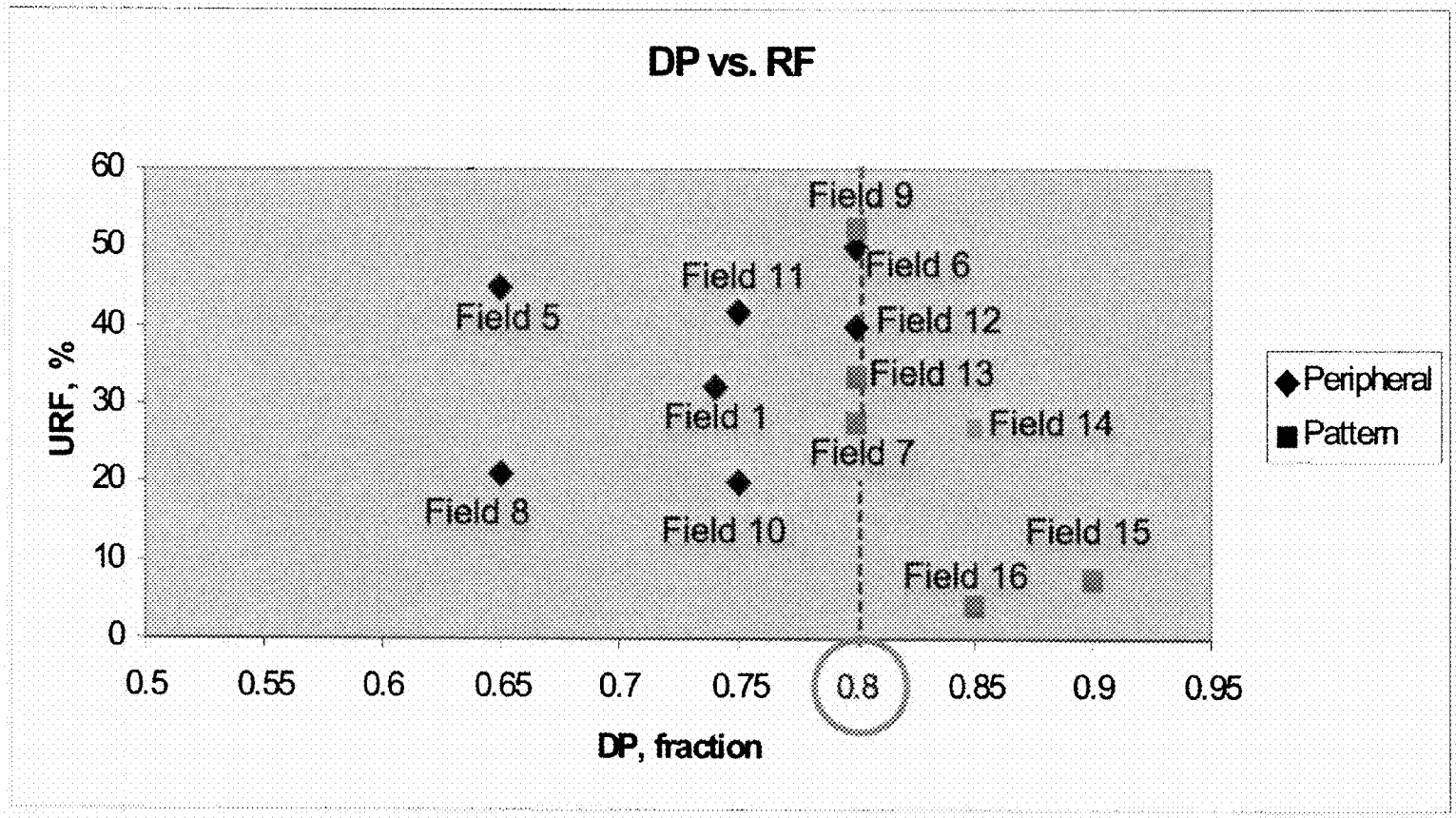

FIG. 45 shows an example of a cutoff determination procedure for the Dykstra-Parsons coefficient (using a plot of the URF % versus the DP).

Figure 46:
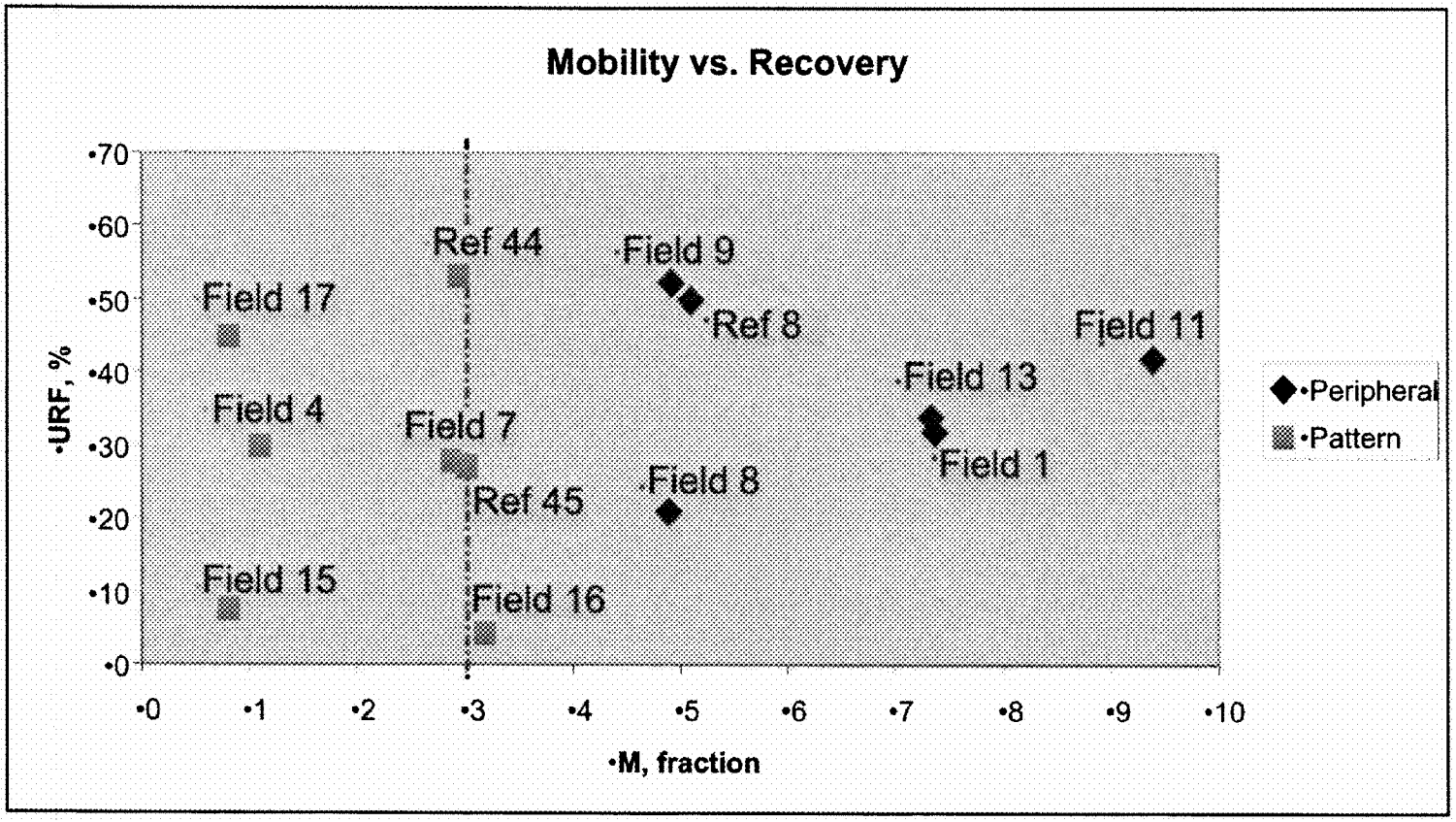

FIG. 46 shows an example of a cutoff determination procedure for the mobility ratio (using a plot of the URF % versus the mobility ratio).

Figure 47:
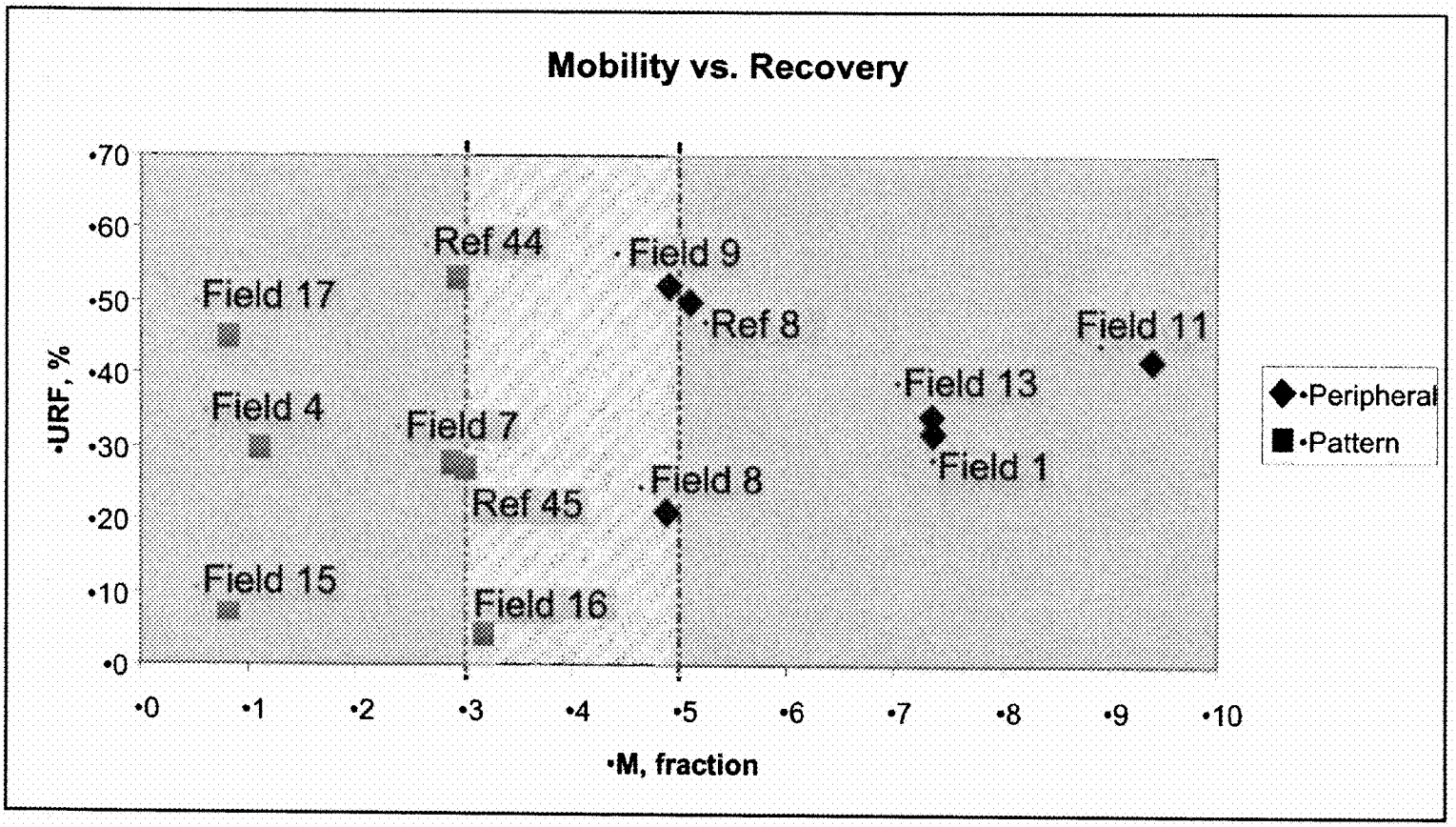

FIG. 47 shows an example of a cutoff determination procedure for the mobility ratio (using a plot of the URF % versus the mobility ratio).

FIG. 48 shows a comparison of waterflood performance computation methodologies, published in Craft et al. (revised by Terry, R), 1991, "Applied Petroleum Reservoir Engineering," 2nd Ed., Prentice Hall PTR, N.J.

Figure 49:
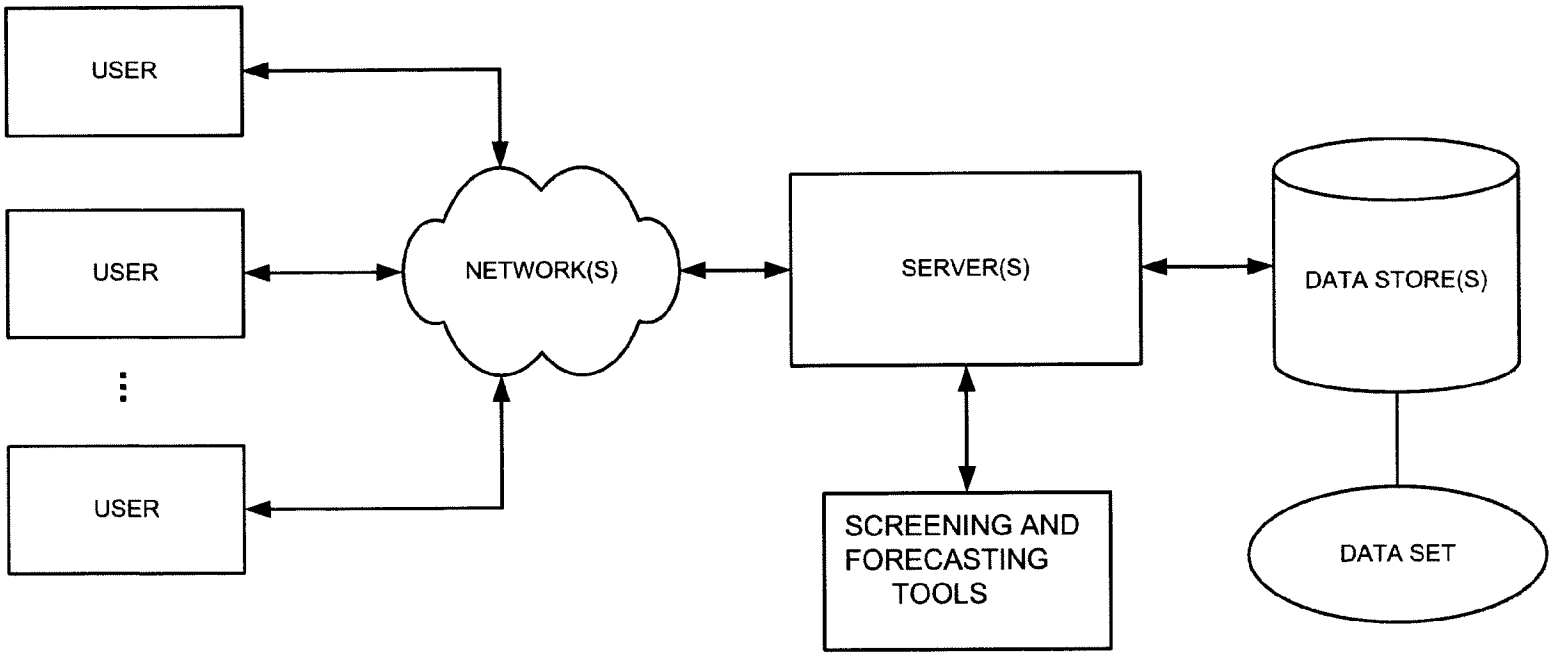

FIG. 49 illustrates an example computer system for implementing the methods disclosed herein.

Figure 50:
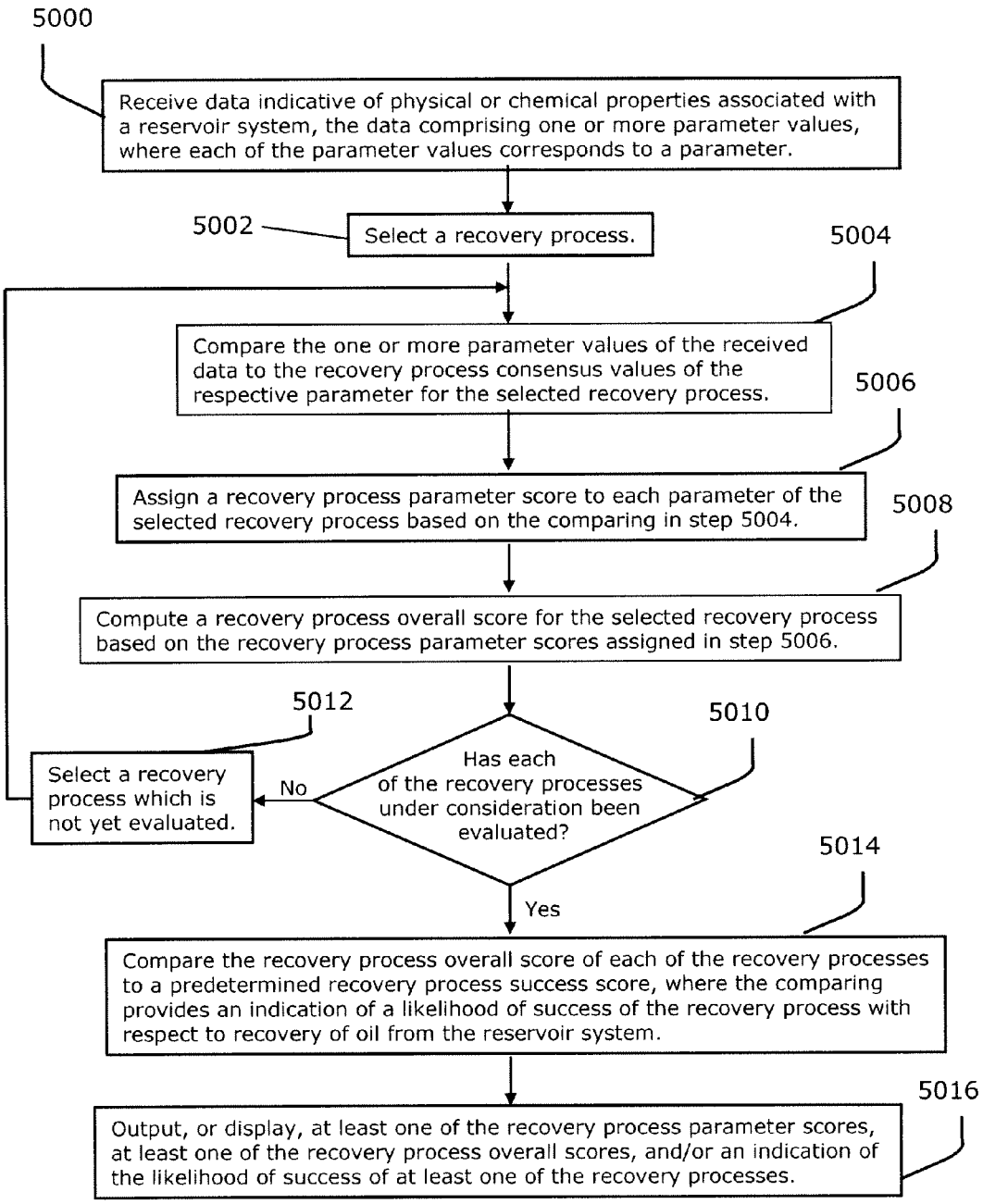

FIG. 50 illustrates a flow chart of a method for screening among recovery processes which may be computer-implemented.

Figure 51:
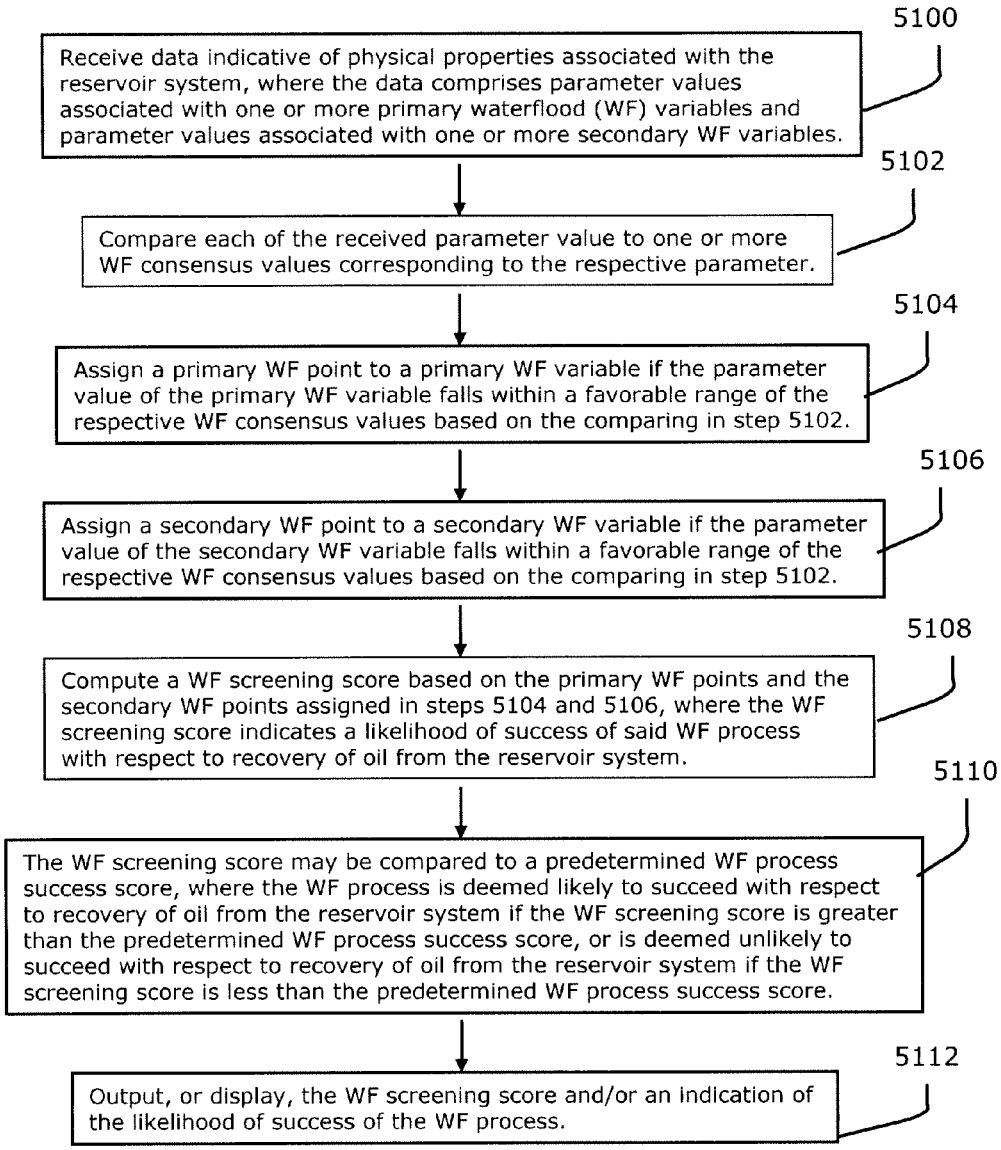

FIG. 51 illustrates a flow chart of a method for screening a reservoir for application of a waterflood process which may be computer-implemented.

Figure 52:
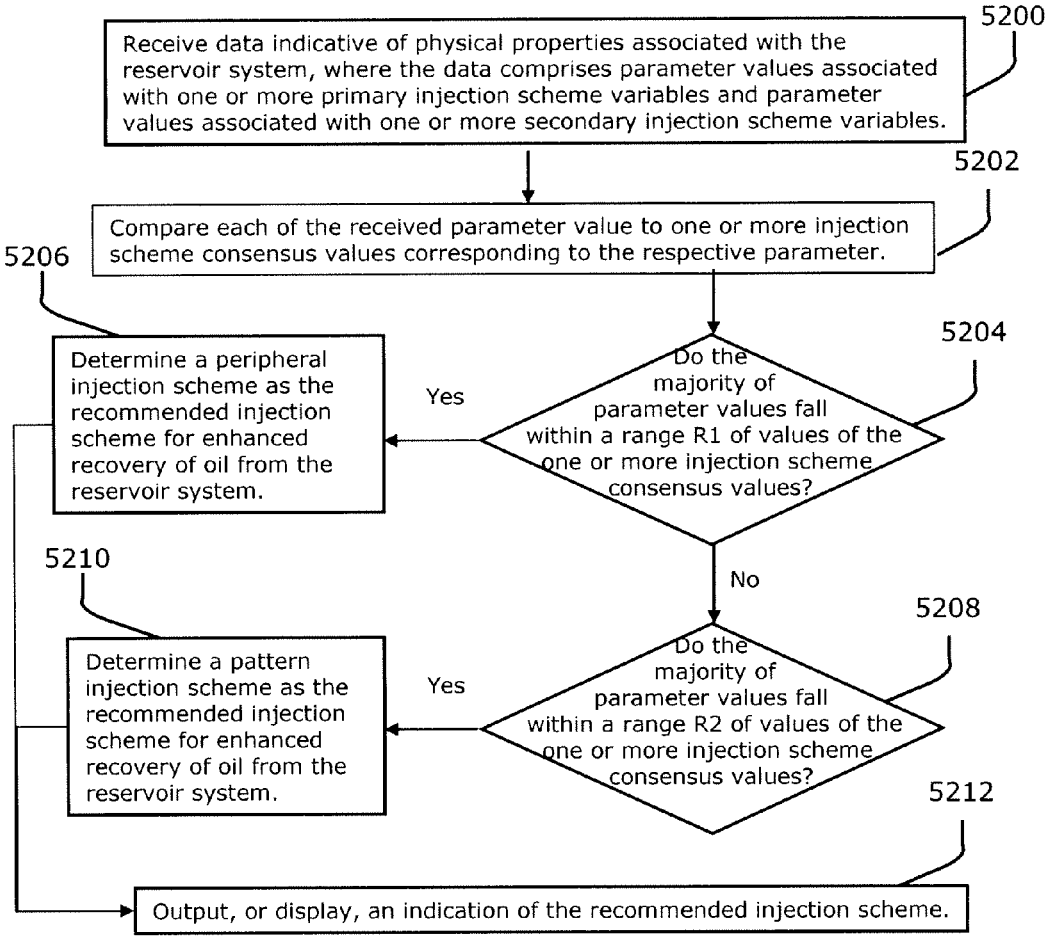

FIG. 52 illustrates a flow chart of a method for evaluating an injection scheme for application of a waterflood process which may be computer-implemented.

Figure 53:
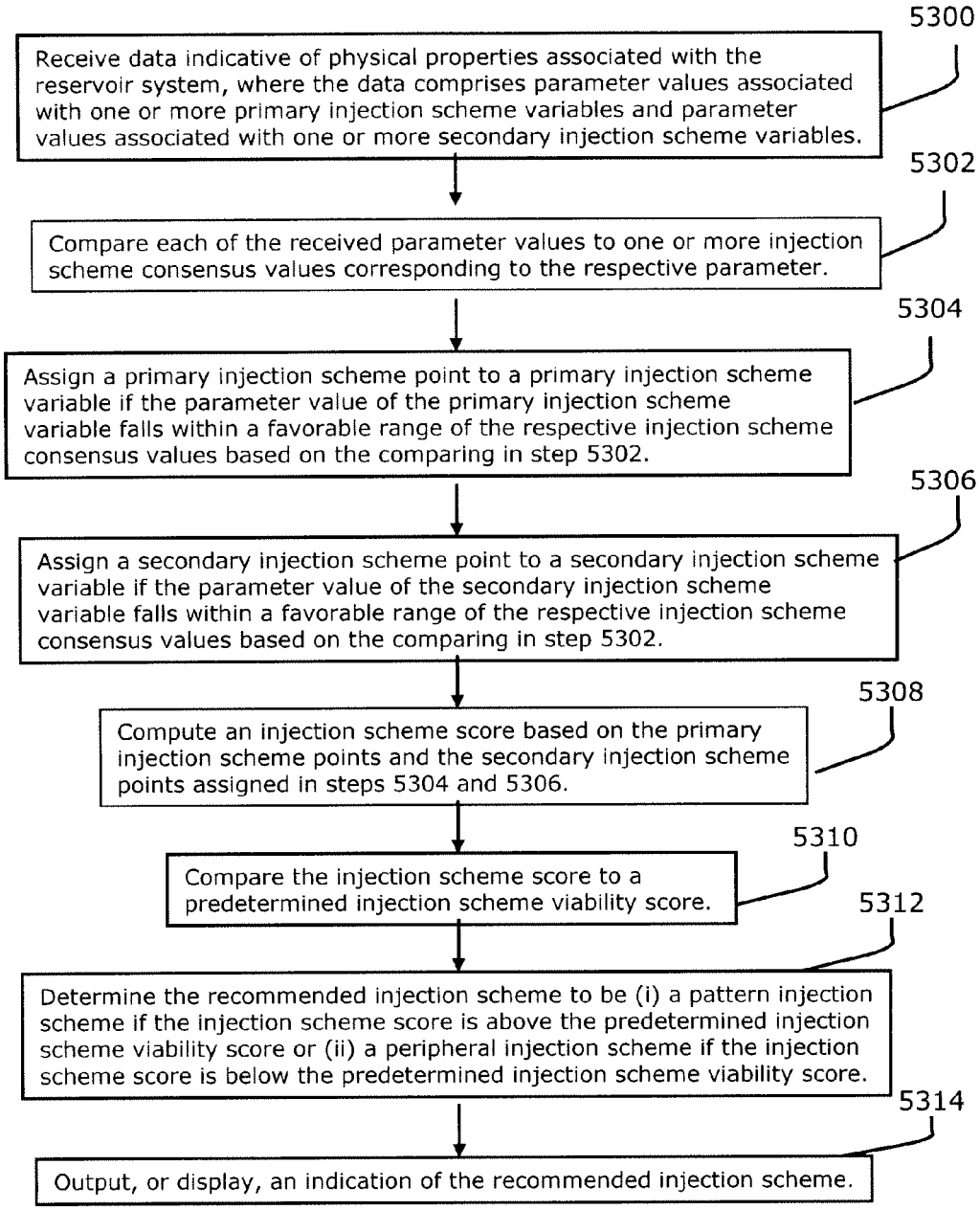

FIG. 53 illustrates a flow chart of a method for evaluating an injection scheme for application of a waterflood process which may be computer-implemented.

Figure 54:
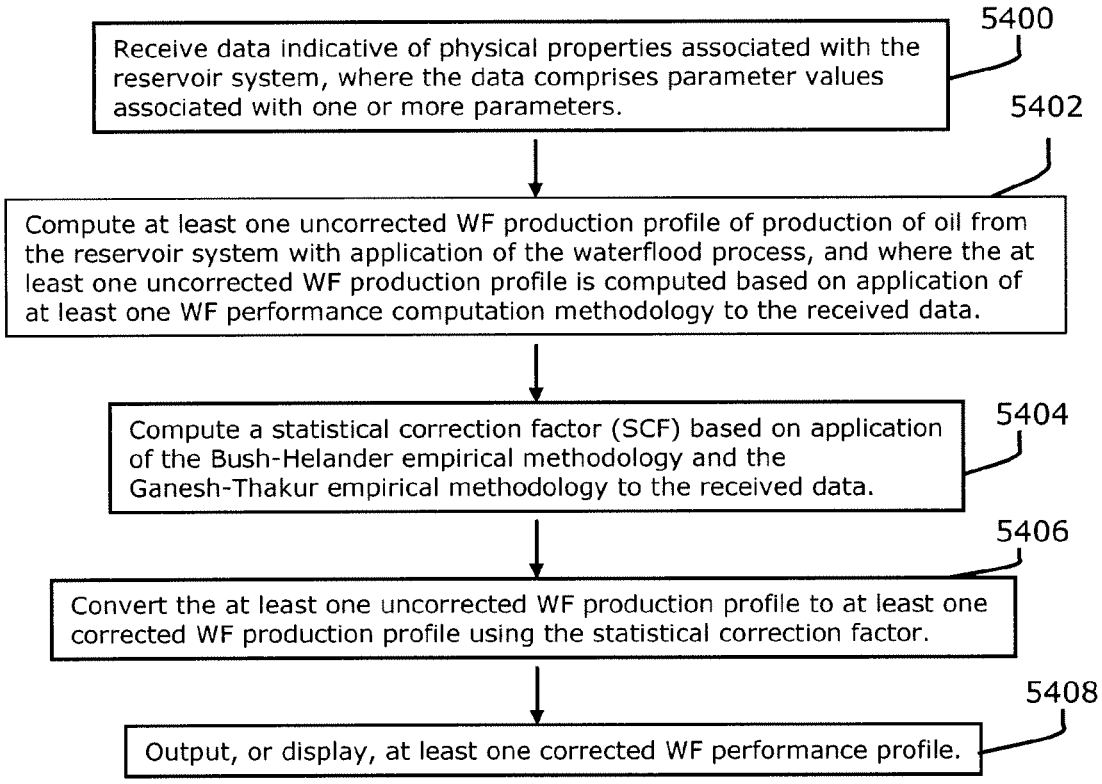

FIG. 54 illustrates a flow chart of a method of the waterflood forecasting tool which may be computer-implemented.

Figure 55:
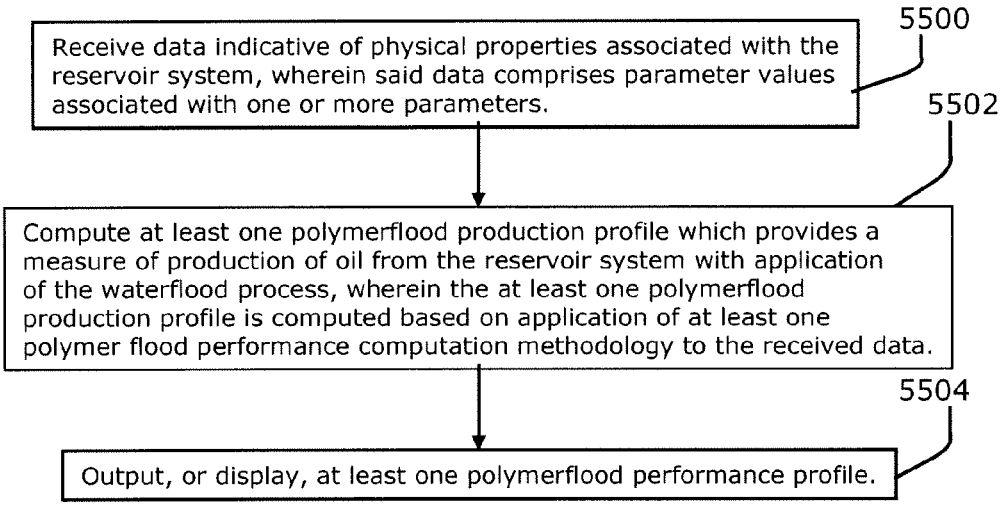

FIG. 55 illustrates a flow chart of a method of the polymer flood forecasting tool which may be computer-implemented.

5. DETAILED DESCRIPTION

The present disclosure relates to the integration of screening criteria and analytical procedures to develop a set of computerized tools which determine whether a reservoir is a candidate for application of an EOR process or a waterflood process (an IOR process) (collectively, EOR and IOR processes are referred to herein as recovery processes) and provide estimates of production from the reservoir with application of the recovery process, in the early stage of development of the reservoir (when little data is available on the reservoir).

Identification of candidate reservoirs for a waterflood or EOR process and evaluation of the performance of a reservoir with application of a waterflood or EOR process are desirable information to effectively support project feasibility and further planning and project execution processes. Simulation models in the art require information that may not be available at early stages of planning a reservoir project. For example, reservoir and fluids information required by methods in the art to build a reservoir simulation model and to obtain performance estimates usually is not available. Also, since reservoir simulation modeling in the art generally requires significant amounts of time and resources, which is usually not available in the early planning stages to develop the reservoir, a common approach is to evaluate candidates using properties from similar areas and make several technical assumptions to run the reservoir model. As a result, uncertainty and technical risk levels are high in the existing methods.

Computerized tools are disclosed herein which consolidate screening criteria and analytical methods to estimate waterflood performance. The tools provide for accurate screening and performance forecasting of waterflood and EOR candidates at early stages of planning of a reservoir project. Also, the tools incorporate published information and analytical and empirical performance estimation methods. These tools may be implemented using Visual Basic Applications or any other pertinent programming application in the art. As examples, the tools can include an EOR screening tool, a waterflood screening tool, and waterflood and polymer flood forecasting tools.

The EOR screening tool determines the most recommendable type of recovery process for a reservoir. Based on an output of the EOR screening tool, such as a ranking of recovery processes, a field engineer could make decisions early in the oil production project as to the type of recovery process to apply to a reservoir system (such as but not limited to a waterflood process, carbon dioxide flooding, or insitu combustion), and move appropriate equipment into place to perform the recommended recovery process on the reservoir. The waterflood screening tool determines the feasibility of a waterflood project in the reservoir and recommends an injection scheme for a field (i.e., pattern or peripheral). Based on the output of the waterflood screening tool, decisions could be made early in the oil production project as to whether to employ a waterflood process in the reservoir, which would affect the type of equipment put into place for applying a recommended oil recovery process. Also, a decision may be made to modify the placement of injector wells relative to a production well based on the injection scheme which is recommended by the waterflood screening tool for a waterflood process. With the EOR screening tool and the waterflood screening tool, technical parameters are evaluated and practical and theoretical recommendations are made available to a user for each case.

The waterflood and polymer flood forecasting tools predict the performance of these waterflood and polymer projects, respectively, in terms of oil and water production, cumulative fluids production, ultimate recovery factor, and volume of water injected in the reservoir. These tools use analytical and empirical procedures along with novel approaches. The tools also provide a comprehensive forecast of future project performance in a short time frame, giving sound support to the decision-making process of engineers in the field. In addition, a statistical correction factor (SCF), a novel indicator which was developed for use in the forecasting process, is provided with one or more of these tools to provide more realistic production profiles based on field statistics and real field responses. Based on the output of the waterflood forecasting tool or the polymer flood forecasting tools, decisions could be made early in the oil production project as to the waterflood process or the polymer flood process to be applied in the reservoir, which would affect, e.g., the type of equipment put into place for applying the waterflood or polymer flood process to the reservoir.

A collection of theoretical definitions may also be included with the disclosed tools to guide a user in the appropriate use of the tools for a given reservoir. A guideline may be provided for special cases, including for water quality, naturally fractured reservoirs, and heavy oil systems.

All methods, systems, and apparatuses, including the computer readable media, described herein in connection with a given screening or forecasting tool may be used with any of the other tools. In addition, all of the methods disclosed herein may include a step of outputting to a user interface device, a computer readable storage medium, a monitor, a local computer, or a computer that is part of a network; or displaying, the information obtained by application of one or more steps of the methods disclosed herein. Moreover, all of the apparatuses and computer systems disclosed herein may include instructions for outputting to a user interface device, a computer readable storage medium, a monitor, a local computer, or a computer that is part of a network; or displaying, the information obtained by application of one or more steps of the methods disclosed herein.

Disclosure herein with respect to an EOR process (or project) also is applicable to an IOR process (or project). In addition, all methods, systems, and apparatuses, including computer readable media, described herein in connection with an EOR process is also applicable to an IOR process (or project).

FIGS. 2-4, 6-14B, 16 to 28B, 30-36C, 38, 39, and 41A-47 illustrate examples of implementations of the various steps of the methods or components of the systems and apparatuses, including computer readable media, disclosed herein as one or more presentation screens. A user may interact with and otherwise use the methods, systems and apparatuses, including computer readable media, disclosed herein via these various presentation screens. It should be noted that the presentation screens shown here represent merely one possible implementation of the methods, systems and apparatuses, including computer readable media, disclosed herein. It will be readily apparent to one of ordinary skill in the art that numerous other implementations and designs may be used without departing from the scope or spirit of this disclosure.

5.1 Screening and Prediction Tools 5.1.1 EOR Screening Tool

Figure 1:
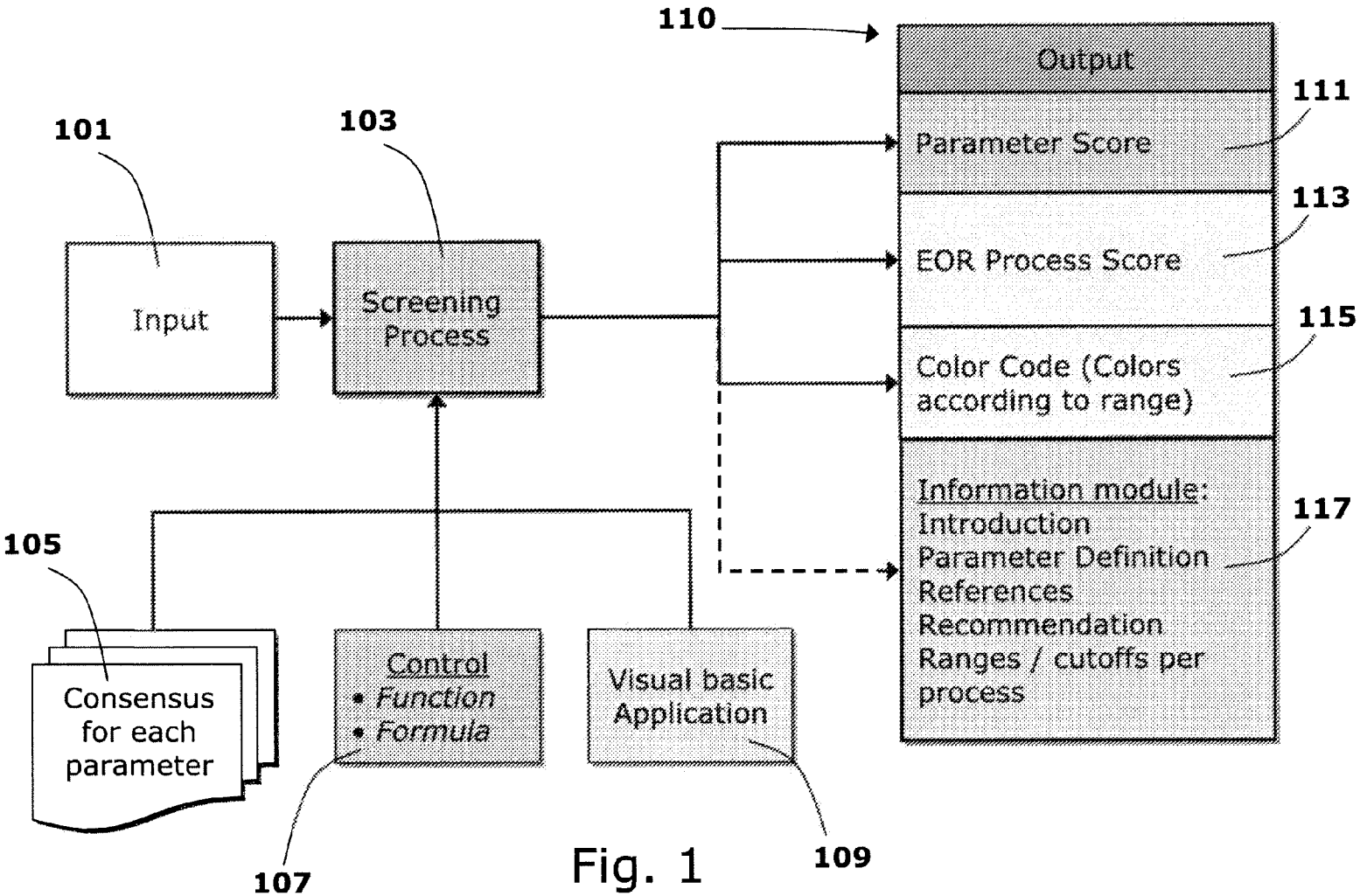
FIG. 1 illustrates a flow chart of a method for screening among recovery processes which may be computer-implemented.

FIG. 1 illustrates a flow chart of a computer-implemented method for evaluating the likelihood of success of one or more enhanced oil recovery (EOR) processes (or projects), or a waterflood process (or project), referred to herein as recovery processes, in providing enhanced recovery of oil from a reservoir system, using an EOR screening tool. FIG. 50 also illustrates a flow chart of a computer implemented method for screening among recovery processes. Data indicative of physical properties or chemical properties of materials in the reservoir is input through an EOR screening input module 101 into an EOR screening module 103 (see also step 5000 of FIG. 50). The EOR screening module 103 also receives information indicative of recovery process consensus values for each reservoir and fluid parameter from EOR consensus module 105. EOR control module 107 provides the functions and formulae corresponding to each of the recovery processes which are being screened. The methods for evaluating the likelihood of success of one or more recovery processes discussed herein may be implemented by way of a Visual Basic application 109. The screening module outputs information indicative of the results of the screening process, e.g., to a user. EOR screening module 103 may output to an EOR screening output module 110. The output generated by the screening module for a given recovery process may be at least one recovery process parameter score 111, which is a score for each parameter used in the calculation for determining the feasibility of application of the recovery process. The output may be at least one EOR process score 113, which is a score each of the screened recovery processes. The output may be presented with a color code 115, where a given color is used to indicate the range within which an output value falls. The system may further include one or more information modules 117. The information modules 117 may provide a Parameter Definition for the parameter used in the calculations for a given recovery process, a listing of the references which provide additional information, and/or a listing of the ranges or cutoffs for the parameters used in the calculations for each recovery process.

FIG. 2 shows a screen shot of an example input window 201 for EOR screening input module 101 of the EOR screening tool. EOR screening input window 201 provides an EOR screening input field 203 into which values for each input parameter may be entered. EOR screening input window 201 also indicates the type of data which may be required for the screening process, as well as other types of information which may be utilized. Examples of the type of data which may be input into the EOR screening tool include, but are not limited to, the type of recovery process currently in use in the reservoir system, the depth of the well, the oil gravity, the oil viscosity, the net thickness of the rock type, the current reservoir pressure, the minimum oil content, the mobile oil saturation at the start of the application of the recovery process, the oil saturation in water swept zones (i.e., the quantity of oil contained in the rock after the waterflooding process), the remaining oil saturation at the start of the application of the recovery process, the permeability and porosity of the rock, the temperature of the system, the transmissibility of the rock, and the water salinity. Examples of other types of input information which may be utilized include, but are not limited to, existing fractures, gas cap, dip angle, net to gross ratio, well spacing, receptivity, hydrocarbon (HC) composition, minimum miscibility pressure, pressure ratio, initial pressure, drive mechanism, gas saturation, bubble point pressure, critical gas saturation, gas ratio, Dykstra-Parsons coefficient, vertical sweep factor, hardness, water divalent ions, water multivalent ions, water iron content, and the water boron content. The EOR screening tool also may display examples of data typically input. One or more of the input parameters may be calculated using one or more of the other input parameters, e.g., through prompts on the EOR screening input window 201. For example, the minimum oil content, mobile oil saturation at the start of the application of the recovery process, the transmissibility, the minimum miscibility pressure, the initial pressure, and the Dykstra-Parsons coefficient may be calculated using one or more of the other input parameters through EOR screening input window 201. Coefficients in connection with the Buckley-Leverett, Craig-Geffen-Morse, Stiles, and/or Bush-Helander methodologies also may be computed.

EOR screening input window 201 lists a name for each input parameter, a type assigned to each input parameter, and the units of the input parameter. EOR screening input window 201 also may provide a definition for each input parameter. EOR screening input window 201 also illustrates a "Quick Help" option to provide the user with assistance with the input parameters and a "FAQ" option which provides responses to typical user inquiries.

In an example implementation of the EOR screening tool (illustrated in FIG. 50), the method comprises selecting a recovery process (see step 5002), comparing the one or more parameter values of the data received in step 5000 to consensus values of the respective parameter for the selected recovery process, assigning a recovery process parameter score to each parameter of the selected recovery process based on the comparing in step 5004, and computing a recovery process overall score for the selected recovery process based on the recovery process parameter scores assigned in step 5006. As illustrated in steps 5010 and 5012, these steps are repeated until each recovery process under consideration is evaluated. In step 5006 of FIG. 50, a recovery process overall score for each recovery process is generated based on the data corresponding to one or more physical properties of the reservoir system, which may be input into or calculated by the EOR screening tool. This recovery process overall score is computed based on the one or more recovery process parameter scores which are assigned to a recovery process by the EOR screening tool (see step 5006 of FIG. 50). As illustrated in step 5014 of FIG. 50, the method may further comprise comparing the recovery process overall score of each of the recovery processes to a predetermined recovery process success score, where the comparing provides an indication of a likelihood of success of the recovery process with respect to recovery of oil from the reservoir system. Examples of output of the EOR screening tool include one or more of the recovery process parameter scores, one or more of the recovery process overall scores, and/or an indication of the likelihood of success of at least one of the recovery processes which were evaluated (see step 5016 of FIG. 50).

Parameters which may be assigned a recovery process parameter score include, but are not limited to, one or more of the following: depth of the well, the rock type, the oil gravity, the oil viscosity, the net thickness of the rock type, the current reservoir pressure, the minimum oil content, the mobile oil saturation at the start of the application of the recovery process, the oil saturation in water swept zones (i.e., the quantity of oil contained in the rock after the waterflooding process), the remaining oil saturation at the start of the application of the recovery process, the permeability and porosity of the rock, the temperature of the system, the transmissibility of the rock formation, and the water salinity. Other parameters which may be assigned a recovery process parameter score include, but are not limited to, one or more of the following: the existing fracture system, gas cap, dip angle, net to gross ratio, well spacing, receptivity, hydrocarbon (HC) composition, minimum miscibility pressure, pressure ratio, initial pressure, drive mechanism, gas saturation, bubble point pressure, critical gas saturation, gas ratio, Dykstra-Parsons coefficient, vertical sweep factor, hardness, water divalent ions, water multivalent ions, water iron content, and the water boron content. The parameters may be geological (G), such as the depth of the well and the rock type, properties of hydrocarbons (HC), such as oil gravity and oil viscosity, reservoir properties (RP), such as net thickness and reservoir pressure, and water properties (WP), such as water salinity. Each parameter has a range of application for each recovery process, as discussed in Section 5.2 below.

The EOR screening tool assigns a recovery process parameter score to each recovery process for given each parameter. To provide the recovery process parameter score, the EOR screening tool compares the value input for a parameter to the recovery process consensus value for the parameter (which is provided by the EOR consensus module 105). The recovery process consensus value of a parameter can be a cutoff value or a range of cutoff values, and serves as a screening criterion to evaluate the applicability in the reservoir of the recovery process in question. For example, the recovery process consensus value may be a numerical value, or a range of numerical values, of a parameter. Table I provides examples of recovery process consensus values of a parameter (well depth), which may be provided by EOR consensus module 105 in connection with each of the indicated recovery processes.

TABLE I

| | Consensus Values for Well Depth (ft) | |
|---|---|---|
| Recovery Process | Recovery Process Favored | Recovery Process Less Favored |
| Waterflood | Design matter | Design matter |
| $CO_2$ Flood | ≧2000 | <2000 |
| Hydrocarbon Gas Injection | ≧2000 | <2000 |
| Nitrogen-Flue Gas Injection | ≧4500 | <4500 |
| Alkaline-Surfactant-Polymer | Design matter | Design matter |
| Polymer Flood | Design matter for temperature | Design matter for temperature |
| Steamflood | 300 to 5000 | <300 or >5000 |
| In-Situ Combustion | ≧500 | <500 |

Recovery processes are discussed in Section 5.2 below. In another example, the recovery process consensus value may screen for whether a specific condition is met for the applicability in the reservoir of the recovery process in question. For example, for the parameter of rock type, any one of the waterflood, $CO_2$, gas injection, nitrogen-flue gas, polymer, steamflood, and in-situ combustion processes is favored for application to a reservoir that comprises a rock type of either sandstone or carbonate, while the sandstone rock type is preferred for an alkaline-surfactant-polymer (ASP) process.

The EOR screening module 103 may assign a recovery process parameter score (S1) to a parameter if the data value input or calculated for the parameter meets the screening criterion of the recovery process consensus value for that parameter for the given recovery process (i.e., indicating that the recovery process is feasible), and assign a different recovery process parameter score (S2) if the screening criterion is not met (i.e., indicating that the recovery process is less favored). In one example, S1 may be "0" while S2 is "1". In other examples S1>S2 or S1<S2. The screening criterion of the recovery process consensus value may indicate when application of a specific recovery process in a reservoir may produce advantageous results, or indicate that the recovery process is unlikely to succeed. For example, if the oil in a reservoir has a high viscosity (e.g., if the oil viscosity is above 400 cP), a recovery process parameter score S1 may be assigned to each recovery process which is not recommendable for oil with such a high viscosity, and a recovery process parameter score S2 is assigned to all other recovery processes (with the recovery process consensus value for viscosity being set at 400 cP). Recovery process consensus values can be determined, e.g., using published literature containing data on reservoirs.

The EOR screening tool computes a recovery process overall score for a given recovery process based on the recovery process parameter scores which were assigned to each of the parameters. In one example, the recovery process overall score for a recovery process may be an arithmetic sum of each of the recovery process parameter scores assigned to the recovery process. In another example, the recovery process overall score for a recovery process may be a weighted sum of each of the recovery process parameter scores. In another example, the recovery process overall score is an arithmetic mean or a geometric mean. The feasibility of a given recovery process may be determined based on the value of its recovery process overall score. In one example, the one or more recovery processes which accumulate the highest recovery process overall score are designated as feasible or recommendable. In another example, the one or more recovery processes which accumulate the lowest recovery process overall score are designated as feasible or recommendable. In this second example, the recovery process overall score may be considered an unlikelihood score, as the highest value indicates the one or more recovery processes which are least likely to succeed.

FIG. 3 shows screen shot of an example EOR screening output window 301 for providing output from the screening process, such as from EOR screening output module 110. EOR screening output window 301 lists a name for each output parameter, a type assigned to each output parameter, and the units of the output parameter. EOR screening output window 301 also provides an EOR screening output field 303 in which values for each output parameter are entered. EOR screening output window 301 also may provide a definition for each output parameter. EOR screening output window 301 illustrates the type of output which may be displayed, such as recovery process parameter scores 111, recovery process overall scores 113 for each of the recovery processes which is evaluated in the screening process. Recovery processes whose applicability to a reservoir may be evaluated include, but are not limited to, waterflooding, carbon dioxide ($CO_2$) injection, hydrocarbon gas injection, nitrogen-flue gas, surfactant polymer, and alkaline-surfactant-polymer injection, polymer injection, steamflooding and in-situ combustion (recovery processes are discussed in Section 5.2 below). EOR screening output window 301 may also provide a refresh option, for example, to reset the input values, and a help option.

The windows of FIGS. 3 and 4 show parameters for example reservoirs. Each parameter in FIG. 3 is assigned a recovery process parameter score 111 based on the value of each input or calculated parameter for each recovery process.

In the example of FIG. 3, a recovery process parameter score of "0" indicates that the recovery process is favorable, while a recovery process parameter score of "1" indicates that the recovery process may be less likely to succeed in the reservoir. For example, a recovery process can be deemed likely to succeed if it results in recovery of about an additional 5%, about an additional 10%, about an additional 12%, about an additional 15%, about an additional 20%, about an additional 25%, about an additional 30%, or more, of original-oil-in-place over the primary recovery process which was applied to the reservoir. The parameter score of "1" can indicate that the recovery process is less likely to succeed, such as by resulting in very low oil recovery or no oil recovery. For example, a recovery process can be deemed less likely to succeed if it results in recovery of less than about 2% of original-oil-in-place over the primary recovery process which was applied to the reservoir.

In FIG. 3, the input parameter of reservoir well depth has a value of 2,000 ft, which is indicated as a design matter for the waterflood, alkaline-surfactant polymer, and polymer EOR processes (no recovery process parameter score assigned); the $CO_2$, hydrocarbon gas injection, steamflood and in-situ combustion processes are favorable for such a reservoir well depth (the recovery process parameter score is 0), while the nitrogen and flue gas EOR process is less favorable (the recovery process parameter score is 1). These recovery process parameter scores would be obtained if the recovery processes were evaluated for application to a reservoir of well depth of 2,000 ft using the recovery process consensus values contained in Table I. FIG. 4 illustrates the effect of a change in reservoir well depth on the recovery process parameter score and the recovery process overall score. In the example of FIG. 4, the reservoir well depth has a value of only 200 ft, which is indicated as a design matter for the waterflood, alkaline-surfactant polymer, and polymer processes (no recovery process parameter score assigned); however, as a result, the other EOR processes are less favorable (the recovery process parameter score is 1). These recovery process parameter scores would be obtained if the recovery processes were evaluated for application to a reservoir of well depth of 200 ft using the recovery process consensus values contained in Table I. All recovery processes are favorable for the rock type of "sandstone" (the recovery process parameter score is 0), which is consistent with the example recovery process consensus values for the parameter of rock type discussed above (where any one of the waterflood, $CO_2$, gas injection, nitrogen-flue gas, polymer, steamflood, and in-situ combustion processes is favored for application to a reservoir that comprises a rock type of either sandstone or carbonate, while the sandstone rock type is preferred for an alkaline-surfactant-polymer (ASP) process).

For an (API) oil gravity of 10° and an oil viscosity of 345 centipoise (cP) (1 cP=0.01 g $cm^{-1}s^{-1}$), the steamflood and in-situ combustion processes are favorable (recovery process parameter score of 0), while the other recovery processes in FIG. 3 are less favorable (the recovery process parameter score is 1). The (API) oil gravity of 10° means that the oil has a density similar to water (i.e., if a petroleum liquid's API gravity is greater than 10, then it is lighter than water and floats on it; if the API gravity is less than 10, then the oil is heavier than water and sinks). Water at 20° C. has a viscosity of 1.0020 cP. The net thickness of the rock type of 33 ft are considerations for only the alkaline-surfactant polymer, steamflood and in-situ combustion processes (recovery process parameter score of 0). The current reservoir pressure of 450 psi is a consideration for only the steamflood process (recovery process parameter score of 0). The minimum oil content of 1,385 barrels per acre-ft (bbl/acre-ft) is a consideration for only the steamflood and in-situ combustion processes (recovery process parameter score of 0). The remaining oil saturation at the start of the application of the recovery process of 51% is applicable to most of the recovery processes in FIG. 3 (recovery process parameter score of 0), i.e., except for the steamflood and in-situ combustion processes. For a permeability is 1,550 millidarcies (mD), the waterflood, alkaline-surfactant polymer, polymer, and in-situ combustion processes are favorable (recovery process parameter score of 0). For a temperature of 192 Fahrenheit, the $CO_2$, alkaline-surfactant polymer, and polymer processes are favorable (recovery process parameter score of 0). The water salinity of 1,200 ppm (total dissolved salts (TDS)) in this example is applicable to only the alkaline-surfactant polymer process.

The output of the EOR screening tool may be displayed according to a color code 115. That is, a value of a score may be associated with a given color. In the example EOR screening output window 301 of FIG. 3, the highest score of "3" may be displayed to a user with a red coding, the lowest score of "0" may be displayed to a user with a green coding, and the intermediate scores of "1" and "2" may be displayed to a user with a yellow coding. In other examples, different colors may be assigned to the intermediate score values; for example, the intermediate score of "1" may be displayed to a user with a yellow coding, while the intermediate score of "2" may be indicated by a different color (such as displayed to a user with an orange coding). Each recovery process parameter score 111 and each recovery process overall score 113 may be displayed using a color which depends on its value. For example, in FIG. 3, each recovery process recovery process parameter score 111 or recovery process overall score 113 of "0" may be displayed to a user with a green coding, each recovery process parameter score 111 and recovery process overall score of "1" or "2" may be displayed to a user with a yellow coding, while a recovery process parameter score 111 or recovery process overall score of "3" may be displayed to a user with a red coding. For example, the recovery process (es) which received the highest recovery process overall score 113 may be indicated in EOR screening output window 301 with a given color, and the recovery processes which received the lowest recovery process overall score 113 may be indicated to a user with a different color. The recovery processes which were assigned scores intermediate between the highest and lowest scores may be indicated with one or more colors other colors which differ from those assigned to the highest and lowest scores. In some examples, the color coding may be assigned to each score value according to a level of warning, for example, to indicate the degree of success to be expected from each recovery process, from least likely to most likely. The recovery process that accumulates the highest recovery process overall score (the nitrogen and flue gas EOR process) can be flagged to a user with a red color code as a warning to indicate that the recovery process is less likely to succeed, and thus is not expected to be feasible in the reservoir. In the example of FIG. 3, the recovery process overall score 113 for each recovery process is an arithmetic sum of the recovery process parameter scores 111 assigned to each parameter used for screening the recovery processes. In other examples, the recovery process overall score 113 may be computed from the recovery process parameter scores 111 using different methods, such as but not limited to a weighted sum of the recovery process parameter scores, a geometric mean, an arithmetic mean, or an arithmetic sum.

For example, a recovery process can be deemed likely to succeed if it results in recovery of about an additional 5%, about an additional 10%, about an additional 12%, about an additional 15%, about an additional 20%, about an additional 25%, about an additional 30%, or more, of original-oil-in-place over the primary recovery process which was applied to the reservoir. The parameter score of "1" can indicate that the recovery process is less likely to succeed, such as by resulting in very low oil recovery or no oil recovery. For example, a recovery process can be deemed less likely to succeed if it results in recovery of less than about 2% of original-oil-in-place over the primary recovery process which was applied to the reservoir.

FIGS. 3 and 4 illustrate the effect of differing values of reservoir well depth on the recovery process overall score 113. While only the nitrogen and flue gas process is indicated as unfeasible in the example of FIG. 3 (recovery process overall score of 3 and displayed to a user with a red coding), all three of the $CO_2$, hydrocarbon gas injection, and nitrogen and flue gas recovery processes are indicated as unfeasible in the example of FIG. 4 (recovery process overall score of 3 and displayed to a user with a red coding).

The recovery process overall score can be compared to a predetermined recovery process success score to provide an indication of the likelihood of success of the recovery process with respect to recovery of oil from the reservoir system. For example, recovery process can be deemed likely to succeed respect to recovery of oil from the reservoir system if the recovery process overall score is less than the predetermined recovery process success score, or can be deemed unlikely to succeed respect to recovery of oil from the reservoir system if the recovery process overall score is greater than the predetermined recovery process success score. The predetermined WF process success score can be determined based on publicly available information, such as data available in published literature. For example, the predetermined recovery process success score can be set as the value of the recovery process overall score (for a given recovery process) computed using publicly available data from a reservoir in which the respective recovery process was successful. In another example, the predetermined recovery process success score can be set at about 90%, about 80%, about 70%, about 60%, about 50%, about 45%, about 40%, about 35%, about 30%, about 25%, about 20%, about 15%, or about 10% of the highest possible recovery process overall score that can be computed for the recovery processes.

5.1.2 Waterflood Screening Tool

FIG. 5 illustrates a flow chart of a computer-implemented method for waterflood screening, which may be implemented by a waterflood screening tool. Data indicative of physical properties of materials in the reservoir is input through a waterflood screening input module 501 into a WF screening module 503. The WF screening module 503 also receives information indicative of a waterflood (WF) consensus value for each parameter from waterflood screening consensus module 505. WF screening control module 507 provides the function and formula applicable to a waterflood process. The methods for waterflood screening may be implemented by way of a Visual Basic application 509. The screening module outputs, e.g., to a user, information indicative of the results of the screening process. WF screening module 503 may output to a WF screening output module 510 which comprises one or more output modules, such as WF screening output modules 511, 513 and 515. For example, WF screening output module 511 may be used to indicate whether employing a WF recovery process in the reservoir is feasible or is unlikely to succeed, and WF screening output module 513 may be used to indicate the recommended injection scheme for the WF recovery process, whether a peripheral injection scheme or a pattern injection scheme. The arrangement of injector wells differs in peripheral and pattern injection schemes. In a peripheral injection scheme, injector wells may be located in the flanks (sides) of the reservoir systems, i.e., the injector wells can be far from the producer wells. In a pattern injection scheme, injector wells may be arranged closer to the producer wells, in a specific pattern. The choice of injection scheme depends on several characteristics of the rock and the fluids. In another example, WF screening output module 515 may be used to provide case studies of the waterflooding process in a system, such as examples of previously performed screening evaluations. The system may further include one or more WF screening information modules 517. WF screening information modules 517 may provide, e.g., a Parameter Definition for the parameter used in the calculations for the WF process or a listing of the references which provide additional information.

Preferably, the input parameters used in the calculations in connection with WF screening tool can be grouped according to reservoir and fluids properties. The input parameters used in calculations in connection with WF process feasibility (discussed in Section 5.1.2.1 below) can be divided into categories, such as categories of primary WF variable, secondary WF variable, tertiary WF variable (if used), and general WF variable (if used), based on the input parameter's potential impact on the output of WF screening module 503 to WF screening output module 511. In some examples, a user guide including theoretical and practical explanations of the WF screening may be provided. Input parameters used in calculations in connection with injection scheme recommendation (discussed in Section 5.1.2.2 below) can be divided into other categories, such as categories of primary injection scheme variable, secondary injection scheme variable, tertiary injection scheme variable (if used), quaternary injection scheme variable (if used), and general WF variable (if used), based on the input parameter's potential impact on the output of WF screening module 503 to WF screening output module 513.

FIG. 6 shows a screen shot of an example input window 601 for WF screening input module 101. WF screening input window 601 provides a WF screening input field 603 into which values for each input parameter may be entered. One or more of the input parameters may be calculated using one or more of the other input parameters through WF screening input window 601, for example, the mobility ratio, transmissibility, fraction of current to initial GOR, the Dykstra-Parsons coefficient, and the mobile oil saturation at the start of the WF process.

WF screening input window 601 may list a name for each input parameter, a type assigned to each input parameter, and the units of the input parameter. WF screening input window 601 also may provide a definition for each input parameter. The screening input window 601 may provide a user with the option of saving the input data, and also may provide examples of previously screened cases WF screening input window 601 also illustrates a "Help" option to provide the user with assistance with the input parameters and a "FAQ" option which provides responses to user inquiries.

WF screening input window 601 also may indicate the type of data which could be required for the screening process, as well as other types of information which may be utilized. Examples of input data which may be required include, but are not limited to, the type of reservoir aquifer (i.e., the type of water drive mechanism), the mobility ratio, the average permeability, the transmissibility, the remaining oil saturation at start of the WF process, the oil relative permeability curve "end-point" (Kroe) and is the relative permeability curve "end point" (Krwe), the type of fracture reservoir (e.g., the reservoir may have natural fractures which will affect the production behavior, or may have no natural fractures), the porosity of the rock in the reservoir, the current GOR, the initial GOR, the fraction of the current to initial GOR, the current producing GOR (the ratio of gas produced to oil produced, both at surface conditions, which may be expressed in units of cubic feet of gas per barrels of oil).

5.1.2.1 WF Process Feasibility

For the purposes of determining the likelihood of success of a waterflood (WF) process in providing improved recovery of oil from a reservoir system, one or more of the input parameters may be designated as a primary WF variable, as a secondary WF variable, as a tertiary WF variable, or as a general WF variable. A primary WF variable may affect the displacement and oil recovery directly. A secondary WF variable may affect the storage/HC volume (which are the variables that may affect the quantity of hydrocarbon volume in the reservoir) and the gas content. A tertiary WF variable or a general WF variable may affect, e.g., the economics of the WF project. The primary WF variables, secondary WF variables, tertiary WF variables, and general WF variables, may be identified from information gathered from any publicly available source. Information may be gathered from tools for evaluating a waterflood process described in published literature (e.g., Thakur, G. C. and Satter, A.: Integrated Waterflood Asset Management, Diaz, D., et al., 1996, Society of Petroleum Engineers (SPE) #35431), from other articles published by the SPE, Journal of Petroleum Technology (JPT), or from other public databases. The types of input parameters for the WF screening tool, and the ranges of WF consensus values that these input parameters which indicate that the WF process is likely to succeed or unlikely to succeed, may be determined from such published records. In the example shown in FIG. 43, the following variables can be categorized as primary WF variables: drive mechanism (type of aquifer), the mobility ratio, the average permeability, the transmissibility, the remaining oil saturation at start of the WF process, the Kro and Krw, the oil viscosity, the oil gravity, and the water viscosity. As shown in FIG. 43, the following variables can be categorized as secondary WF variables: net thickness, type of reservoir (such as whether it is a fractured reservoir), porosity, the current GOR, the initial GOR, and the fraction of the current to initial GOR. Examples of other variables for which input may be received include, but are not limited to, location, rock type, depth, structure of dip angle, net to gross ratio, Dykstra-Parsons coefficient, receptivity, residual oil saturation, mobile oil saturation, well spacing, temperature, initial pressure, current reservoir pressure, bubble point pressure, tarmat presence, and water salinity. One or more of these other variables can be categorized as a tertiary WF variable or as a general WF variable.

In an example implementation of the waterflood screening tool (illustrated in FIG. 51), the method comprises receiving data indicative of physical properties associated with the reservoir system, where the data comprises parameter values associated with one or more primary waterflood (WF) variables and parameter values associated with one or more secondary WF variables (step 5100), comparing each of the received parameter value to one or more WF consensus values corresponding to the respective parameter (step 5102), assigning a primary WF point to a primary WF variable if the parameter value of the primary WF variable falls within a favorable range of the respective WF consensus values based on the comparing in step 5102 (step 5104), assigning a secondary WF point to a secondary WF variable if the parameter value of the secondary WF variable falls within a favorable range of the respective WF consensus values based on the comparing in step 5102 (step 5106), and computing a WF screening score based on the primary WF points and the secondary WF points assigned in steps 5104 and 5106, where the WF screening score indicates a likelihood of success of said WF process with respect to recovery of oil from the reservoir system (step 5108). If tertiary WF variables are used in the evaluation, then tertiary WF points would be assigned (in a step similar to step 5104 or 5106), and included in the computation of step 5108. Also, if general WF variables are used in the evaluation, then general WF points would be assigned (in a step similar to step 5104 or 5106), and included in the computation of step 5108. As illustrated in FIG. 52, the method may further comprise a step of comparing the WF screening score to a predetermined WF process success score, where the WF process is deemed likely to succeed with respect to recovery of oil from the reservoir system if the WF screening score is greater than the predetermined WF process success score, or is deemed unlikely to succeed with respect to recovery of oil from the reservoir system if the WF screening score is less than the predetermined WF process success score. Examples of output of the waterflood screening tool include the WF screening score and/or an indication of the likelihood of success of the WF process (see step 5112 of FIG. 51).

The WF consensus value of each parameter, which may be stored, for example, in waterflood screening consensus module 505, may be determined based on publicly available information, e.g., published literature. Ranges of WF consensus values for a parameter can be established using a statistical approach based on publicly available information. A range of WF consensus values of the parameter can indicate that the WF process may result in low oil recovery, or failure of the WF process, such as by indicating the ranges of values of the parameter that result in recovery of less than about an additional 2% of original-oil-in-place over the primary recovery process which was applied to the reservoir. A range of WF consensus values of the parameter can indicate that the WF process may result in a likelihood of success of the WF process, such as by indicating the ranges of values of the parameter that result in recovery of about an additional 5%, about an additional 10%, about an additional 12%, about an additional 15%, about an additional 20%, about an additional 25%, about an additional 30%, or more, of original-oil-in-place over the primary recovery process which was applied to the reservoir.

A score can be assigned to each parameter based on its effect on the feasibility study. That is, a primary WF point can be assigned to each primary WF variable, a secondary WF point may be assigned to each secondary WF variable, and a tertiary WF point may be assigned to each tertiary WF variable, if the value of the primary WF variable, secondary WF variable, or tertiary WF variable, respectively, falls within a range of WF consensus values of the respective parameter which indicates that the WF process is likely to succeed with respect to recovery of oil from the reservoir. For example, the primary WF point may be of a higher value than the secondary WF point, which the secondary WF point may be of a higher value than a tertiary WF point. In one example of a scoring method, two (2) points are assigned to a primary WF variable if its value falls within the range of WF consensus values for a primary WF variable which indicates a likelihood of success of the WF process, and one (1) point is assigned to each secondary WF variable whose value falls within the range of WF consensus values for that variable which indicates a likelihood of success of the WF process. That is, in this example, the primary point is 2, and the secondary point is 1. In another example of a scoring method, five (5) points are assigned to a primary WF variable, three (3) points are assigned to a secondary WF variable, and two (2) points are assigned to a tertiary WF variable, if the value of the primary WF variable, secondary WF variable, or tertiary WF variable, respectively, falls within a range of WF consensus values which indicates a likelihood of success of the WF process. In this example, the primary point is 5, the secondary point is 3, and the tertiary point is 2. In yet another example of a scoring method, ten (10) points are assigned to a primary WF variable, five (5) points are assigned to a secondary WF variable, and two (2) points are assigned to a tertiary WF variable, if the value of the primary WF variable, secondary WF variable, or tertiary WF variable, respectively, falls within a range of WF consensus values which indicates a likelihood of success of the WF process. In some examples, no points are assigned to a primary WF variable, a secondary WF variable, or a tertiary WF variable, if the value of the respective parameter does not fall within the range of the WF consensus values for that parameter which indicates a likelihood of success of the WF process. Preferably, general WF variables are not assigned a score.

A WF screening score is computed based on the primary WF points, secondary WF points; and tertiary WF points (if used). In an example, the WF screening score is computed based on an arithmetic sum of the points assigned to the primary WF variables and the secondary WF variables of a waterflood process. In another example, the recovery process overall score for a recovery process is computed based on an arithmetic sum of the primary WF points, secondary WF points, and tertiary WF points (if used). In yet another example, the recovery process overall score for a recovery process is computed based on a weighted sum of each of the recovery process parameter scores. In other examples, the recovery process overall score is an arithmetic mean or a geometric mean. The WF screening score indicates a likelihood of success of said WF process with respect to recovery of oil from the reservoir system. In one example, a higher value of WF screening score indicates an increased likelihood of success of enhanced oil recovery with application of the waterflooding project to the reservoir system. In the foregoing examples, the WF screening tool can indicate to a user that the waterflood project is feasible if the WF screening score is above a predetermined WF process success score.

The WF screening score can be compared to a predetermined WF process success score to provide an indication of the likelihood of success of the WF process with respect to recovery of oil from the reservoir system. For example, the WF process can be deemed likely to succeed respect to recovery of oil from the reservoir system if the WF screening score is above the predetermined WF process success score, or can be deemed unlikely to succeed with respect to recovery of oil from the reservoir system if the WF screening score is below the predetermined WF process success score. The predetermined WF process success score can be determined based on publicly available information, such as data available in published literature. For example, the predetermined WF process success score can be set as the value of the WF screening score computed using publicly available data from a reservoir in which a WF project was successful. In another example, the predetermined WF process success score can be set as about 30%, about 40%, about 50%, about 55%, about 60%, about 65%, about 70%, about 75%, about 80%, about 85%, about 90%, or more, of the highest possible WF screening score that can be computed based on the primary WF points, the secondary WF points, and the tertiary WF points (if used) assigned to the respective variables.

In the example of FIGS. 6 and 7, an output of the WF screening output module 511 is displayed in the upper right corner of input window 601. As shown in FIGS. 6 and 7, the WF screening computation indicates that the waterflooding project is considered unlikely to succeed based on the values of input parameters for the example reservoir and on the number of parameters which are outside of the range of values of the respective WF consensus value. In addition, as an output from WF screening output module 511, the input parameters may be color coded, based upon which a conclusion concerning the feasibility or unlikelihood of success of the WF project may be reached. For example, in FIGS. 6 and 7, the mobility ratio and the transmissibility may be displayed to a user with a red coding, and the average permeability and oil gravity may be displayed to a user with a yellow coding as an indication of their role in the evaluation of the WF screening. A color code of red (for example, if FIGS. 6 and 7 are displayed to a user with a red coding) may alert the user that the value of the variable is outside of a range where a waterflooding project would be feasible for the reservoir system. A color code of yellow could be displayed to the user to indicate that the value of the variable is nearly outside of the range where a waterflooding project would be feasible. A value of 12 may be designated as a high limit of the mobility ratio (WF consensus value), which information may be ascertained from the performance of a waterflood project in an oil field with a high mobility ratio. As shown in FIG. 7, an input parameter value of 12.1 for the mobility ratio is higher than the set high limit. In the example of FIG. 7, the transmissibility and oil gravity are also outside of the range of values of their respective WF consensus values for which the WF process is considered likely to succeed, as a result of the cumulative effect of the transmissibility, the oil gravity, and the mobility ratio being outside of their consensus ranges, the WF screening score was below a predetermined WF process success score. Thus, the display in FIG. 7 shows that the WF project is considered unlikely to succeed. The display also may provide additional information, e.g., the example display shown in FIG. 7 indicates that the high limit does not mean that waterflooding would be unsuccessful, but that optimum results may not be achieved in terms of recovery factor and amount of water produced. The range of preferred values (WF consensus values) for a given parameter may be displayed as an advisory, such as the illustration of a mobility ratio advisory displayed in FIG. 7. FIGS. 8 and 9 show results of the waterflood screening evaluation for a reservoir system in which the mobility ratio has a lower value. The mobility ratio of 11.8 in the example of FIGS. 8 and 9 is not color coded since it falls below the high limit of 12 (WF consensus value). In the example of FIGS. 8 and 9, the WF screening computation indicates that the waterflooding project is considered feasible based on the input parameters for the example reservoir. In FIGS. 8 and 9, the transmissibility may be displayed to a user with a red coding to indicate that its value is outside of the range where a waterflooding project is considered feasible, and the average permeability and oil gravity are displayed to a user with a yellow coding as an indication that their value is nearly outside of the range where a waterflooding project is considered feasible.

5.1.2.2 Injection Scheme Recommendation

The WF screening tool also provides for evaluating a pattern injection scheme or peripheral injection scheme for application of a waterflood project to a reservoir system. FIGS. 10 to 12 show screen shots of an example output window 602 for WF screening output module 513 which provides a recommended injection scheme, whether peripheral or pattern. In FIG. 10, the peripheral injection scheme is recommended as most likely to be applied. In FIGS. 11 and 12, the pattern injection scheme is recommended as most likely to be applied.

As illustrated in FIG. 52, the method comprises a step of receiving data indicative of physical properties associated with the reservoir system, where the data comprises parameter values associated with one or more primary injection scheme variables and parameter values associated with one or more secondary injection scheme variables. The input parameters which may be required for evaluating the WF injection scheme include, but are not limited to, one or more of reservoir continuity, main recovery mechanism (such as main water drive, dissolved gas, and gravity segregation), main objective of the water injection pressure (such as pressure maintenance and hydrocarbon (HC) displacement), rock type and permeability, Dykstra-Parsons coefficient, the injection to production (I/P) ratio, the mobility ratio, the transmissibility, the structure dip. Other input information includes, but is not limited to, the reservoir location, the time of application, the depth and costs associated with the reservoir, the reservoir pressure, and the water volume requirements. Waterflood screening input module 501 of the WF screening tool receives input data indicative of the properties of the reservoir for each of the input parameters.

The WF screening tool evaluates a pattern injection scheme or peripheral injection scheme for application of a waterflood project to a reservoir system by comparing the input values for the parameters to the injection scheme consensus value that corresponds to the respective parameter (see step 5202 of FIG. 52). The injection scheme consensus value of a parameter is the value, or range of values, of the parameter in reservoirs in which the injection scheme was successfully applied. The injection scheme consensus value can be determined using publicly available data from reservoirs in which the injection scheme was successfully applied. Based on the results of the comparison, the WF screening tool determines a recommended injection scheme to be applied to a reservoir for enhanced recovery of oil from the reservoir. In one example, illustrated in steps 5204 and 5206 of FIG. 52, the recommended injection scheme is determined to be a pattern injection scheme if a majority of the parameter values (such as but not limited to the parameters listed in FIG. 10) falls within Range R1 of values of their respective consensus values in which a pattern injection scheme is feasible (which can be determined, e.g., from published references). In another example, illustrated in steps 5208 and 5210 of FIG. 52, the recommended injection scheme is determined to be a peripheral injection scheme if a majority of the parameter values (such as but not limited to the parameters listed in FIG. 10) falls within Range R2 of values of their respective WF consensus values in which a pattern injection scheme is feasible. As illustrated in step 5212 of FIG. 52, an indication of the recommended injection scheme may be output. In general, Range R1 is different from Range R2. In one specific example, the recommended injection scheme can be determined to be a pattern injection scheme if the reservoir is not a continuous formation, i.e., some permeability barriers or faults are present. In another example, the recommended injection scheme can be determined to be a pattern injection scheme if the structure dip angle less than 5°.

In the example of FIG. 10, the values of a majority of the input parameters for the reservoir fall within Range R1, where Range R1 is the range of injection scheme consensus values for input parameters which favors a peripheral injection scheme. Range R2 is the range of injection scheme consensus values for the respective input parameters which favors a pattern injection scheme. The range of injection scheme consensus values in Range R1 and Range R2 for the indicated input parameters can be determined using publicly available data from reservoirs in which the injection scheme in question was successfully applied. Table II provides examples of ranges of injection scheme consensus values for the indicated parameters.

TABLE II

| Parameter | Unit(s) | Effects of parameter on the WF project | Injection Scheme Consensus Values |
|---|---|---|---|
| Reservoir Continuity | N/A | Lack of continuity may cause oil to be bypassed (sweep efficiency is affected). | If continuous, peripheral; If permeability barriers or faults, pattern |
| Structure Dip Angle | degrees | Relates gravity effects, rates and sweep efficiency. | Angle ≧5, peripheral; Angle <5, pattern. |

In FIGS. 11 and 12, the WF screening output module 513 displays an output in output window 602 indicating that a peripheral injection scheme may be the most likely WF injection scheme to be applied. Factors which may favor a peripheral injection scheme include continuous formations, i.e., few or no permeability barriers (reservoir continuity) and a structure dip angle greater than or equal to 5° (see FIG. 10). The WF screening output module 513 displays an output indicating that a peripheral injection scheme may be the more favorable WF injection scheme to be applied, and a pattern injection scheme may be less favorable. Furthermore, since the WF screening output module 513 displays an output of the recommended injection scheme on a sliding scale, the output of FIG. 10 where the indicator lies in between the pattern and peripheral injection schemes also could be used to indicate that, while a peripheral injection scheme may be the more favorable WF injection scheme to be applied, a pattern injection scheme may still be viable. In the example of FIGS. 11 and 12, the values of a majority of the input parameters for the reservoir fall within Range R2. Factors which may favor a pattern injection scheme include, but are not limited to, little continuous reservoir formations (such as due to the presence of permeability barriers or faults) and a structure dip angle less than 5° (see FIGS. 11 and 12). The WF screening output module 513 displays an output indicating that a pattern injection scheme may be the more favorable WF injection scheme to be applied.

The WF screening tool also provides for evaluating a pattern injection scheme or peripheral injection scheme for application of a waterflood project to a reservoir system by computing an injection scheme score from primary injection scheme points assigned to primary injection scheme variables, secondary injection scheme points assigned to secondary injection scheme variables, tertiary injection scheme points assigned to tertiary injection scheme variables (if used), and quaternary injection scheme points assigned to quaternary injection scheme variables (if used). In one example, the primary injection scheme variables are reservoir continuity, main recovery mechanism, and main objective of the water injection pressure, and the secondary injection scheme variables are rock type and permeability, Dykstra-Parsons coefficient, the injection to production (I/P) ratio, and the mobility ratio. In another example, the primary injection scheme variable is reservoir continuity; the secondary injection scheme variables are main recovery mechanism and main objective of the water injection pressure; the tertiary injection scheme variables are rock type and permeability, Dykstra-Parsons coefficient, the injection to production (I/P)

ratio, and the mobility ratio; and quaternary injection scheme variables are the transmissibility and the structure dip. Examples of general injection scheme variables include, but is not limited to, the reservoir location, the time of application, the depth and costs associated with the reservoir, the reservoir pressure, and the water volume requirements. In the example illustrated in FIG. 53, the method comprises comparing each of the parameter values received in step 5300 to one or more injection scheme consensus values corresponding to the respective parameter (step 5302), assigning a primary injection scheme point to a primary injection scheme variable if the parameter value of the primary injection scheme variable falls within a favorable range of the respective injection scheme consensus values based on the comparing in step 5302, assigning a secondary injection scheme point to a secondary injection scheme variable if the parameter value of the secondary injection scheme
variable falls within a favorable range of the respective injection scheme consensus values based on the comparing in step 5302, and computing an injection scheme score based on the primary
injection scheme points and the secondary injection scheme points assigned in steps 5304 and 5306. If tertiary injection scheme variables are used in the evaluation, then tertiary injection scheme points would be assigned (in a step similar to step 5304 or 5306), and included in the computation of step 5308. Also, if quaternary injection scheme variables are used in the evaluation, then quaternary injection scheme points would be assigned (in a step similar to step 5304 or 5306), and included in the computation of step 5308. The method may further comprise comparing the injection scheme score to a predetermined injection scheme viability score and the recommended injection scheme to be a pattern injection scheme if the injection scheme score is above the predetermined injection scheme viability score, or a peripheral injection scheme if the injection scheme score is below the predetermined injection scheme viability score. An indication of the recommended injection scheme may be output in step 5314.

The input value for each parameter is compared to the injection scheme consensus value for that parameter, and a primary injection scheme point, secondary injection scheme point, tertiary injection scheme point (if used), or a quaternary injection scheme point (if used), is assigned to the respective primary injection scheme variable, secondary injection scheme variable, or tertiary injection scheme variable, respectively, falls within a range of injection scheme consensus values of the respective parameter which indicates that the injection scheme in question is likely to succeed with respect to recovery of oil from the reservoir. That is, in one example, a point system can be established for the range of injection scheme consensus values associated with successful application of a pattern injection scheme. In another example, a point system can be established for the range of injection scheme consensus values associated with successful application of a peripheral injection scheme. The primary injection scheme point may be of a higher value than the secondary injection scheme point, which secondary injection scheme point may be of a higher value than a tertiary injection scheme point, which tertiary injection scheme point may be of a higher value than a quaternary injection scheme point. In one example of a scoring method, ten (10) points are assigned to a primary injection scheme variable, five (5) points are assigned to a secondary injection scheme variable, and two (2) points are assigned to a tertiary injection scheme variable, if the value of the primary injection scheme variable, secondary injection scheme variable, or tertiary injection scheme variable, respectively, falls within a range of injection scheme consensus values which indicates a likelihood of success of the injection scheme in question. In this example, the primary point is 10, the secondary point is 5, and the tertiary point is 3. In the foregoing example scoring method, two (2) points are assigned to a quaternary injection scheme variable (if used), if the value of that quaternary injection scheme variable falls within a range of injection scheme consensus values which indicates a likelihood of success of the injection scheme (i.e., the quaternary injection scheme point is 2). In another example of a scoring method, five (5) points are assigned to a primary injection scheme variable, three (3) points are assigned to a secondary injection scheme variable, and two (2) points are assigned to a tertiary injection scheme variable, if the value of the primary injection scheme variable, secondary injection scheme variable, or tertiary injection scheme variable, respectively, falls within a range of injection scheme consensus values which indicates a likelihood of success of the injection scheme in question. In this example, the primary point is 5, the secondary point is 3, and the tertiary point is 2. In some examples, no points are assigned to a primary injection scheme variable, a secondary injection scheme variable, or a tertiary injection scheme variable, if the value of the respective parameter does not fall within the range of the injection scheme consensus values for that parameter which indicates a likelihood of success of the injection scheme in question.

An injection scheme score is computed based on the primary injection scheme points, the secondary injection scheme points, the tertiary injection scheme points (if used), and the quaternary injection scheme points (if used), based on the results of the comparison of the input value for each parameter to the respective injection scheme consensus value for that parameter. In an example, the arithmetic sum of the points assigned to the primary injection scheme variables and the secondary injection scheme variables of a waterflood process becomes the injection scheme score. In another example, the injection scheme score can be an arithmetic sum of the primary injection scheme points, secondary injection scheme points, tertiary injection scheme points (if used), and quaternary injection scheme points (if used). In yet another example, the injection scheme score can be a weighted sum of each of the primary injection scheme points, secondary injection scheme points, tertiary injection scheme points (if used), and quaternary injection scheme points (if used). In other examples, the injection scheme score is an arithmetic mean or a geometric mean of the primary injection scheme points, secondary injection scheme points, tertiary injection scheme points (if used), and quaternary injection scheme points (if used).

The injection scheme score indicates a likelihood of success of a given injection scheme with respect to recovery of oil from the reservoir system. In one example, a higher value of injection scheme score can indicate that a pattern injection scheme has an increased likelihood of success of improved oil recovery with application of the waterflooding project to the reservoir system, such as if the points were assigned to parameters based on injection scheme consensus values in a range in which a pattern injection scheme was successful. In the foregoing example, a lower value of injection scheme score can indicate that a peripheral injection scheme is more favorable. In another example, a higher value of injection scheme score can indicate that a peripheral injection scheme has an increased likelihood of success of improved oil recovery with application of the waterflooding project to the reservoir system, such as if the points were assigned to parameters based on injection scheme consensus values in a range in which a peripheral injection scheme was successful. In the foregoing example, a lower value of injection scheme score can indicate that a pattern injection scheme is more favorable.

The WF screening tool can determine a recommended injection scheme to be applied to a reservoir for enhanced recovery of oil from the reservoir by comparing the primary injection scheme points to a predetermined injection scheme viability score. The injection scheme can be deemed likely to with succeed respect to recovery of oil from the reservoir system if the injection scheme score is above the predetermined injection scheme viability score, or can be deemed unlikely to succeed with respect to recovery of oil from the reservoir system if the injection scheme score is below the predetermined injection scheme viability score. The predetermined injection scheme viability score can be determined based on publicly available information, such as data available in published literature. For example, the predetermined injection scheme viability score can be set as the value of the injection scheme viability score computed using publicly available data from reservoirs in which the injection scheme in question was successful. In another example, the predetermined injection scheme score can be set as at least about 30%, at least about 40%, at least about 50%, at least about 55%, at least about 60%, at least about 65%, at least about 70%, at least about 75%, at least about 80%, at least about 85%, at least about 90%, or more, of the highest possible injection scheme score that can be computed based on the primary injection scheme points, the secondary injection scheme points, the tertiary injection scheme points (if used), and the quaternary injection scheme points (if used), assigned to the respective variables. In one example, if higher points are assigned using ranges of injection scheme consensus values in which a pattern injection scheme was successful, then an injection scheme score above the predetermined injection scheme score can indicate that a pattern injection scheme is more favorable and an injection scheme score below the predetermined injection scheme score can indicate that a peripheral injection scheme is more favorable. In another example, if higher points are assigned using ranges of injection scheme consensus values in which a peripheral injection scheme was successful, then an injection scheme score above the predetermined injection scheme score can indicate that a peripheral injection scheme is more favorable and an injection scheme score below the predetermined injection scheme score can indicate that a pattern injection scheme is more favorable.

FIG. 44 shows a display for the WF injection scheme, and indicates examples of the primary, secondary and general injection scheme variables (parameters). As shown in the example of FIG. 44, a set of primary variables may be designated, where the primary variables affecting the choice of waterflood injection scheme are those that affect the reservoir productivity, influence the determination of the WF injection scheme, and are related to the objective of the project, the reservoir conditions and connectivity. The secondary variables are those found to affect fluid displacement and relate mainly to heterogeneity. Water displaces oil easier in homogeneous rock; water may bypass oil inside the reservoir if the rock has a high heterogeneity. The general variables can be those that affect design choices and the economics of the waterflood project. In FIGS. 11 and 12, primary variables may be the reservoir continuity, main recovery mechanism, main objective, while secondary variables may be the rock type and permeability, Dykstra-Parsons coefficient, the injection to production (I/P) ratio, the mobility ratio, the transmissibility, and the structure dip.

FIGS. 45 to 47 show plots that may be used as a statistical approach to determining ranges for consensus values. FIG. 45 shows a plot of the Ultimate Recovery Factor (URF) versus the Dykstra-Parsons (DP) coefficient, where a DP value of about 0.8 fairly delineates between peripheral and pattern WF injection schemes. In FIG. 46, a mobility ratio of about 3.0 fairly delineates between peripheral and pattern WF injection schemes. FIG. 47 also shows a plot which may be used to establish a range of consensus values. For example, in FIG. 47, values of mobility ratio fraction range from about 3.0 to about 5.0, which may fairly delineate between peripheral and pattern WF injection schemes.

FIG. 13 shows a screen shot of an example output window 603 for WF screening output module 515 which provide case studies for various reservoirs, as an example of real data applications that serve as a guide to a user. FIG. 13 illustrates the warning which may be displayed to a user if the actual condition of the WF injection scheme being employed differs from the recommended injection scheme from application of the WF screening process.

5.1.3 Waterflood Forecasting Tool

A waterflood (WF) forecasting tool also is provided. The WF forecasting tool provides a forecast (i.e., prediction) of the performance of a WF process in a reservoir. The WF forecasting tool uses computer-implemented analytical and empirical methods to predict the performance of the WF process. Also, the WF forecasting tool provides one or more modules, including modules for input variables, parameters definition, graphic correlations, documentation, guidelines for user, and for a listing of references which provide an explanations for each parameter used in the prediction. The WF forecasting tool also may provide a module for comparisons of the results of computations using the tool for different reservoirs, an option for modifying the sensitivities and analyses of various waterflooding scenarios in different reservoirs.

The WF forecasting tool may communicate with the WF screening tool (discussed in Section 5.1.1.2 above). The flow chart in FIG. 15 illustrates a flow chart of the WF forecasting tool, including the communication which may be established between the WF forecasting tool and the WF screening tool. In the implementation of the WF forecasting tool, it may access either the WF screening tool or the WF forecasting module 1501. For example, a user may enter input data into either the WF forecasting tool or the WF screening tool, and the data is made available to both tools. Such communication provides for increased consistency and data management. Input to the WF forecasting tool includes, but is not limited to, reservoir and fluid properties, relative permeability data (e.g., Corey-type relative permeability data or user input relative permeability data), and layer data (including the thickness, permeability porosity and Dykstra-Parsons (DP) coefficient. In the implementation of the WF forecasting tool, one or more WF performance computation methodologies known in the art may be used for computing the expected performance of the WF process. A WF performance computation methodology may be an analytical methodology or an empirical methodology. Non-limiting examples of WF performance computation methodologies include the Buckley-Leverett, Craig-Geffen-Morse, Dykstra-Parsons, Stiles, and Bush-Helander methodologies. FIG. 48 shows a comparison of several WF performance computation methodologies known in the art, including the Buckley-Leverett, Craig-Geffen-Morse, and Stiles methodologies. The computation of the expected performance of the WF process is based on a fit of the one or more WF performance computation methodologies to the received data. In an example, the WF forecasting tool may provide an output, for example, to a user, based on the computation of a fit of at least two of the WF performance computation methodologies for computing the expected performance of the WF process. For example, the WF forecasting tool may provide an output, for example, to a user, based on the computation of a fit of two, three, four, five, or more, of the WF performance computation methodologies to the received data for computing the expected performance of the WF process. For a computation involving two or more WF performance computation methodologies, a comparison may be made between the results of the fit of the two or more WF performance computation methodologies to the received data. In the foregoing example, the comparison can be performed during a single time step during a computation. In another example, the results of the fit of the two or more WF performance computation methodologies to the received data can be displayed to display or user interface, and the comparison can be performed at the display or user interface, for example, at the same screen.

The fit of the one or more WF performance computation methodologies to the received data can be performed using any applicable data fitting method in the art. For example, the fit of a WF performance computation methodology to the received data can be performed using a regression method, such as a linear regression or a nonlinear regression. Regression packages which can be used to perform a regression fit to data are known in the art. As non-limiting examples, the regression can be performed with limited dependent variables, can be a Bayesian linear regression, a quantile regression, a nonparametric regression, a simple linear regression, or a multiple linear regression. Other data fitting methods known in the art can be used.

The WF forecasting tool may receive information from the results of a primary decline curve analysis (DCA), which procedure provides for estimating the production performance. The output of the WF forecasting tool also may be compared with the output of the primary oil recovery process, for example, to determine the incremental oil recovery that application of the waterflood process may provide. That is, the production to be obtained using a waterflooding process may be compared with the production which would be obtained if no water was injected. The WF forecasting tool may further provide a description of the different computation methods for predicting performance of a WF process, and cite to references which discuss the special cases of application of a WF process to heavy oil in a reservoir, naturally fractured reservoirs, and considerations for water quality.

The WF forecasting tool disclosed herein provides the advantages of ease of use and reliability in its evaluation of waterflooding candidates. It also provides a direct way of recognizing waterflood opportunities, such as by comparing the additional production expected with water injection to a scenario where no water is injected. Furthermore, the WF forecasting tool disclosed herein utilizes readily available reservoir data.

FIG. 16 shows an example of an input screen 1601 for a WF forecasting input module. FIG. 17 shows an input data analysis screen 1701 of the WF forecasting tool. Examples of input parameters in FIGS. 16 and 17 include, but are not limited to, irreducible water saturation, residual saturation, residual oil saturation, residual gas saturation, oil saturation at the beginning of the WF process (initial oil saturation), gas saturation at the beginning of the WF process (initial gas saturation), initial water saturation, water viscosity, oil viscosity, oil formation volume factor, water formation factor, the pattern area, the net thickness, net thickness, porosity, the distance between wells, reservoir pressure drop, injection pressure, the number of layers, average permeability, the transmissibility, the reservoir pressure, the injection bottom hole pressure (BHP), the wellbore radius. Input screen 1601 may also provide feedback or information concerning the input data, e.g., a warning may be displayed if one or more input parameters are outside the allowable physical range for the parameter. For example, in FIG. 16 a warning is displayed because the input parameters entered resulted in residual water saturation greater than 1 (the display also states that the residual water saturation should be less than 1). In FIG. 17, the value input for the "Initial Oil Saturation" parameter is highlighted. The parameter may be highlighted in yellow (when displayed to a user) if the value input for the parameter is close to a boundary of a suitable range for the parameter, highlighted in red (when displayed to a user) if the value is outside of the suitable range for the parameter, or be shown against a white background if the input if in a suitable range. Input data analysis screen 1701 also displays a "Change Data" option to allow a user to change the value of a parameter when required. For example, the "Change Data" option may be required if a user wants to run a new case or when changes or corrections must be done to original input data. Input screen 1601 may provide a concise explanation of each input parameter in addition to detailed properties description in a "Parameter Definition" module. Input screen 1601 also may provide for saving and storing the previously entered input data for view at a later time or for analyzing the sensitivity of the tool to values of input data. One or more basic examples of application of the WF forecasting tool may be provided to a user as an instructional tool.

In an example implementation of the WF forecasting tool (illustrated in FIG. 54), the method comprises receive data indicative of physical properties associated with the reservoir system, where the data comprises parameter values associated with one or more parameters (see step 5400), computing at least one uncorrected WF performance profile of production of oil from the reservoir system with application of the waterflood process, and where the at least one uncorrected WF performance profile is computed based on application of at least one WF performance computation methodology to the received data (step 5402), and converting the at least one uncorrected WF performance profile to at least one corrected WF performance profile using a statistical correction factor (step 5406). The method may comprise a step of computing the statistical correction factor (SCF) based on application of the Bush-Helander empirical methodology and the Ganesh Thakur empirical methodology to the received data (step 5404). That is, step 5404 may be performed during an implementation to compute a SCF, but if a previously computed SCF is applied in step 5406, then step 5404 may not be performed. The corrected WF performance profile may be output (step 5408).

FIGS. 14B and 18A show examples of fractional flow curves for the performance of a WF process to be expected, computed using the WF forecasting tool. The screen shot in FIG. 18B also displays an example of a relative permeability curves for water and oil, computed using the WF forecasting tool. As illustrated in FIG. 18A, the WF forecasting tool may provide a user with an "Explanation" of the fractional flow curve and the relative permeability curves for water and oil. For example, FIG. 19A shows a screen shot of an explanation which may be provided to a user of how to derive from the fractional flow curve the initial water saturation, the water fractional flow at breakthrough, the water saturation at breakthrough, and the average water saturation at breakthrough. The screen shot in FIG. 19B also illustrates explanations of the Relative Permeability curves for that particular run, and for example, how to derive the irreducible water saturation and water end point relative permeability from the water relative permeability curve, and how to derive the irreducible oil saturation and oil end point relative permeability from the oil relative permeability curve. Also, as illustrated in FIG. 19B, the screen also may provide an explanation of the plot, i.e., an arrow across the water relative permeability curve indicates that the values of permeability on the left-hand y-axis in the figure corresponds to the water relative permeability curve, while the arrow across the oil relative permeability curve indicates that the values of permeability on the right-hand y-axis in the figure corresponds to the oil relative permeability curve.

The screen shots in FIGS. 20A and 20B show plots of curves for the cumulative oil production and water-oil-ratio (WOR) (FIG. 20A) and the recovery factor (as a percentage of the original-oil-in-place (OOIP)) (FIG. 20B), which were computed using the Buckley-Leverett methodology. The example of FIG. 20A also provides an option for changing the plots to the units of pore volumes injected, the units in which time is displayed (on the horizontal-axis of the figures), and provides an explanation of the plots. A toolbar also may be provided which provides for navigating through the output of the results, and which allows a user to return to a previous screen to change one or more input data parameters, or to retrieve results from computations using methods other than the Buckley Leverett method. FIG. 21A shows the plots of curves for the cumulative oil production WOR and the recovery factor (as a percentage of the OOIP) similar to that of FIG. 20A, except that the screen shot also provides explanations of the plots and of the axes which correspond to each curve.

Digitized values of the Dykstra-Parsons correlations (developed by Dykstra and Parsons for different values of water-oil ratio (WOR) and mobility ratio) can be included in the WF forecasting tool, and an automated procedure can be included in the WF S forecasting tool which accesses these Dykstra-Parsons coefficients. For example, FIG. 42A shows plots of the vertical coverage plotted against the permeability variation for a WOR=1, with each line representing a constant mobility ratio (M) which can have a value of from 0.1 up to 100.0. FIG. 42B shows plots similar to those of FIG. 42A, except that the WOR is set to 5. In this example, a user of the WF forecasting tool would not need to consult a plot of the Dykstra-Parsons coefficients in a publication to obtain a coverage value.

The screen shot in FIG. 22A shows a comparison of the total oil rates per well resulting from computations for the different WF performance computation methodologies, including Buckley-Leverett (BL Method), Craig-Geffen-Morse (CGM Method), Dykstra-Parsons (DP Method), the Stiles Method, and Bush-Helander (BH Method). FIG. 22B also shows a comparison of the recovery factor (as a percentage of the OOIP) resulting from computations for the different WF performance computation methodologies. The screen in FIG. 22A also provides an option for changing the x-axis in the display, an option for viewing more plots than only the five shown, and an option for obtaining an explanation. The screen in FIG. 23A shows plots of comparisons of the cumulative oil recovered versus time and the WOR versus recovery factor (% OOIP), respectively, for the different WF performance computation methodologies. The screen in FIG. 23A also provides an option for changing the x-axis in the display, an option for returning to rate plots such as those shown in FIGS. 22A and B, and an option for obtaining an explanation of the plot. FIG. 24 shows a comparison of the oil production rate versus recovery factor for the different WF performance computation methodologies.

The WF forecasting tool also provides a Statistical Correction Factor (SCF) which may provide for direct comparison of primary and secondary recovery processes by converting the data from the two processes to comparable scales. Application of the SCF corrects an uncorrected, analytically calculated WF oil production performance profile (such as computed using a WF performance computation methodology) to a more realistic WF performance profile, e.g., based on published statistical correlations. That is, application of the SCF to the computed forecasted production of the secondary recovery processes provides a more realistic production profile for the secondary recovery processes. For example, as shown in FIGS. 25A and 25B, application of the SCF allows for a direct comparison of the oil flow rates from primary and secondary recovery processes by converting the data for the secondary recovery process to a scale comparable to the data for the primary recovery process (i.e., in going from FIG. 25A to 25B). The SCF may be generated based on empirical correlations between the Bush-Helander (BH) and Ganesh Thakur (GT) empirical methodologies. The SCF can be determined using published data and statistical correlations to give the analytical output a more realistic performance profile. The SCF uses, e.g., real field data, to determine a more probable behavior in the oil production rate variable. FIG. 26A shows a comparison of the oil flow rates versus time for the different WF performance computation methodologies using data from an actual reservoir (Field 4). FIG. 26B shows a comparison of the cumulative oil produced versus time for the computations of the different WF performance computation methodologies using that data. Several operational conditions which may affect the data retrieved from a reservoir include, but are not limited to, changes in water injection rate ($i_w$), infill drilling (i.e., the drilling of additional wells within the reservoir area), and injection from other patterns (such as injection effects from other well patterns in the same reservoir). FIGS. 26A and 26B show comparisons of production data from a real well (Field 4), and computations of different WF performance computation methodologies using the WF forecasting tool, and also show the quality of the match. FIG. 27 shows that application of the SCF to the computations for the different WF performance computation methodologies facilitates more realistic estimates of the oil flow rate from the different WF performance computation methodologies. FIGS. 28A and 28B show comparisons of the oil flow rate versus time and the cumulative oil produced versus time, respectively, for the different WF performance computation methodologies using data from Field 7. This comparison shows that a reasonable match may be obtained using the WF forecasting tool.

5.1.4 Polymer Flood Forecasting Tool

A polymer flood forecasting tool also is disclosed which provides computer-implemented methods for forecasting (i.e., predicting) the performance of a polymer flood process. The polymer flood forecasting tool facilitates calculation of reservoir performance using Fractional Flow Theory, may be applicable to single-layered and multi-layered reservoirs, and may be employed for computations of continuous injection and slug injection followed by chase water. Since continuous injection may be expensive, the injection of chemical slugs provides an attractive alternative to improve the recovery of mature oil fields and can be more economical. Chase water refers to fluid injected after the slug injection to reduce the cost of continuous injection of polymer.

FIG. 29 illustrates a flow chart of an example implementation of the polymer flood forecasting tool. An injection method is selected (for example but not limited to continuous polymer or polymer slug), and data indicative of physical properties of materials in the reservoir (reservoir parameters) is input. The polymer type is selected; examples of polymer types include, but are not limited to, polyacrilamide and biopolymers. Data concerning the input layer properties of the reservoir are input. The polymer flood forecasting tool is run to provide results and to define the basic sensitivities of the results to variations in value of different input parameters. These results may be output, e.g., as plots and tables. These steps may be repeated.

In an example implementation of the polymer flood forecasting tool (illustrated in FIG. 55), the method comprises receive data indicative of physical properties associated with the reservoir system, where the data comprises parameter values associated with one or more parameters (see step 5500), and computing at least one polymer flood performance profile which provides a measure of production of oil from the reservoir system with application of the waterflood process, wherein the at least one polymer flood performance profile is computed based on application of at least one polymer flood performance computation methodology to the received data (step 5502). At least one polymer flood performance profile may be output (step 5508).

FIG. 30 shows example screen shots of the implementation of the polymer flood forecasting tool where a polymer injection method is selected in screen 3001. As a non-limiting example, a continuous polymer injection method or a polymer slug injection method may be selected. Screen 3001 may provide additional screen options for selection of other types of polymer injection methods in the art.

FIG. 31 shows a screen shot of an example input window 3101 for a polymer forecasting input module. Polymer forecasting input window 3101 may list the name of each input parameter and facilitates the entry of values for each input parameter. Examples of the type of input data which may be entered into the polymer flood forecasting tool include, but are not limited to, data indicative of rock properties (including the rock density), data indicative of fluids properties (including oil viscosity, the water viscosity, the polymer viscosity, the oil formation volume factor, the water formation volume factor, and polymer slug pore volume), and other properties of the reservoir (including the number of layers, the pressure drop, the wellbore radius, and the area). Data entered into the polymer forecasting input window 3101 also may be saved for later retrieval and/or manipulation. In addition, input window 3101 may provide example data.

FIG. 32 shows an example polymer type selection screen 3201, and also illustrates the type of information which may be displayed with selection of the polymer type. Examples of such information retrieved include, but are not limited to, values of the concentration and the retention for the polymer type selected. The two polymer types shown in screen 3201 are polyacrilamides and biopolymers. Screen 3203 shows the values of concentration and retention for the polyacrilamides. Screen 3205 shows the values of concentration and retention for the biopolymers. As shown in FIG. 32, the values of concentration for the polyacrilamides may be lower than those for the biopolymers, and the values of retention for the polyacrilamides may be higher than those for the biopolymers. The polymer flood forecasting tool also may allow a user to input user-preferred values of concentration and/or retention.

FIG. 33 shows a screen shot of a window 3301 of values of relative permeability and layer information for an example reservoir. Values of Corey-type relative permeability information, such as the endpoint of the oil relative permeability (Kro), the exponent of the oil Corey-type function, the endpoint of the water relative permeability (Krw), and the exponent of the water Corey-type function, also may be displayed. Input data for the input layer information includes, but is not limited to, reservoir lithology parameters such as porosity, permeability, and thickness, which may be provided for each layer. Fluid saturation (such as oil, water, and gas saturation) information may also be input.

In the implementation of the polymer flood forecasting tool, one or more polymer flood performance computation methodologies known in the art may be used for computing the expected performance of the polymer flood process. A polymer flood performance computation methodology may be an analytical methodology or an empirical methodology. Non-limiting examples of polymer flood performance computation methodologies include Buckley-Leverett, Craig-Geffen-Morse, Dykstra-Parsons, Stiles, and Bush-Helander methodologies. The computation of the expected performance of the polymer flood process is based on a fit of the one or more polymer flood performance computation methodologies to the received data. In an example, the polymer flood forecasting tool may provide an output, for example, to a user, based on the computation of a fit of at least two of the polymer flood performance computation methodologies for computing the expected performance of the polymer flood process. For example, the polymer flood forecasting tool may provide an output, for example, to a user, based on the computation of a fit of two, three, four, five, or more, of the polymer flood performance computation methodologies to the received data for computing the expected performance of the polymer flood process. For a computation involving two or more polymer flood performance computation methodologies, a comparison may be made between the results of the fit of the two or more polymer flood performance computation methodologies to the received data. In the foregoing example, the comparison can be performed during a single time step during a computation. In another example, the results of the fit of the two or more polymer flood performance computation methodologies to the received data can be displayed to display or user interface, and the comparison can be performed at the display or user interface, for example, at the same screen. The output of the polymer flood forecasting tool also may be compared with the output of the primary oil recovery process, for example, to determine the incremental oil recovery that application of the polymer flood process may provide. That is, the production to be obtained using a polymer flood process may be compared with the production which would be obtained if no fluid was injected.

The fit of the one or more polymer flood performance computation methodologies to the received data can be performed using any applicable data fitting method in the art. For example, the fit of a polymer flood performance computation methodology to the received data can be performed using a regression method, such as a linear regression or a nonlinear regression. Regression packages which can be used to perform a regression fit to data are known in the art. As non-limiting examples, the regression can be performed with limited dependent variables, can be a Bayesian linear regression, a quantile regression, a nonparametric regression, a simple linear regression, or a multiple linear regression. Other data fitting methods known in the art can be used.

Examples of output from the polymer flood forecasting tool include, but are not limited to, waterflood and polymer flood fractional flow data for each layer of the reservoir; water, polymer and oil saturations at respective fronts (such as at breakthrough); production and injection profiles for each layer for the waterflood and polymer flood projects; cumulative production and injection profile combined for all layers; and plots for flow rates, cumulative production for injected and produced fluids, water-oil-ratio (WOR), recovery factor etc. The polymer and oil saturations at respective fronts at breakthrough may be provided by comparing outputs from two scenarios: one scenario in which water is injected and another scenario where polymer is injected. The oil recovery, sweep efficiency, and fluid saturations may differ in the two scenarios.

Screen shot 3401 in FIG. 34 shows a comparison of the water-oil and polymer-oil fractional flow curves. Screen 3401 also provides an explanation of how to derive properties of a reservoir from the fractional flow curves. In connection with the polymer fractional flow curve, screen 3401 show the polymer retention, the fractional flow and the saturation at the front of the polymer bank, and the average saturation behind the front. Screen 3401 also shows the fractional flow at the front of the oil bank relative to the water curve, and the average saturation behind the front. The water-oil and polymer-oil fractional flow curves shows how the water and polymer fronts may be at different saturations and may be used to determine the fractional flow and saturation at the front of the polymer bank, at the front of the oil bank, and the average water saturation behind the front.

FIGS. 35 and 36A-C show example screen shots of different outputs from the polymer flood forecasting tool. Screen shot 3501 in FIG. 35 shows a plot of example relative permeability curves for oil and water. Screen shot 3601 in FIG. 36A shows example plots of the cumulative water injected and produced vs. pore volume injected (PVI). Screen shot 3602 (FIG. 36B) shows example plots of the oil and water flow rate vs. pore volume injected (PVI). Screen shot 3603 (FIG. 36C) shows an example cumulative oil production vs. pore volume injected (PVI). These plots illustrate the reservoir performance and the polymer flood results in terms of the amount of water that may be injected, the amount of water that may be produced, the oil and water production rate that may be obtained during the process, and the total recovery that may be obtained in terms of cumulative oil production (in units of barrels (bbls).

Input data for parameters applicable to the polymer flood forecasting tool is shown in FIG. 37 for an actual reservoir (Field 7). Field 7 is a layered, high mobility ratio reservoir system. One type of polymer which may be used is HPAM Betz Hi-Viz Polyacrylamides Polymer, which has a concentration of 750 ppm and a retention of 160 lbm/ac-ft. This type of polymer has undergone a partial hydrolysis, which process negatively charges the molecules to optimize certain properties such as water solubility, viscosity and retention. The HPAM Betz Hi-Viz Polyacrylamides Polymer is an example of a type of relatively inexpensive polymer used in the field. FIG. 38 shows a screen shot of an example plot of the cumulative oil produced vs. pore volume injected (PVI) for Field 7 which may be output by the polymer flood forecasting tool using input data from the reservoir. FIG. 39 shows a screen shot of example plots of the cumulative water injected and produced vs. pore volume injected (PVI) for Field 7.

As a guide to a user, the polymer flood forecasting tool may provide a comparison between the outputs of the tool for an actual reservoir to other data, e.g., data from a comparative textbook. For example, Craig, F., 1971, "Reservoir Engineering Aspects of Waterflooding," SPE Monograph Series, vol. 3. Richardson, Tex., Appendix E4, page 114, provides an example calculation using the Craig-Geffen-Morse (CGM) method. FIG. 40 shows values of some parameters for a comparative textbook example, which may be compared to the values listed in FIG. 37 for Field 7. Since the polymer concentration and retention in FIG. 40 are assumed to be zero, the polymer flood forecasting tool defaults to a waterflood computation, and the production rates for oil and water are compared. As shown in the screen shot of FIG. 41A, the oil and water production rates over time are consistent with the example results published in Craig, F., 1971, "Reservoir Engineering Aspects of Waterflooding," SPE Monograph Series, vol. 3. Richardson, Tex., Fig. E.10, page 123. Also, as shown in FIG. 41B, the water production flow rate versus pore volume injected (PVI) appears to plateau at about 1200 bbl/d (water and oil production rates, in units of barrels (bbl) per day).

The polymer flood forecasting tool disclosed herein provides for both waterflood and polymer flood modeling and facilitates identification of early polymer flood opportunities. Production rates for oil and water from actual reservoirs and the textbook examples may be compared. The polymer flood forecasting tool also can be used to calculate oil recovery, water-oil-ratio (WOR) and cumulative volume of displacing fluid injected.

5.2 Description of Recovery Processes

A description of the waterflood process and a number of EOR processes (or IOR processes) is provided below. Waterflooding is the most commonly used recovery process (see section 5.2.1). However, in an effort to increase the oil recovery, surfactants may be added to flood water to lower the oil-water interfacial tension and/or to alter the wettability characteristics of the reservoir rock in a surfactant flooding EOR process (see, e.g., Section 5.2.4 below). Also, viscosifiers such as polymeric thickening agents may be added to all or part of the injected water in order to increase its viscosity in a polymer flooding process (see, e.g., Section 5.2.6 below), thereby decreasing the mobility ratio between the injected water and oil and improving the sweep efficiency of the recovery process.

EOR processes may be grouped into three main categories: chemical, gas/solvent, and thermal processes. Examples of a chemical EOR process include, but are not limited to, polymer flooding, surfactant/polymer flooding, alkaline/polymer flooding, and alkaline/surfactant/polymer flooding. Examples of a gas EOR process include, but are not limited to, $CO_2$, $N_2$, and flue gas flooding.

Thermal recovery processes generally rely on the use of thermal energy to improve oil recovery. They may be steamflooding (cycling steam stimulation or steamdrive) and in-situ combustion. The objective of thermal recovery processes is to increase reservoir temperature, reduce oil viscosity and enhance oil displacement towards the producing wells.

The mechanism and limitations of each EOR process is discussed below. Also, the different physical and chemical criteria which may be used to screen the various EOR processes for application in a reservoir are discussed.

5.2.1 Waterflooding

Waterflooding involves the injection of water into a well, e.g., an injection well, to cause oil that was not recovered by primary production to migrate through of the reservoir rock and into the wellbores of an adjacent well, e.g., a production well. As the water moves through the reservoir, it acts to displace contained oil towards a production system comprising one or more production wells (i.e., the wells through which the oil is recovered).

Factors which may influence the amount of oil recovered by waterflooding include, but are not limited to, the interfacial tension between the injected water and the reservoir oil, the relative permeabilities of the fluids, and the wettability characteristics of the rock surfaces within the reservoir.

5.2.2 Carbon Dioxide Flooding

Carbon dioxide ($CO_2$) flooding is considered a miscible displacement since the effectiveness of the displacement can depend on the miscibility between the oil in place and the injected fluid (hydrocarbon solvents, $CO_2$, flue gas and nitrogen). $CO_2$ flooding is carried out by injecting large quantities of the gas $CO_2$ (30% or more of the hydrocarbon pore volume (PV)) into the reservoir. The $CO_2$ helps to extract the light to intermediate components from the oil. Although $CO_2$ is not normally miscible with the crude oil at first contact, the $CO_2$ and the crude oil may become miscible with a sufficiently injection high pressure, causing displacement of the crude oil from the reservoir. Miscibility of $CO_2$ with oil in the reservoir can be achieved at lower pressures than those used for other gases (such as but not limited to $N_2$). The $CO_2$ flooding recovers crude oil by swelling the crude oil (since $CO_2$ is highly soluble in high-gravity oils), lowering the viscosity of the oil, lowering the interfacial tension between the oil and the $CO_2$ phase/oil phase in the near-miscible regions, and generating miscibility when pressure is high enough.

Several factors may affect the amount of oil recovered in the $CO_2$ EOR process. Some of these factors may be influenced by the extent of any prior waterflooding. Examples of the factors include, but are not limited to, the degree to which reservoir stratification (and other heterogeneities) influences the miscible sweep efficiency, and the ability of the $CO_2$ to contact the reservoir volume effectively. The degree of gravity segregation of $CO_2$ also influences sweep efficiency, and the severity of the gravity segregation depends strongly upon the ratio of vertical to horizontal permeability, which also can vary appreciably among and within reservoirs. Other factors that affect incremental recovery include, but are not limited to, the waterflood residual oil saturation, the $CO_2$ flushed region (the miscible residual saturation), the efficiency with which the displaced oil can be captured by the producing wells, and the lost displaced oil due to re-saturation of low oil-saturation zones. In $CO_2$ flooding corrosion could occur, e.g., if there is early breakthrough of $CO_2$ in producing wells.

5.2.3 Nitrogen and Flue-Gas Flooding

The nitrogen and flue gas EOR process uses mainly non-hydrocarbon gases to displace oil in a system that may be either miscible or immiscible, depending on the pressure and on the oil composition. Flue gas may include, but are not limited to, one or more of sulphur dioxide ($SO_2$), sulphur trioxide ($SO_3$), nitrous oxide (NO), hydrogen chloride (HCL) and hydrogen fluoride (HF). Large volumes of these non-hydrocarbon gases may be injected. Nitrogen and flue gas also may be used as chase gases in hydrocarbon-miscible and $CO_2$ flooding. In the practice of nitrogen and flue gas flooding, oil is recovered by vaporizing the lighter components of the crude oil and generating miscibility (e.g., if the pressure is high enough), providing a gas drive (i.e., a portion of the reservoir volume is filled with low-cost gases), and enhancing gravity drainage in dipping reservoirs (miscible or immiscible).

Miscibility may be achieved with light oils and at very high pressure. Therefore, nitrogen and flue gas EOR processes may be performed on deep reservoirs. A steeply dipping reservoir may be desired to permit gravity stabilization of the displacement if there is an unfavorable mobility ratio. For miscible or immiscible enhanced gravity drainage, a dipping reservoir may be applicable to the project. Since the gas generally is less viscous than the crude oil, the moving interface between the gas and oil may be unstable to small disturbances in a phenomenon called "viscous fingering." Viscous fingering may result in poor vertical and horizontal sweep efficiency. Preferably, the non-hydrocarbon gases are separated from any hydrocarbon gas. Injection of a flue gas may cause corrosion, therefore, solely nitrogen gas injection may be preferable.

5.2.4 Surfactant Flooding

In surfactant EOR process, surfactants may be added to the injected water to lower the oil-water interfacial tension and/or to alter the wettability characteristics of the reservoir rock. The reduced oil-water interfacial tension may result in greater oil miscibility and improved mobility.

The principal factors which influence surfactant flooding injection are interfacial tension, surfactant mobility in relation to the mobility of the oil/water bank, acceptable surfactant properties and integrity in the reservoir. As reservoirs each have unique fluid and rock properties, specific chemical systems should be designed for each individual application. The type of surfactant used, its concentration and size may depend on specific properties of the fluids in the reservoir and the reservoir rock type.

The application of the surfactant EOR process may be limited by the availability of surfactants. Also, the technology for surfactant injection may not be as mature as the technology in other areas.

5.2.5 Micellar/polymer, Alkaline-Surfactant-Polymer (ASP), and Alkaline Flooding Micellar/polymer flooding involves the injection of a slug containing water, surfactant, polymer, an electrolyte (salt), optionally alcohol, and optionally oil, into a reservoir. The slug is usually 5-15% pore volume (PV) (for high surfactant concentration) and 15-50% PV (for low concentration). The injection of the slug is followed by injection of water mixed with polymer. The polymer concentration ranges from 500 to 2,000 mg/L, and the injected polymer volume may be 50% PV or more.

Alkaline-Surfactant-Polymer (ASP) injection is similar to micellar/polymer injection, except that much of the surfactant is substituted with an alkaline. In an alkaline injection, the water is treated with a low concentration alkaline agent prior to injection.

Enhanced crude oil recovery is facilitated by the reduced the oil-water interfacial tension, the oil miscibility in some micellar system, the oil and water emulsification (e.g., in the alkaline), the change in wettability (e.g., due to the alkaline), and improved mobility.

The micellar/polymer, ASP, and alkaline flooding processes are preferably performed on reservoirs with: (i) relatively homogeneous formations, (ii) rocks with small amounts of anhydrite (the anhydrous form of calcium sulfate ($CaSO_4$)), gypsum (the dihydrate form of calcium sulfate ($CaSO_4.2H_2O$)), or clay, (iii) a sweep zone greater than 50% for water injection, (iv) chloride at less than 20,000 ppm, and (v) divalent ions (e.g., $Ca^{2+}$ and $Mg^{2+}$) at less than 500 ppm. A flushed zone is the part of the rock that has been flushed with a sweep fluid. The area may have some hydrocarbons remaining. That is, the displacing fluid may leave behind hydrocarbon due to low sweep efficiency after the sweep zone.

5.2.6 Polymer Flooding

In the polymer flooding process, certain high-molecular-weight polymers, typically polyacrylamide or xanthan, are dissolved in the injection water prior to injection, to decrease water mobility and increase its viscosity. Polymer concentrations may range from 250 to 2000 mg/L. A polymer flooding process facilitates larger volume of the reservoir to be contacted as compared to other EOR processes. Factors which may cause the polymer flooding process to be unsuitable for a reservoir include, but are not limited to, extensive fracturing, multiple sealing faults and a strong natural water drive.

Examples of reservoirs which may be amenable to polymer flooding are heterogeneous light-oil reservoirs and those containing moderately viscous oils (such as those having viscosity less than 100 cp) with unfavorable mobility ratio. Application of a polymer flooding process in heterogeneous reservoirs may result in improved vertical conformance or redistribution of injected fluids. Moderately viscous oil reservoirs may exhibit increased oil recovery through better flood mobility control. Polymer flooding may show long term thermal stability in reservoir systems with temperatures at or below 160° F. Chemical stabilizers may be used for reservoirs at temperatures above 160° F. High clay content in reservoirs is undesirable, since the retention (loss) of polymer may be increased.

5.2.7 Steam Flooding

Steamflooding is generally limited to relatively shallow reservoirs due to the potential of heat loss in the wellbore, even though insulated injection tubing can be used to increase depth of application. This process involves continuous injection of steam (about 80% pure) into the viscous oil-bearing formation to establish thermal communication through the formation from an injection well to at least one production well, with the aim to displace crude oil towards the producing wells. Steam injection may be preceded by, or be applied concurrent with, a steamdrive, through cyclic steam stimulation of producing wells, i.e., where the operation of the injector well is reversed to produce the oil after the reservoir has been through a soak phase (in a process referred to as huff-n-puff). Steamflooding recovers crude oil by heating the crude oil to reduce its viscosity, and applying pressure to drive the crude oil to the producing well. Steamflooding can also produce steam distillation of in light crude oils.

In order for a steamflooding process to be applicable, oil saturation should be between 8% and 10%, and the pay zone (i.e., the region with the oil) should be equal to or more than 20 ft thick (to minimize heat losses to adjacent formations). Lighter, less-viscous crude oils also may be steamflooded, but normally a waterflooding process is applied to such systems. Steamflooding is generally applicable to reservoir systems containing viscous oils in high-permeability sandstones or unconsolidated sands. Due to the risk of excess heat losses in the wellbore, a reservoir ideally should be as shallow as possible, so that a high enough pressure to injection rates can be maintained. It is desired for the reservoirs to have a low percentage of water-sensitive clays to maintain good injectivity.

5.2.8 In-Situ Combustion

In the in-situ combustion (also called fire flooding) process, an oxygen containing gas (such as air) is introduced into the formation and high temperature combustion of the reservoir oil is initiated and maintained. The oxygen reacts with the residual oil laid down during the process to generate heat and, as a result, oxides of carbon are formed. The heat of combustion in the reservoir results in lowered viscosity of the oil over a substantial portion of the formation and enhancing the recovery of the oil. Due to the high temperature, the reaction rate is high.

In a technique commonly referred to as forward combustion, air is continually injected while the injection well is burned to cause the burning to proceed in a forward direction, with crude oil being recovered at wells that are offset from the injection well. The injected air also increases the pressure in the reservoir. The efficiency of forward combustion may be improved by alternating the injection of water and air, where the injected water allows transference of heat from the rock behind the combustion zone to the rock immediately ahead of the combustion zone, thereby improving the heating of the system. The success of the in-situ combustion process may depend on the occurrence of coke burning. That is, if there is too little coke, then the burning process cannot maintain, but with too much coke, the combustion speed becomes slower and more air should be injected. A consideration in in-situ combustion process is that oil saturation and porosity should be high enough to minimize heat loss to adjacent rock. In addition, the combustion process may not be as efficient in thin reservoirs.

5.3 Examples of Apparatus and Computer-Program Implementations

The methods disclosed herein can be implemented using an apparatus, e.g., a computer system, such as the computer system described in this section, according to the following programs and methods. Such a computer system can also store and manipulate the data indicative of physical properties associated with materials in a reservoir which is input into the tools, and the output of the tools, such as the different scores or the plots. The systems and methods may be implemented on various types of computer architectures, such as for example on a single general purpose computer, or a parallel processing computer system, or a workstation, or on a networked system (e.g., a client-server configuration such as shown in FIG. 49).

As shown in FIG. 49, the modeling computer system to implement one or more methods and systems disclosed herein can be linked to a network link which can be, e.g., part of a local area network ("LAN") to other, local computer systems and/or part of a wide area network ("WAN"), such as the Internet, that is connected to other, remote computer systems.

The modeling system comprises any methods of the described herein. For example, a software component can include programs that cause one or more processors to implement steps of accepting a plurality of parameters indicative of physical properties associated with the reservoir, and/or the generated output of the screening and forecasting tools and storing the parameters indicative of physical properties associated with the reservoir, and/or the generated output of the screening and forecasting tools in the memory. For example, the system can accept commands for receiving parameters indicative of physical properties associated with the reservoir, and/or output of the screening and forecasting tools, that are manually entered by a user (e.g., by means of the user interface). The programs can cause the system to retrieve parameters indicative of physical properties associated with the reservoir, and/or the generated output of the screening and forecasting tools, from a data store (e.g., a database). Such a data store can be stored on a mass storage (e.g., a hard drive) or other computer readable medium and loaded into the memory of the computer, or the data store can be accessed by the computer system by means of the network.

6. MODIFICATIONS

Many modifications and variations of this invention can be made without departing from its spirit and scope, as will be apparent to those skilled in the art. The specific examples described herein are offered by way of example only, and the invention is to be limited only by the terms of the appended claims, along with the full scope of equivalents to which such claims are entitled.

As an illustration of the wide scope of the systems and methods described herein, the systems and methods described herein may be implemented on many different types of processing devices by program code comprising program instructions that are executable by the device processing subsystem. The software program instructions may include source code, object code, machine code, or any other stored data that is operable to cause a processing system to perform the methods and operations described herein. Other implementations may also be used, however, such as firmware or even appropriately designed hardware configured to carry out the methods and systems described herein.

The systems' and methods' data (e.g., associations, mappings, data input, data output, intermediate data results, final data results, etc.) may be stored and implemented in one or more different types of computer-implemented data stores, such as different types of storage devices and programming constructs (e.g., RAM, ROM, Flash memory, flat files, databases, programming data structures, programming variables, IF-THEN (or similar type) statement constructs, etc.). It is noted that data structures describe formats for use in organizing and storing data in databases, programs, memory, or other computer-readable media for use by a computer program.

The systems and methods may be provided on many different types of computer-readable media including computer storage mechanisms (e.g., CD-ROM, diskette, RAM, flash memory, computer's hard drive, etc.) that contain instructions (e.g., software) for use in execution by a processor to perform the methods' operations and implement the systems described herein.

The computer components, software modules, functions, data stores and data structures described herein may be connected directly or indirectly to each other in order to allow the flow of data needed for their operations. It is also noted that a module or processor includes but is not limited to a unit of code that performs a software operation, and can be implemented for example as a subroutine unit of code, or as a software function unit of code, or as an object (as in an object-oriented paradigm), or as an applet, or in a computer script language, or as another type of computer code. The software components and/or functionality may be located on a single computer or distributed across multiple computers depending upon the situation at hand.

7. REFERENCES CITED

All references cited herein are incorporated herein by reference in their entirety and for all purposes to the same extent as if each individual publication or patent or patent application was specifically and individually indicated to be incorporated by reference in its entirety herein for all purposes. Discussion or citation of a reference herein will not be construed as an admission that such reference is prior art to the present invention.

8. LIST OF REFERENCES

1. Craft, B. C. and Hawkins, M. (revised by Terry, R): "Applied Petroleum Reservoir Engineering" 2nd. Edition. Prentice Hall PTR. NJ, 1991.
2. Willhite, G. P.: "Waterflooding". SPE Textbook Series. Vol. 3. Richardson, Tex., 1986.
3. Wayhan, D. A. and McCaleb, J. A.: "Elk Basin Madison Heterogeneity-Its Influence on Performance". J. Pet. Tech. (February 1969) 153-59. Paper SPE 2214 presented at the 1968 Annual Fall Meeting. Houston. September. 29-Oct. 2.
4. Hunter Z. A.: "Progress Report. North Burbank Unit Waterflood-Jan. 1, 1956". Drill. And Prod. Prac., API (1956) 262-73.
5. Wattenbarger, R., Howell, B., Loye, P.: "A Successful Peripheral Waterflood in a Thin Pennsylvanian Reservoir". Paper SPE 943. November 1964
6. Denham, R.: "Peripheral Pattern Waterflood Performance, Sholem Alechem Fault Block "E" Unit". Paper SPE 949, presented at 1964 Annual Fall Meeting. Houston, Oct. 11-14.
7. Cowan, R. and Guerrero, E.: "Predicting Reserves and Performance of a Peripheral Waterflood". Paper SPE 1121.
8. McNeill, W., Garret, J.: "Predicting Optimum Shut-In of Wells in Peripheral and Line Drive Waterfloods". Paper SPE 2474 presented at 1969 Permian Basin Oil Recovery Conference, May 8-9.
9. Khan, A.: "An Empirical Approach to Waterflood Predictions". Paper SPE 2931 presented at the 1970 Annual Fall Meeting, Houston, Oct. 4-7.
10. Bobar, A.: "Reservoir Engineering Concepts on Well Spacing". Paper SPE 15338. January 1985.
11. Gould, T. and Sarem, A.: "Infill Drilling for Incremental Recovery". Paper SPE 18941 Distinguished Author Series, December 1981-December 1983.
12. Kwan, G., Addie, D., and Redman, S.: "Waterflood/EOR Infill Drilling in Drill Site 9, Flow Station 2, of Prudhoe Bay. Paper SPE 27885 presented at the 1994 Western Regional Meeting, Long Beach, Mar. 23-25.
13. Diskstra, H.: "The Effect of an Initial Gas Saturation on the Performance of a Waterflood". Paper SPE 29467 presented in the 1995 Production Operations Symposium. Oklahoma City, April 2-4.
14. Collings, R., Hild, G. and Abidi, H.: "Pattern Modification by Injection-Well Shut-In: A Combined Cost-Reduction and Sweep-Improvement Effort". Paper SPE 30730 presented at the 1995 Annual Technical Conference and Exhibition. Dallas. Oct. 22-25.
15. Elias, A. et al: "Optimization of Water Injection in a Sandstone Reservoir: A Successful Case Study". Paper SPE 39554 presented at the 1998 SPE India Oil and Gas Conference and Exhibition. New Delhi, Feb. 17-19.
16. Mamgal, D. C. et al: "Improving Recovery through Peripheral Waterflood Management in Multilayered Reservoir". Paper SPE 39561 presented at the 1998 SPE India Oil and Gas Conference and Exhibition. New Delhi, Feb. 17-19.
17. Davis, D., Habib, H.: "Start-up of Peripheral Water Injection". Paper SPE 53208 presented at the 1999 SPE Middle East Oil Show, Bahrain, Feb. 20-23.
18. Grinestaff, G. and Caffrey, D.: "Waterflood Management: A Case Study of the Northwest Fault Block Area of Prudhoe Bay, Ak., Using Streamline Simulation and Traditional Waterflood Analysis". Paper SPE 63152 presented at the 2000 SPE Annual Technical Conference and Exhibition, Dallas. Oct. 1-4.
19. Kolbikov, S. et al: "Improved Oil Recovery Based on Optimal Waterflood Pressure". Paper SPE 65172 presented at the 2000 European Petroleum Conference, Paris. Oct. 24-25. B33
20. Hendih, A., et al: "Investigation for Mature Minas Waterflood Optimization". Paper SPE 77924 presented at the 2002 SPE Asia Pacific Oil and Gas Conference and Exhibition. Melbourne, Oct. 8-10.
21. Bhushan, Y., et at: "A Case Study on Redevelopment of a Giant Multilayered Carbonate Reservoir Based on Modification of Ongoing Waterflood Program through Integrated Reservoir Modelling Studies". Paper SPE 81581 presented at the 2003 Middle East Oil Show and Conference. Bahrain. April, 5-8.
22. Terrado, M., Yudono, S, and Thakur, G.: "Waterflooding Surveillance and Monitoring: Putting Principles into Practice". Paper SPE 102200 presented in the 2006 SPE Annual Technical Conference and Exhibition. San Antonio. September. 24-27.
23. Lu, X., et al: "Strategies and Techniques for a Giant Sandstone Oilfield Development: A Road Map to Maximize Recovery". Paper SPE 100942 presented at the 2006 Asia Pacific Oil & Gas Conference and Exhibition. Adelaide. September. 11-13.

24. Cobb, W. and Marek, F.: "Determination of Volumetric Sweep Efficiency in Mature Waterfloods Using Production Data". Paper SPE 38902 presented in the 1997 Annual Technical Conference and Exhibition. San Antonio, Oct. 5-8.
25. Thakur, G, and Satter, A.: "Integrated Waterflood Asset Management". PennWell Corporation, 1998.
26. Yudono, S., et al: "SMO Waterflood Benchmarking". Chevron internal document (presentation). March 2007.
27. Vicente, M, et al: "Determination of Volumetric Sweep Efficiency in Barrancas Unit, Barrancas Field". Paper SPE 68806 presented at the 2001 Western Regional Meeting. Bakersfield. March, 26-30.
28. Dandona, A. and Morse, R.: "The Influence of Gas Saturation on Waterflood Performance—Variations Caused by Changes in Flooding Rate". Paper SPE 4257 presented at the 1972 Hobbs Regional Meeting. Hobbs. Nov. 9-10.
29. Doublet, L et al: "An Integrated Geologic and Engineering Reservoir Characterization of the North Robertson (Clearfork) Unit; A Case Study, Part 1". Paper SPE 29594 presented at the 1995 Joint Rocky Mountain Regional Meeting and Low-Permeability Reservoirs Symposium. Denver. March 20-22.
30. Frampton, et al: "Development of a Novel Waterflood Conformance Control S+B44ystem". Paper SPE 89391 presented at the 2004 SPE/DOE14th Symposium on Improved Oil Recovery. Tulsa. April 17-21.
31. Juanes, R. and Blunt, M.: "Impact of Viscous Fingering on the Prediction of Optimum WAG Ratio". Paper SPE 99721 presented at the 2006 SPE/DOE Symposium on IOR. Tulsa. April 22-26.
32. Wang, D. et al: "Sweep Improvement Options for the Daqing Oil Field". Paper SPE 99441 presented at the 2006 SPE/DOE Symposium on IOR. Tulsa. April 22-26.
33. Mc Lachlan, K. and Ershaghi, I.: "A Method for Reservoir Management of Waterfloods". Paper SPE 97829 presented at the 2005 Eastern Regional Meeting, Morgantown. September. 14-16.
34. Kumar, M. et al: "High Mobility Ratio Waterflood Performance Prediction: Challenges and New Insights". Paper SPE 97671 presented at the 2005 SPE International Improved Oil Recovery Conference in Asia Pacific. Kuala Lumpur. Dec. 5-6.
35. Hirasaky, G., Morra, F., and Willhite, P.: "Estimation of Reservoir Heterogeneity from Waterflood Performance". Paper SPE 13415.
36. Van den Hoek, P.: "Impact of Induced Fractures on Sweep and Reservoir Management in Pattern Floods". Paper SPE 90968 presented at the 2004 SPE Annual Technical Conference and Exhibition. Houston. September. 26-29.
37. Algharaib, M. and Gharbi, R.: "A C+B52omparative Analysis of Waterflooding Projects Using Horizontal Wells". Paper SPE 93743 presented at the 2005 Middle East Oil Show. Bahrain. March 12-15.
38. Ferreira, H., Mamora, D., Startzman, R.: "Simulation Studies of Waterfloods Performance with Horizontal Wells". Paper SPE 35208 presented at the 1996 SPE Permian Basin Oil and Gas Recovery Conference. Midland. March 27-29.
39. Brigham, W.: "Fluid Flow in Various Patterns and Implications for EOR Pilot Flooding". Paper SPE 87661. Mar. 2, 2004.
40. El-Khatib, N.: "The Application of Buckley-Leverett Displacement to Waterflooding in Non-Communicating Stratified Reservoirs". Paper SPE 68076 presented in the 2001 SPE Middle East Oil Show. Bahrain. March 17-20.
41. Jones, M.: "Waterflood Mobility Control: A Case History". Paper SPE 1427. Published at J. of Pet. Tech. September 1966.
42. Kelley, D.: "The Effect of Connate Water on Efficiency of High-Viscosity Waterfloods". Paper SPE 1615 published in November, 1966.
43. Snyder, R.: "Application of Buckley-Leverett Displacement Theory to Noncommunicating Layered Systems". Paper SPE 1645 presented at the 1967 SPE Rocky Mountain Regional Meeting. Casper. May, 22-23.
44. Hiatt, W.: "Simplified Performance Calculation for Pattern Waterfloods in Stratified Reservoirs". Paper SPE 2007 presented at the 1968 SPE California Fall Meeting. Bakersfield. Nov. 7-8.
45. Hall, R. et al: "Identification and Analysis of Fields for Waterflood-Enhanced Recovery Efforts". Paper SPE 104596 presented at the 2006 SPE Eastern Regional Meeting. Canton. Oct. 11-13.
46. Yang, Z. and Ershaghi, I.: "A Method for Pattern Recognition of WOR Plots in Waterflooding Management". Paper SPE 93870 presented at the 2005 SPE Western Regional Meeting. Irvine. March 30-April 1.
47. Craig, F.: "The Reservoir Engineering Aspects of Waterflooding". SPE Monograph volume 3. 1971.
48. IBU
49. Taber, J. et al: "EOR Screening Criteria Revisited—Part 1: Introduction to S+B65536creening Criteria and Enhanced Recovery Fields Projects" Paper SPE 35385 presented at the 1996 SPE/DOE Improved Oil Recovery Symposium. Tulsa, April 21-24.
50. Starcher, M. G., et al: "Case History of the 31S Peripheral Waterflood Project, Stevens Zone, Elk Hills Field, Calif.". Paper SPE 35673 presented at the 1996 SPE Western Regional Meeting. Anchorage. May 22-24.
51. Thakur, G.: "The Role of Reservoir Management in Carbonate Waterfloods". Paper SPE 39519 presented at the 1998 SPE India Oil and Gas Conference and Exhibition. New Delhi. April 7-9.
52. Barbe, J.: "Evaluation and Modification of the Means San Andres Unit Waterflood". Paper SPE 3301 presented at the 1971 SPE Permian Basin Oil Recovery Conference. Midland. May 6-7.
53. Rahman, M., et al: "Case Study: Performance of a Complex Carbonate Reservoir Under Peripheral Water Injection". Paper SPE 21370 presented at the 1991 SPE Middle East Oil Show. Bahrain. Nov. 16-19.
54. Stephens, F.: "Peripheral and Line Drive Water Injection Projects". Paper SPE 1504-G presented at the 1960 4th Biennial Secondary Recovery Symposium. Wichita Falls. May 2-3.
55. Jardine, D. and Wilshart, W.: "Carbonate Reservoir Description". Paper SPE 10010 presented at the 1982 SPE International Petroleum Exhibition and Technical Symposium. Beijing. March 18-26.
56. Dake, L. P.: "Fundamentals of Reservoir Engineering". Elsevier Scientific Publishing Co. New York. 1995.
57. McCain, W.: "Properties of Petroleum Fluids". 2nd. Ed. 1990
58. Ahmed, T.: "Reservoir Engineering Handbook". 2nd. Ed. Gulf Professional Publishing. 2001
59. N. M. Jedaan, A. Al Abdulmalik.: "Characterisation, Origin and Reparation of Tar Mat in the Bul Hanine Field in Qatar". International Petroleum Technology Conference, 4-6 Dec. 2007, Dubai, U. A. E. 2007
60. L. W. Lake, "Enhanced Oil Recovery"

61. Cobb, W. and Smith. J.: "Waterflooding Training Course". Texaco. 1986
62. Wei, W., Maddux, P. "The applications of water geochemistry in waterflood surveillance". WFCoP/WF workshop presentations—(May 2008).
63. Tuck, J.: "The Water Cycle, a Water Injection Perspective". Oil Plus Ltd. and WFCoP/WF workshop presentations—(May 2008).
64. MacLeod, N.: "Sulphate Removal Membranes—SRM". WFCoP/WF workshop presentations—(May 2008).
65. Looney, M.: "The relationship between Water Quality and the Completion". WFCoP/WF workshop presentations—(May 2008).
66. Evans, P.: "Managing the Risk of Reservoir Souring". WFCoP/WF workshop presentations—(May 2008).
67. Bush, J. and Helander, D.: "Empirical Prediction of Recovery Rate in Waterflooding Depleted Sands". Paper SPE presented at the 1968 Eight Secondary Recovery Symposium, Wichita Falls, May 6-7.

What is claimed is:

1. A computer-implemented method of evaluating the likelihood of success of one or more recovery processes in providing enhanced or improved recovery of oil from a reservoir system, wherein said one or more recovery processes are one or more of an enhanced oil recovery (EOR) process or a waterflood process, said method comprising:

receiving data indicative of physical or chemical properties associated with the reservoir system, said data comprising one or more parameter values, wherein each said parameter value corresponds to a parameter;

comparing each said received parameter value to one or more recovery process consensus values corresponding to the respective parameter, wherein each said recovery process consensus value is associated with a recovery process, and wherein said comparing is implemented on a computer system;

assigning a recovery process parameter score to each said recovery process for each said parameter based on said comparing, wherein said assigning is implemented on a computer system;

computing a recovery process overall score for each said recovery process based on the recovery process parameter scores assigned to the recovery process, wherein said computing is implemented on a computer system;

wherein said recovery process overall score provides an indication of the likelihood of success of said recovery process with respect to recovery of oil from the reservoir system;

comparing said recovery process overall score to a predetermined recovery process success score, wherein said recovery process is deemed likely to succeed with respect to recovery of oil from the reservoir system if said recovery process overall score is less than said predetermined recovery process success score, or is deemed unlikely to succeed with respect to recovery of oil from the reservoir system if said recovery process overall score is greater than said predetermined recovery process success score; and outputting to a display, a user interface device, a tangible computer readable data storage product, or a tangible random access memory, least one of said recovery process parameter score and said recovery process overall score.

2. The method of claim 1, wherein the one or more recovery processes with the highest recovery process overall score are deemed to have the lowest likelihood of success, and the one or more recovery processes with the lowest overall score are deemed to have the highest likelihood of success.

3. A method of operating a reservoir system to achieve enhanced or improved recovery of oil from the reservoir system, comprising executing the steps of the method of claim 1, and applying to the reservoir system a recovery process based on one or more of said recovery process parameter score assigned to said recovery process or said recovery process overall score computed for said recovery process.

4. A computer-implemented method of evaluating the likelihood of success of a waterflood (WF) process in providing enhanced recovery of oil from a reservoir system, comprising:

receiving data indicative of physical properties associated with the reservoir system, wherein said data comprises parameter values associated with one or more primary WF variables and parameter values associated with one or more secondary WF variables;

comparing each said received parameter value to one or more WF consensus values corresponding to the respective parameter;

assigning a primary WF point to a primary WF variable if the parameter value of said primary WF variable falls within a favorable range of the respective WF consensus values;

assigning a secondary WF point to a secondary WF variable if the parameter value of said secondary WF variable falls within a favorable range of the respective WF consensus values;

computing a WF screening score based on said primary WF points and said secondary WF points;

wherein said WF screening score indicates a likelihood of success of said WF process with respect to recovery of oil from the reservoir system; and wherein said steps of comparing, assigning and computing are implemented on a computer system;

receiving data indicative of physical properties associated with the reservoir system, wherein said data further comprises parameter values associated with one or more tertiary WF variables; assigning a tertiary WF point to a tertiary WF variable if the parameter value of said tertiary WF variable falls within a favorable range of the respective WF consensus values; and computing said WF screening score based on said primary WF points, said secondary WF points, and said tertiary WF points; and outputting said WF screening score to a display, a user interface device, a tangible computer readable data storage product, or a tangible random access memory.

5. The method of claim 4, further comprising, prior to said outputting, a step of comparing said WF screening score to a predetermined WF process success score, wherein said WF process is deemed likely to succeed with respect to recovery of oil from the reservoir system if said WF screening score is greater than said predetermined WF process success score, or is deemed unlikely to succeed with respect to recovery of oil from the reservoir system if said WF screening score is less than said predetermined WF process success score.

6. A method of operating a reservoir system to achieve improved recovery of oil from the reservoir system, comprising executing the steps of the method of claim 4, and applying to the reservoir system the WF process if said WF screening score indicates a likelihood of success of said WF process.

7. A method of operating a reservoir system to achieve improved recovery of oil from the reservoir system, comprising executing the steps of the method of claim 5, and applying to the reservoir system the WF process said WF process is deemed likely to succeed.

8. A method of evaluating a pattern injection scheme or a peripheral injection scheme for application of a waterflood (WF) process to a reservoir system, comprising:

receiving data indicative of physical properties associated with the reservoir system, wherein said data comprises parameter values associated with one or more primary injection scheme variables and parameter values associated with one or more secondary injection scheme variables;

comparing each said received parameter value to one or more injection scheme consensus values corresponding to the respective parameter;

assigning a primary injection scheme point to a primary injection scheme variable if the parameter value of said primary injection scheme variable falls within a favorable range of the respective injection scheme consensus values;

assigning a secondary injection scheme point to a secondary injection scheme variable if the parameter value of said secondary injection scheme variable falls within a favorable range of the respective injection scheme consensus values;

computing an injection scheme score based on said primary injection scheme points and said secondary injection scheme points;

determining a recommended injection scheme to be applied to said reservoir system for improved recovery of oil from the reservoir system;

wherein said recommended injection scheme is determined to be a pattern injection scheme if said injection scheme score is above a predetermined injection scheme viability score;

wherein said recommended injection scheme is determined to be a peripheral injection scheme if said injection scheme score is below a predetermined injection scheme viability score; and wherein said steps of comparing, assigning, computing and determining are implemented on a computer system;

receiving data indicative of physical properties associated with the reservoir system, wherein said data further comprises parameter values associated with one or more tertiary injection scheme variables; assigning a tertiary injection scheme point to a tertiary injection scheme variable if the parameter value of said tertiary injection scheme variable falls within a favorable range of the respective injection scheme consensus values; and computing said injection scheme score based on said primary injection scheme points, said secondary injection scheme points, and said tertiary injection scheme points; and outputting an indication of said recommended injection scheme to a display, a user interface device, a tangible computer readable data storage product, or a tangible random access memory.

9. The method of claim 8, further comprising, prior to outputting, receiving data indicative of physical properties associated with the reservoir system, wherein said data further comprises parameter values associated with one or more quaternary injection scheme variables; assigning a quaternary injection scheme point to a quaternary injection scheme variable if the parameter value of said quaternary injection scheme variable falls within a favorable range of the respective injection scheme consensus values; and computing said injection scheme score based on said primary injection scheme points, said secondary injection scheme points, said tertiary injection scheme points, and said quaternary injection scheme points.

10. A method of operating a reservoir system to achieve improved recovery of oil from the reservoir system, comprising executing the steps of the method of claim 8, and applying to the reservoir system said WF process according to the recommended injection scheme.

11. The method of claim 4, further comprising:

computing at least one uncorrected WF performance profile of production of oil from the reservoir system with application of the waterflood process, wherein said at least one uncorrected WF performance profile is computed based on a fit of at least one WF performance computation methodology to the received data;

converting said at least one uncorrected WF performance profile to at least one corrected WF performance profile using a statistical correction factor, wherein application of said statistical correction factor provides for direct comparison of said at least one corrected WF performance profile to a measure of production of oil from said reservoir system following application of an initial oil recovery process to said reservoir system;

wherein said at least one corrected WF performance profile provides an indication of the performance of said waterflood process in the reservoir system; and wherein said outputting step further comprises outputting said at least one corrected WF performance profile.

12. A method of operating a reservoir system to achieve improved recovery of oil from the reservoir system, comprising executing the steps of method of the method of claim 11, and applying to said reservoir system said WF process based on said at least one corrected WF performance profile.

13. A computer-implemented method of evaluating the likelihood of success of one or more recovery processes in providing enhanced or improved recovery of oil from a reservoir system, wherein said one or more recovery processes are one or more of an enhanced oil recovery (EOR) process or a waterflood process, said method comprising:

receiving data indicative of physical or chemical properties associated with the reservoir system, said data comprising one or more parameter values, wherein each said parameter value corresponds to a parameter;

comparing each said received parameter value to one or more recovery process consensus values corresponding to the respective parameter, wherein each said recovery process consensus value is associated with a recovery process, and wherein said comparing is implemented on a computer system;

assigning a recovery process parameter score to each said recovery process for each said parameter based on said comparing, wherein said assigning is implemented on a computer system;

computing a recovery process overall score for each said recovery process based on the recovery process parameter scores assigned to the recovery process, wherein said computing is implemented on a computer system;

wherein said recovery process overall score provides an indication of the likelihood of success of said recovery process with respect to recovery of oil from the reservoir system;

comparing said recovery process overall score to a predetermined recovery process success score, wherein said recovery process is deemed likely to succeed with respect to recovery of oil from the reservoir system if said recovery process overall score is greater than said predetermined recovery process success score, or is deemed unlikely to succeed with respect to recovery of oil from the reservoir system if said recovery process overall score is less than said predetermined recovery process success score; and outputting to a display, a user interface device, a tangible computer readable data storage product, or a tangible random access memory, least one of said recovery process parameter score and said recovery process overall score.

14. A method of operating a reservoir system to achieve enhanced or improved recovery of oil from the reservoir system, comprising executing the steps of the method of claim 13, and applying to the reservoir system a recovery process based on one or more of said recovery process parameter score assigned to said recovery process or said recovery process overall score computed for said recovery process.

* * * * *